US009034543B2

(12) United States Patent
Iwadate et al.

(10) Patent No.: US 9,034,543 B2
(45) Date of Patent: May 19, 2015

(54) ELECTROPHOTOGRAPHIC PHOTORECEPTOR, PROCESS CARTRIDGE, AND IMAGE FORMING APPARATUS

(71) Applicant: FUJI XEROX CO., LTD., Tokyo (JP)

(72) Inventors: Yuko Iwadate, Kanagawa (JP); Wataru Yamada, Kanagawa (JP); Hidekazu Hirose, Kanagawa (JP); Kenji Kajiwara, Kanagawa (JP); Katsumi Nukada, Kanagawa (JP); Ryo Sekiguchi, Kanagawa (JP); Takayuki Ito, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/016,671

(22) Filed: Sep. 3, 2013

(65) Prior Publication Data

US 2014/0295337 A1 Oct. 2, 2014

(30) Foreign Application Priority Data

Mar. 26, 2013 (JP) ..... 2013-065215

(51) Int. Cl.

| | |
|---|---|
| ***G03G 5/05*** | (2006.01) |
| ***G03G 5/14*** | (2006.01) |
| ***G03G 5/06*** | (2006.01) |
| ***G03G 5/147*** | (2006.01) |

(52) U.S. Cl.

CPC ..... *G03G 5/0618* (2013.01); *G03G 5/0614* (2013.01); *G03G 5/0616* (2013.01); *G03G 5/14717* (2013.01); *G03G 5/14721* (2013.01); *G03G 5/0564* (2013.01); *G03G 5/0535* (2013.01)

(58) Field of Classification Search

CPC ..... G03G 5/0564; G03G 5/0535; G03G 5/14717; G03G 5/14721

USPC ..... 430/58.7, 66, 132, 133

See application file for complete search history.

(56) References Cited

U.S. PATENT DOCUMENTS

| | | | |
|---|---|---|---|
| 5,411,827 | A | 5/1995 | Tamura et al. |
| 5,427,880 | A | 6/1995 | Tamura et al. |
| 5,456,989 | A | 10/1995 | Nogami et al. |
| 5,496,671 | A | 3/1996 | Tamura et al. |
| 5,695,898 | A | 12/1997 | Go et al. |
| 2002/0119382 | A1 | 8/2002 | Nakata et al. |
| 2004/0043312 | A1 | 3/2004 | Kikuchi et al. |

(Continued)

FOREIGN PATENT DOCUMENTS

| | | |
|---|---|---|
| JP | A-62-251757 | 11/1987 |
| JP | A-05-040360 | 2/1993 |

(Continued)

*Primary Examiner* — Christopher Rodee

(74) *Attorney, Agent, or Firm* — Oliff PLC

(57) ABSTRACT

An electrophotographic photoreceptor includes a conductive substrate; a charge generating layer provided on the conductive substrate; a charge transporting layer provided on the charge generating layer, which is configured to include a charge transporting material and a polycarbonate; and an outermost surface layer provided on the charge transporting layer, which is constituted with a cured film formed of a composition including a chain polymerizable compound having at least a charge transporting skeleton and a chain polymerizable functional group in the same molecule, and has an A value represented by the following equation (1) being from 0.1 to 0.3, and a B value represented by the following equation (2) being 0.02 or less, each of which is determined by an Attenuated total reflection Fourier transform infrared spectroscopy:

$$A=(S1/S13)-(S0/S03) \quad \text{Equation (1)}$$

$$B=S2/S23 \quad \text{Equation (2).}$$

14 Claims, 7 Drawing Sheets

(56) References Cited

U.S. PATENT DOCUMENTS

| | | | | |
|---|---|---|---|---|
| 2004/0248024 | A1 | 12/2004 | Suzuki et al. | |
| 2004/0253527 | A1 | 12/2004 | Suzuki et al. | |
| 2007/0122724 | A1 | 5/2007 | Suzuki et al. | |
| 2007/0178400 | A1 | 8/2007 | Kikuchi et al. | |
| 2007/0297836 | A1 | 12/2007 | Kawasaki et al. | |
| 2008/0020305 | A1 | 1/2008 | Suzuki et al. | |
| 2014/0072906 | A1 * | 3/2014 | Iwadate et al. | 430/56 |

FOREIGN PATENT DOCUMENTS

| | | | | | |
|---|---|---|---|---|---|
| JP | A-05-216249 | | | 8/1993 | |
| JP | A-07-072640 | | | 3/1995 | |
| JP | A-07-146564 | | | 6/1995 | |
| JP | 07325412 | A | * | 12/1995 | G03G 5/06 |
| JP | 08006274 | A | * | 1/1996 | G03G 5/06 |
| JP | A-2000-019749 | | | 1/2000 | |
| JP | A-2000-206715 | | | 7/2000 | |
| JP | A-2002-082469 | | | 3/2002 | |
| JP | B2-3287678 | | | 6/2002 | |
| JP | A-2004-012986 | | | 1/2004 | |
| JP | A-2004-302450 | | | 10/2004 | |
| JP | A-2006-084711 | | | 3/2006 | |
| JP | A-2007-086522 | | | 4/2007 | |
| JP | A-2007-286306 | | | 11/2007 | |
| JP | B2-4410691 | | | 2/2010 | |

* cited by examiner

ELECTROPHOTOGRAPHIC PHOTORECEPTOR, PROCESS CARTRIDGE, AND IMAGE FORMING APPARATUS

CROSS-REFERENCE TO RELATED APPLICATIONS

This application is based on and claims priority under 35 USC 119 from Japanese Patent Application No. 2013-065215 filed Mar. 26, 2013.

BACKGROUND

1. Technical Field

The present invention relates to an electrophotographic photoreceptor, a process cartridge, and an image forming apparatus.

2. Related Art

Generally, an electrophotographic image forming apparatus has the following configurations and processes. That is, the surface of an electrophotographic photoreceptor is charged by a charging device to defined polarity and potential, and the charged surface of the electrophotographic photoreceptor is selectively removed of charge by image-wise exposure to form an electrostatic latent image. The latent image is then developed into a toner image by attaching a toner to the electrostatic latent image by a developing unit, the toner image is transferred onto an transfer medium by a transfer unit, and then the transfer medium is discharged as an image formed material.

It has been proposed, for example, to provide the surface of an electrophotographic photoreceptor with a protective layer to increase the strength.

For example, a protective layer formed with acrylic materials has attracted attentions recently.

SUMMARY

According to an aspect of the invention, there is provided an electrophotographic photoreceptor including: a conductive substrate; a charge generating layer provided on the conductive substrate; a charge transporting layer provided on the charge generating layer, which is configured to include a charge transporting material and a polycarbonate; and an outermost surface layer provided on the charge transporting layer, which is constituted with a cured film formed of a composition including a chain polymerizable compound having at least a charge transporting skeleton and a chain polymerizable functional group in the same molecule, and has an A value represented by the following equation (1) being from 0.1 to 0.3, and a B value represented by the following equation (2) being 0.02 or less, each of which is determined by an Attenuated total reflection Fourier transform infrared spectroscopy:

$$A=(S1/S13)-(S0/S03) \quad \text{Equation (1)}$$

$$B=S2/S23 \quad \text{Equation (2)}$$

wherein in the equations (1) and (2), S1 represents a peak area of a peak based on a mono-substituted benzene in the outermost surface layer (a peak in the range from 685 $cm^{-1}$ to 715 $cm^{-1}$); S13 represents a peak area of a peak based on C═C stretching vibration of aromatics of the outermost surface layer (a peak in the range from 1500 $cm^{-1}$ to 1525 $cm^{-1}$); S0 represents a peak area of a peak based on a mono-substituted benzene of the washed outermost surface layer (a peak in the range from 685 $cm^{-1}$ to 715 $cm^{-1}$); S03 represents a peak area of a peak based on C═C stretching vibration of aromatics of the washed outermost surface layer (a peak in the range from 1500 $cm^{-1}$ to 1525 $cm^{-1}$); S2 represents a peak area of a peak based on a C═O bond of a polycarbonate of the outermost surface layer (a peak in the range from 1750 $cm^{-1}$ to 1800 $cm^{-1}$); and S23 represents a peak area of a peak based on C═C stretching vibration of aromatics of the outermost surface layer (a peak in the range from 1500 $cm^{-1}$ to 1525 $cm^{-1}$).

BRIEF DESCRIPTION OF THE DRAWINGS

Exemplary embodiments of the present invention will be described in detail based on the following figures, wherein.

DETAILED DESCRIPTION

Figure 1:
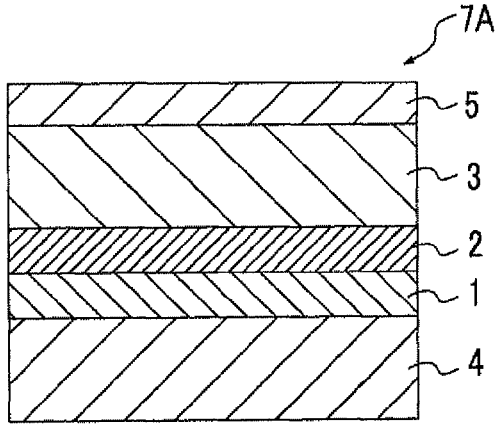
FIG. 1 is a schematic partial cross-sectional view showing an example of the layer configuration of the electrophotographic photoreceptor according to the present exemplary embodiment.

Hereinbelow, the present exemplary embodiment which is one example of the invention will be described.

Electrophotographic Photoreceptor

The electrophotographic photoreceptor according to the present exemplary embodiment has a conductive substrate, a charge generating layer provided on the conductive substrate, a charge transporting layer provided on the charge generating layer, and an outermost surface layer provided on the charge transporting layer.

The charge transporting layer is configured to include a charge transporting material and a polycarbonate.

Further, the outermost surface layer is constituted with a cured film formed of a composition including a chain polymerizable compound having at least a charge transporting skeleton and a chain polymerizable functional group in the same molecule, and has an A value represented by the following equation (1) being from 0.1 to 0.3, and a B value represented by the following equation (2) is 0.02 or less, each of which is determined by an Attenuated total reflection Fourier transform infrared spectroscopy.

$$A=(S1/S13)-(S0/S03) \quad \text{Equation (1)}$$

$$B=S2/S23 \quad \text{Equation (2)}$$

In the equations (1) and (2), S1 represents a peak area of a peak based on a mono-substituted benzene in the outermost surface layer (a peak in the range from 685 $cm^{-1}$ to 715 $cm^{-1}$). Specifically, S1 represents a peak area of a peak based on a mono-substituted benzene at a position of 1 μm from the interface between the outermost surface layer as it is formed on the charge transporting layer (that is, the unwashed outermost surface layer) and the charge transporting layer to the side of the surface.

S13 represents a peak area of a peak based on C═C stretching vibration of aromatics of the outermost surface layer (a peak in the range from 1500 $cm^{-1}$ to 1525 $cm^{-1}$). Specifically, S13 represents a peak area of a peak based on C═C stretching vibration of aromatics at a position of 1 μm from the interface between the outermost surface layer as it is formed on the charge transporting layer (that is, the unwashed outermost surface layer) and the charge transporting layer to the side of the surface.

S0 represents a peak area of a peak based on a mono-substituted benzene of the washed outermost surface layer (a peak in the range from 685 $cm^{-1}$ to 715 $cm^{-1}$). Specifically, S0 represents a peak area of a peak based on a mono-substituted benzene at a position of 1 μm from the interface between the charge transporting layer and the washed outermost surface layer to the side of the surface.

S03 represents a peak area of a peak based on C═C stretching vibration of aromatics at a position of 1 μm from the interface between the outermost surface layer as it is formed as a monolayer on a measurement substrate and the measurement substrate on the charge transporting layer to the side of the surface (a peak in the range from 1500 $cm^{-1}$ to 1525 $cm^{-1}$). Specifically, S03 represents a peak area of a peak based on C═C stretching vibration of aromatics at a position of 1 μm from the interface between the washed outermost surface layer and the charge transporting layer to the side of the surface.

S2 represents a peak area of a peak based on a C═O bond of a polycarbonate of the outermost surface layer (a peak in the range from 1750 $cm^{-1}$ to 1800 $cm^{-1}$). Specifically, S2 represents a peak area of a peak based on a C═O bond of the polycarbonate at a position of 1 μm from the surface of the outermost surface layer as it is formed on the charge transporting layer (that is, a unwashed outermost surface layer) to the side of the charge transporting layer.

S23 represents a peak area of a peak based on C═C stretching vibration of aromatics of the outermost surface layer (a peak in the range from 1500 $cm^{-1}$ to 1525 $cm^{-1}$). Specifically, S23 represents a peak area of a peak based on C═C stretching vibration of aromatics at a position of 1 μm from the surface of the outermost surface layer as it is formed on the charge transporting layer (that is, the unwashed outermost surface layer) to the side of the charge transporting layer.

Further, a "position at 1 μm from an interface (or a surface corresponding to the interface) to the side of the surface" refers to a position having a length along the thickness direction of 1 μm, starting from an interface (or a surface corresponding to an interface) in the cut surface when a layer is cut along the thickness direction. Further, a "position at 1 μm from the surface to the side of the charge transporting layer" refers to a position having a length along the thickness direction of 1 μm, starting from the surface in the cut surface when a layer is cut along the thickness direction.

It is thought that the electrophotographic photoreceptor according to the present exemplary embodiment becomes an electrophotographic photoreceptor having an outermost surface layer having excellent electrical characteristics and scratch resistance by the configuration above. The reason is not clear, but is thought to be as described below.

First, as the outermost surface layer of the electrophotographic photoreceptor, it is effective for high strength to form a cured film with a composition including a chain polymerizable compound on a charge transporting layer. This outermost surface layer is formed by coating a coating liquid including a chain polymerizable compound onto the charge transporting layer. As a result, according to the kind of the solvent used to prepare a coating liquid, in the case of forming the outermost surface layer by coating, a phenomenon that a charge transporting material included in the charge transporting layer of the lower layer moves into the outermost surface layer may occur in some cases.

A small amount of the charge transporting material moving to the outermost surface layer contributes to improvement of a charge injection property at an interface between the outermost surface layer and the charge transporting layer, while a large amount of the charge transporting material moving to the outermost surface layer decreases the concentration of the chain polymerizable compound in the outermost surface layer, leading to a decrease in the strength.

Based on this, "S1/S13" in the equation (1) represents the ratio of the monosubstituted benzene (—($C_6H_5$)) based on the aromatic double bond (aromatic C═C bond) derived from the entire components of the outermost surface layer at a position of 1 μm from an interface between the outermost surface layer as it is formed on the charge transporting layer and the charge transporting layer to the side of the surface. This is based on that the charge transporting material moving from the charge transporting layer to the outermost surface layer is an non-reactive compound, it has a mono-substituted benzene (—($C_6H_5$)).

"S0/S03" in the equation (1) represents the ratio of the mono-substituted benzene (—($C_6H_5$)) based on the aromatic double bond (aromatic C═C bond) derived from the entire components of the outermost surface layer at a position of 1 μm from a surface corresponding to the interface between the washed outermost surface layer, that is, the outermost surface layer as the charge transporting material is removed therefrom by washing with a method described later and the charge transporting layer to the side of the surface.

That is, since A shown in the equation (1) is a difference between "S1/S13" and "S0/S03", the A is a value showing whether the charge transporting material moves to some degrees near the interface between the outermost surface layer and the charge transporting layer when the outermost surface layer is formed on the charge transporting layer, based on the outermost surface layer as the charge transporting material does not move (the moving charge transporting material is removed). In addition, the A value satisfying the above range means that the charge transporting material moves to the outermost surface layer to a degree that contributes to the improvement of the charge injection property at the interface between the outermost surface layer and the charge transporting layer.

On the other hand, in the case of forming the outermost surface layer by coating, a phenomenon that a polycarbonate which is a binder resin included in the charge transporting layer of the lower layer is dissolved or swollen, and moves into the outermost surface layer may occur in some cases, according to the kind of the solvent used to prepare a coating liquid.

When the polycarbonate moves into the outermost surface layer, it enters between the molecules of the chain polymerizable compound, which is thought to suppress the chain polymerization reaction, and the film strength of a cured film decreases, and thus, the scratch resistance decreases. Further, it is thought that the concentration of the chain polymerizable compound decreases, and thus the film strength of the cured film decreases and the scratch resistance decreases.

Based on this, "S2/S23" represents the ratio of the C=O bonds of the polycarbonate based on the aromatics derived from the entire components of the outermost surface layer at a position of 1 μm from the surface of the outermost surface layer as it is formed on the charge transporting layer to the side of the charge transporting layer.

That is, the B value (=S2/S23) represented by the equation (2) is a value showing whether the polycarbonate decreasing the film strength moves to some degrees to the side of the surface of the outermost surface layer when the outermost surface layer is formed on the charge transporting layer. Further, the B value satisfying the above range means that a small amount of the polycarbonate moves to the side of the surface of the outermost surface layer, and thus, the concentration of the chain polymerizable compound in the outermost surface layer does not decrease, and further, the chain polymerization proceeds sufficiently.

From the description above, the electrophotographic photoreceptor according to the present exemplary embodiment becomes an electrophotographic photoreceptor having an outermost surface layer having excellent electrical characteristics and scratch resistance. Further, the electrophotographic photoreceptor having the above characteristics suppresses, for example, variation in the potential in an exposed area, and thus, the image concentration stability and the image quality consistency are easily accomplished.

In addition, long lifetime of a process cartridge and an image forming apparatus, each of which includes the electrophotographic photoreceptor according to the present exemplary embodiment, is accomplished.

Here, in the electrophotographic photoreceptor according to the present exemplary embodiment, the A value represented by the equation (1) is from 0.1 to 0.3, and preferably from 0.12 to 0.28.

On the other hand, the B value represented by the equation (2) is 0.02 or less, and preferably 0.015 or less. Further, the B value is more preferably 0, and for example, the lower limit thereof is 0.001 or more.

Regarding a method for adjusting the A value and the B value to the ranges above, the adjustment is conducted by 1) applying a polycarbonate copolymer having a specific range of solubility parameters as calculated by a Feders method, as described later, as a polycarbonate in a charge transporting layer; 2) adopting a solvent used to form an outermost surface layer; or the like.

Further, measurement of the respective peak areas for calculating the A and B value is carried out by an Attenuated total reflection Fourier transform infrared spectroscopy, that is, a method called an Attenuated Total Reflection (ATR) method among Fourier Transform Infrared Spectroscopy methods. Specifically, the method is as follows.

First, the respective peak areas on the outermost surface layer as it is formed on the charge transporting layer are as follows.

The interface between the conductive substrate and the undercoat layer in the electrophotographic photoreceptor is peeled and embedding-treated; the side of the upper layer including the undercoat layer is then cut obliquely by a microtomy method with respect to the interface between the conductive substrate and the undercoat layer with a cross-section along the thickness direction of the outermost surface layer being a measurement surface; and a measurement sample having an enlarged measurement surface is collected. Here, the "position at 1 μm" as described above is a value based on the cross-section perpendicular to the outer peripheral surface of the conductive substrate, and therefore, whether a certain position in the cross-section cut obliquely corresponds to the "position at 1 μm" or not is determined by calculation using the cutting angle.

Using this measurement sample, by a microscopic reflection method using a Fourier Transform Infrared Spectrometer (FTIR MAGNA-850, manufactured by Nicolet), absorption spectra are obtained at a position of 1 μm from the interface between the outermost surface layer as it is formed on the charge transporting layer and the charge transporting layer to the side of the surface, or at a position of 1 μm from the surface of the outermost surface layer as it is formed on the outermost surface layer as it is formed on the charge transporting layer to the side of the charge transporting layer, and thus, the respective peak areas at desired measurement positions are determined.

Further, the conditions of an apparatus of the Fourier Transform Infrared Spectrometer (FTIR MAGNA-850, manufactured by Nicolet) are as follows.

Internal reflection element (prism): Ge (germanium)

Incident angle: 45 degrees

Here, a method for washing the outermost surface layer for measuring the respective measurement areas of "S0" and "S03" of "S0/S03" in the equation (1) is shown.

First, a sample piece at 10 mm×10 mm of the outermost surface layer is peeled. The peeling is conducted between the undercoat layer and the charge generating layer, and the charge generating layer may remain partially on the side of the undercoat layer.

Next, the peeled sample piece is dipped in 10 ml of THF (tetrahydrofuran), and washed at 25° C. for 30 minutes. Thereafter, THF is exchanged with fresh one, and washed by ultrasonification again for 30 minutes.

Further, the above process is repeated and ultrasonification washing is carried out five times, and then drying is carried out at 80° C. for 1 day in vacuo using a vacuum drier, thereby obtaining a measurement sample.

The obtained measurement sample is embedding-treated, and then cut and measured by the above-described method, thereby determining the respective peak areas.

Hereinafter, the electrophotographic photoreceptor according to the present exemplary embodiment will be described in detail with reference to the drawings.

FIG. 1 is a schematic cross-sectional view showing an example of the electrophotographic photoreceptor according to the present exemplary embodiment.

The electrophotographic photoreceptor 7A as shown in FIG. 1 is so-called a function separation type photoreceptor (or a laminated layer type photoreceptor), which has a structure including an undercoat layer 1 provided on a conductive substrate 4, and having a charge generating layer 2, a charge transporting layer 3, and a protective layer 5 as the outermost surface layer, formed in this order thereon. In the electrophotographic photoreceptor 7A, a photosensitive layer is constituted with a charge generating layer 2 and a charge transporting layer 3.

In addition, an undercoat layer 1 may or may not be provided in the electrophotographic photoreceptor shown in FIG. 1.

Hereinbelow, the respective elements of the electrophotographic photoreceptor 7A shown in FIG. 1 will be described. In addition, the symbols will be omitted in the description.

Conductive Substrate

Any conductive substrate may be used such as the conductive substrate which has been used in the related art. Examples thereof include a resin film provided with a thin film (for example, films formed of metals such as aluminum, nickel, chromium, and stainless steel, aluminum, titanium, nickel, chromium, stainless steel, gold, vanadium, tin oxide, indium oxide, indium tin oxide (ITO), and the like); a paper coated or impregnated with a conductivity-imparting agent; and a resin film coated or impregnated with a conductivity-imparting agent. The shape of the substrate is not limited to a cylindrical shape and may be a sheet shape or a plate shape.

In addition, the conductive substrate preferably has conductivity, for example, with a resistivity of less than $10^7$ Ω·cm.

When a metal pipe is used as the conductive substrate, the surface thereof may be as it is or may be subjected to a treatment such as mirror grinding, etching, anodizing, rough grinding, centerless grinding, sandblasting, or wet honing.

Undercoat Layer

The undercoat layer is provided, if necessary, in order to prevent the light reflection at the surface of the conductive substrate, or to prevent the unnecessary carrier injection from the conductive substrate to the organic photosensitive layer.

The undercoat layer includes a binder resin and, if necessary, other additives, for example.

Examples of the binder resin included in the undercoat layer include known polymer resin compounds, for example, acetal resins such as polyvinyl butyral, polyvinyl alcohol resins, casein, polyamide resins, cellulose resins, gelatin, polyurethane resins, polyester resins, methacrylic resins, acrylic resins, polyvinyl chloride resins, polyvinyl acetate resins, vinyl chloride-vinyl acetate-maleic anhydride resins, silicone resins, silicone-alkyd resins, urea resins, phenol resins, phenol-formaldehyde resins, melamine resins, unsaturated urethane resins, polyester resins, alkyd resins, and epoxy resins; and conductive resins such as a charge transporting resin having a charge transporting group, and polyaniline.

Among these, as a binder resin, a resin which is insoluble in the coating solvent for the upper layer (charge generating layer) is preferable, and in particular, a thermosetting resin such as a urea resin, a phenol resin, a phenol-formaldehyde resin, a melamine resin, a urethane resin, an unsaturated polyester resin, an alkyd resin, and an epoxy resin, or a resin obtained by the reaction of at least one selected from the group consisting of a polyamide resin, a polyester resin, a polyether resin, an acrylic resin, a polyvinyl alcohol resin, and a polyvinyl acetal resin with a curing agent are suitable.

In the case where two or more of these binder resins are used in combination, the blending ratio is set as necessary.

The undercoat layer may contain, for example, a metal compound such as a silicone compound, an organic zirconium compound, an organic titanium compound, and an organic aluminum compound.

The ratio between the metal compound and the binder resin is not particularly limited and is set in a range in which preferable characteristics of the electrophotographic photoreceptor may be obtained.

Resin particles may be added in the undercoat layer in order to adjust the surface roughness of the undercoat layer. Examples of the resin particles include silicone resin particles, and cross-linked poly methyl methacrylate (PMMA) resin particles. In addition, after the formation of the undercoat layer, the surface thereof may be polished in order to adjust the surface roughness. As a polishing method, buffing grinding, a sandblasting treatment, wet honing, a grinding treatment, or the like, is employed.

Examples of the configuration of the undercoat layer include a configuration including at least a binder resin and conductive particles. Further, the conductive particles having a volume resistivity of less than $10^7$ Ω·cm are preferable.

Examples of the conductive particles include, for example, metal particles (particles of aluminum, copper, nickel, silver, or the like), conductive metal oxide particles (particles of antimony oxide, indium oxide, tin oxide, zinc oxide, or the like), and conductive material particles (particles of carbon fiber, carbon black, graphite powders, or the like). Among these examples, conductive metal oxide particles may be used. The conductive particles may be used in a combination of two or more types.

In addition, the resistance of the conductive particles may be adjusted by surface treatment using a hydrophobizing agent (such as a coupling agent) or the like.

The content of the conductive particles may be in a range from 10% by weight to 80% by weight, or in a range from 40% by weight to 80% by weight, with respect to the binder resin.

Formation of the undercoat layer is not particularly limited, but a known forming method is used. For examples, the process is carried out by forming a coating film of a coating liquid for forming an undercoat layer, formed by adding the components above to a solvent, and drying and, if necessary, heating the coating film.

Examples of a method for coating the conductive substrate with the coating liquid for forming an undercoat layer include a dip-coating method, an extrusion coating method, a wire-bar coating method, a spray coating method, a blade coating method, a knife coating method, and a curtain coating method.

In addition, in the case of dispersing the particles into the coating liquid for forming an undercoat layer, in the dispersing method, a media dispersing machine such as a ball mill, a vibrating ball mill, an attritor, a sand mill, and a horizontal sand mill, or a medialess dispersing machine such as a stirrer, an ultrasonic dispersing machine, a roll mill, and a high-pressure homogenizer is used. Here, examples of the high-pressure homogenizer system include a collision system in which the particles are dispersed by causing the dispersion liquid to collide against liquid or against walls under a high pressure, and a penetration system in which the particles are dispersed by causing the dispersion liquid to penetrate through a fine flow path under a high pressure.

The film thickness of the undercoat layer is set within a range of preferably 15 μm or more, and more preferably from 20 μm to 50 μm.

Although not shown in the drawing, an intermediate layer may be further provided between the undercoat layer and the photosensitive layer. Examples of the binder resin used for the intermediate layer include a polymer resin compound such as an acetal resin such as polyvinyl butyral, a polyvinyl alcohol resin, casein, a polyamide resin, a cellulose resin, gelatin, a polyurethane resin, a polyester resin, a methacrylic resin, an acrylic resin, a polyvinyl chloride resin, a polyvinyl acetate resin, a vinyl chloride-vinyl acetate-maleic anhydride resin, a silicone resin, a silicone-alkyd resin, a phenol-formaldehyde resin, or a melamine resin, an organic metal compound containing zirconium, titanium, aluminum, manganese, or silicon atoms. The compound may be used alone or as a mixture or a polycondensation product of plural compounds. Among them, the organic metal compound containing zirconium or silicon may be preferably used from the viewpoint that such an organic metal compound has a low residual potential and exhibits less potential change due to the environment or due to the repeated usage thereof.

Formation of the intermediate layer is not particularly limited, but a known forming method is used. For examples, the process is carried out by forming a coating film of a coating liquid for forming an intermediate layer, formed by adding the components above to a solvent, and drying and, if necessary, heating the coating film.

As a method for coating the coating liquid for forming an intermediate layer onto the undercoat layer, for example, an ordinary method such as a dip-coating method, an extrusion coating method, a wire-bar coating method, a spray coating method, a blade coating method, a knife coating method, and a curtain coating method is used.

The intermediate layer functions to improve the coating property of the upper layer, and in addition, the intermediate layer functions as an electrically-blocking layer. When the layer thickness thereof is excessively large, however, the electrical blocking functions too strongly, which results in a decrease in the sensitivity or in an increase in the potential due to the repeated usage, in some cases. Accordingly, when the intermediate layer is formed, the film thickness is preferably set to be in a range from 0.1 μm to 3 μm. In addition, the intermediate layer in this case may be used as the undercoat layer.

Charge Generating Layer

The charge generating layer is configured to include, for example, a charge generating material and a binder resin. Further, the charge generating layer may be constituted with, for example, a vapor deposition film of a charge generating material.

Examples of the charge generating material include a phthalocyanine pigment such as metal-free phthalocyanine, chlorogallium phthalocyanine, hydroxygallium phthalocyanine, dichlorotin phthalocyanine, or titanyl phthalocyanine. In particular, examples thereof include chlorogallium phthalocyanine crystals which have main diffraction peak intensities at the Bragg angles (20±0.2°) of at least 7.4°, 16.6°, 25.5°, and 28.3° with respect to CuKα characteristic X-rays, metal-free phthalocyanine crystals which have main diffraction peak intensities at the Bragg angles (2θ±0.2°) of at least 7.7°, 9.3°, 16.9°, 17.5°, 22.4°, and 28.8° with respect to CuKα characteristic X-rays, hydroxygallium phthalocyanine crystals which have main diffraction peak intensities at the Bragg angles (2θ±0.2°) of at least 7.5°, 9.9°, 12.5°, 16.3°, 18.6°, 25.1°, and 28.3° with respect to CuKα characteristic X-rays, and titanyl phthalocyanine crystals which have main diffraction peak intensities at the Bragg angles (2θ±0.2°) of at least 9.6°, 24.1°, and 27.2° with respect to CuKα characteristic X-rays. In addition, examples of the charge generating material include a quinone pigment, a perylene pigment, an indigo pigment, a bisbenzo-imidazole pigment, an anthrone pigment, and a quinacridone pigment. In addition, these charge generating materials may be used alone or in a mixture of two or more types.

Examples of the binder resin that constitutes the charge generating layer include a polycarbonate resin (for example, a polycarbonate resin of a bisphenol A type and a polycarbonate resin of a bisphenol Z type), an acrylic resin, a methacrylic resin, a polyallylate resin, a polyester resin, a polyvinyl chloride resin, a polystyrene resin, an acrylonitrile-styrene copolymer resin, an acrylonitrile-butadiene copolymer resin, a polyvinyl acetate resin, a polyvinylformal resin, a polysulfone resin, a styrene-butadiene copolymer resin, a vinylidene chloride-acrylonitrile copolymer resin, a vinyl chloride-vinyl acetate-maleic anhydride resin, a silicone resin, a phenol-formaldehyde resin, a polyacrylamide resin, a polyamide resin, and a poly-N-vinylcarbazole resin. These binder resins may be used singly or as a mixture of two or more kinds thereof.

Further, the blending ratio of the charge generating material to the binder resin is preferably, for example, in the range of 10:1 to 1:10.

The charge generating layer may further contain known additives.

Formation of the charge generating layer is not particularly limited, but a known forming method is used. For examples, the process is carried out by forming a coating film of a coating liquid for forming a charge generating layer, formed by adding the components above to a solvent, and drying and, if necessary, heating the coating film. Further, formation of the charge generating layer may also be carried out by the vapor deposition of the charge generating material.

Examples of a method for coating the coating liquid for forming a charge generating layer onto the undercoat layer (or on the intermediate layer) include a dip-coating method, an extrusion coating method, a wire-bar coating method, a spray coating method, a blade coating method, a knife coating method, and a curtain coating method.

Furthermore, in a method for dispersing the particles (for example, the charge generating materials) in the coating liquid for forming a charge generating layer, for example a media dispersing machine such as a ball mill, a vibrating ball mill, an attritor, a sand mill, and a horizontal sand mill, or a medialess dispersing machine such as a stirrer, an ultrasonic dispersing machine, a roll mill, and a high-pressure homogenizer is used. Examples of the high-pressure homogenizer system include a collision system in which the particles are dispersed by causing the dispersion liquid to collide against liquid or against walls under a high pressure, and a penetration system in which the particles are dispersed by causing the dispersion liquid to penetrate through a fine flow path under a high pressure.

The film thickness of the charge generating layer is set within a range of preferably from 0.01 μm to 5 μm, and more preferably from 0.05 μm to 2.0 μm.

Charge Transporting Layer

The charge transporting layer is configured to include a charge transporting material and a binder resin.

Examples of the charge transporting material include an oxadiazole derivative such as 2,5-bis(p-diethylaminophenyl)-1,3,4-oxadiazol; a pyrazoline derivative such as 1,3,5-triphenyl-pyrazoline and 1-[pyridyl-(2)]-3-(p-diethylaminostyryl)-5-(p-diethylaminostyryl)pyrazoline; an aromatic tertiary amino compound such as triphenylamine, tris[4-(4,4-diphenyl-1,3-butadienyl)phenyl]amine, N,N'-bis(3,4-dimethylphenyl)biphenyl-4-amine, tri(p-methylphenyl)aminyl-4-amine, and dibenzylaniline; an aromatic tertiary diamino compound such as N,N'-bis(3-methylphenyl)-N,N'-diphenylbenzidine; a 1,2,4-triazine derivative such as 3-(4'-dimethylaminophenyl)-5,6-di-(4'-methoxyphenyl)-1,2,4-triazine; a hydrazone derivative such as 4-diethylaminobenzaldehyde-1,1-diphenylhydrazone; a quinazoline derivative such as 2-phenyl-4-styryl-quinazoline; a benzofuran derivative such as 6-hydroxy-2,3-di(p-methoxyphenyl)benzofuran; an α-stilbene derivative such as p-(2,2-diphenylvinyl)-N,N-diphenylaniline; an enamine derivative; a carbazole derivative such as N-ethylcarbazole; a hole transporting material such as poly-N-vinylcarbazole and a derivative thereof; a quinone compound such as chloranil and bromoanthraquinone; a tetracyanoquinodimethane compound; a fluorenone compound such as 2,4,7-trinitrofluorenone and 2,4,5,7-tetranitro-9-fluorenone; an electron transporting material such as a xanthone compound, and a thiophene compound, and a polymer having a group constituted by the above compound at a main chain or a side chain.

These charge transporting materials may be used singly or in combination of two or more kinds thereof.

Among these, from the viewpoint of the charge mobility of the charge transporting layer, at least one selected from a triarylamine derivative represented by the following formula (a-1) and a benzidine derivative represented by the following formula (a-2) is preferable.

(a-1)

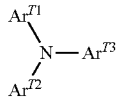

In the above formula (a-1), $Ar^{T1}$, $Ar^{T2}$, and $Ar^{T3}$ each independently represent a substituted or unsubstituted aryl group, $—C_6H_4—C(R^{T4})=C(R^{T5})(R^{T6})$, or $—C_6H_4—CH=CH—CH=C(R^{T7})(R^{T8})$. $R^{T4}$, $R^{T5}$, $R^{T6}$, $R^{T7}$, and $R^{T8}$ each independently represent a hydrogen atom, a substituted or unsubstituted alkyl group, or a substituted or unsubstituted aryl group.

Here, examples of a substituent of the above respective groups include a halogen atom, an alkyl group having from 1 to 5 carbon atoms, an alkoxy group having from 1 to 5 carbon atoms, and a substituted amino group substituted with an alkyl group having from 1 to 3 carbon atoms.

(a-2)

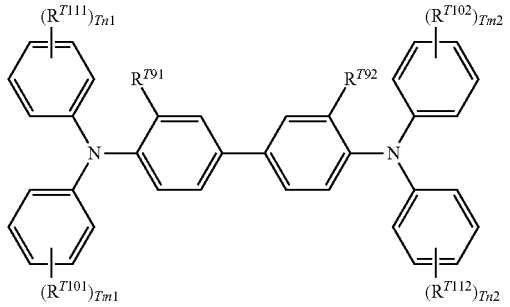

In the above formula (a-2), $R^{T91}$ and $R^{T92}$ each independently represent a hydrogen atom, a halogen atom, an alkyl group having from 1 to 5 carbon atoms, or an alkoxy group having from 1 to 5 carbon atoms. $R^{T101}$, $R^{T102}$, $R^{T111}$ and $R^{T112}$ each independently represent a halogen atom, an alkyl group having from 1 to 5 carbon atoms, an alkoxy group having from 1 to 5 carbon atoms, an amino group substituted with an alkyl group having from 1 to 2 carbon atoms, a substituted or unsubstituted aryl group, $—C(R^{T12})=C(R^{T13})(R^{T14})$, or $—CH=CH—CH=C(R^{T15})(R^{T16})$. $R^{T12}$, $R^{T13}$, $R^{T14}$, $R^{T15}$ and $R^{T16}$ each independently represent a hydrogen atom, a substituted or unsubstituted alkyl group, or a substituted or unsubstituted aryl group. Tm1, Tm2, Tn1 and Tn2 each independently represent an integer from 0 to 2.

Here, among the triarylamine derivative represented by the above formula (a-1) and the benzidine derivative represented by the above formula (a-2), in particular, the triarylamine derivative having "$—C_6H_4—CH=CH—CH=C(R^{T7})(R^{T8})$" and the benzidine derivative having "$—CH=CH—CH=C(R^{T15})(R^{T16})$" are excellent and preferable from the viewpoint of a charge mobility.

As a binder resin, a polycarbonate is applied. Examples of the polycarbonate include various polycarbonates, but are polycarbonate copolymers (hereinafter referred to as a "specific polycarbonate copolymer") having a solubility parameter calculated by a Feders method (hereinafter sometimes referred to as an "SP value") ranging from 11.40 to 11.75 (preferably from 11.40 to 11.70), from the viewpoint of the improvement of electrical characteristics and scratch resistance of the protective layer (outermost surface layer).

Within the range of SP values of the specific polycarbonate copolymer, the polycarbonate is suppressed from moving to the protective layer (outermost surface layer), and thus, the A and B values are easily satisfied.

Further, in the case where the protective layer (outermost surface layer) contains fluorine-containing resin particles, an SP value of the polycarbonate copolymer of 11.40 or more suppresses uneven distribution of the fluorine-containing resin particles on the surface layer of the protective layer (outermost surface layer). On the other hand, an SP value of a specific polycarbonate copolymer of 11.75 or less suppresses deterioration of the compatibility of the charge transporting layer with the charge transporting material, and thus, a decrease in the electrical characteristics of the electrophotographic photoreceptor (particularly an increase in the residual potential due to repeated use) is easily suppressed.

The specific polycarbonate copolymer preferably has a repeating structural unit having an SP value ranging from 12.20 to 12.40. It is thought that if the polycarbonate copolymer has a repeating structural unit having an SP value in the above range as at least one of the repeating structural units, the compatibility of the entire specific polycarbonate copolymer with the resin components of the protective layer (outermost surface layer) easily decreases, and thus, the diffusion of the charge transporting materials of the charge transporting layer into the protective layer is easily suppressed. For this, the A and B values are easily satisfied, and thus, a decrease in the electrical characteristics of the electrophotographic photoreceptor (particularly an increase in the residual potential due to repeated use) is easily suppressed.

Here, the Feders method refers to a convenient method for calculating a solubility parameter (SP value) from a structural formula. Specifically, in the Feders method, when the cohesive energy density is denoted as ΔE and the molar volume is denoted as V, and the solubility parameter is calculated from SP Value $\delta=(\Delta E/V)^{1/2}=(\Sigma\Delta_{ei}/\Sigma\Delta_{vi})^{1/2}$. Further, ei and vi are the cohesive energy and the molar volume of the unit of the structural formula, respectively, and the list thereof is described in, for example, "Fundamentals and Engineering of Coating" (Processing Technology Study Association), p. 55".

Further, $(cal/cm^3)^{1/2}$ is employed as a unit of the solubility parameter (SP value), but according to the customary practice, the solubility parameter is denoted without a dimension with the omission of the unit.

Moreover, the method for calculating the solubility parameter (SP value) according to the Feders method is defined as follows. That is, the solubility parameter of the repeating structural unit constituting the copolymer is denoted as δn and the existence ratio (molar ratio) of the repeating structural unit in the copolymer is denoted as χn, and the solubility parameter (SP value) of the copolymer is denoted as $\delta=\Sigma(\delta n\cdot\chi n)$. When the solubility parameter (SP value) of the repeating structural unit is calculated, the cohesive energy and the molar volume of the carbonate group use the values of $\Delta e_i$=4200 cal/mol and $\Delta v_i$=22.0 $cm^3$/mol, shown in the list of "Fundamentals and Engineering of Coating" (Processing Technology Study Association), p. 55. For example, the copolymer is a polycarbonate copolymer formed by the polymerization of bisphenol Z monomers and bisphenol F monomers, and in the case where the molar ratio of the respective repeating units is 70% of Z units/30% of F units, the repeating unit structure of the Z unit has the following Z unit (I): $\delta_z=((1180\times5+350\times1+7630\times2+4200\times1+250\times1)/(16.1\times5+(-19.2)\times1+52.4\times2+22.0\times1+16\times1))^{1/2}=-11.28$; the repeating unit structure of the F unit has the following F unit (I): $\delta_F=((1180\times1+7630\times2+4200\times1)/(16.1\times1+52.4\times2+22.0\times1))^{1/2}=12.02$; and the solubility parameter $\delta_{Z70F30}$ of the polycarbonate copolymer is as follows: $\delta_{Z70F30}=11.28\times0.7+12.02\times0.3=11.50$.

Z Unit (I)

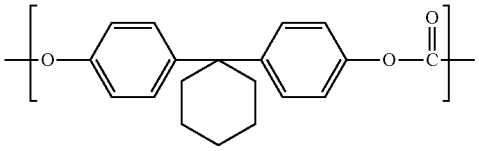

F Unit (I)

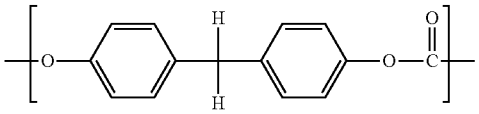

Specific examples of the specific polycarbonate copolymer include a copolymer of at least two or more divalent monomers (hereinafter referred to as a "divalent phenol") selected from a biphenyl monomer and a bisphenol monomer.

Particularly, from the viewpoint of suppression of the uneven distribution of the fluorine-containing resin particles on the surface layer side of the outermost surface layer, specific suitable examples of the polycarbonate copolymer include a polycarbonate copolymer having the repeating structural units represented by the following formula (PC-1) and a polycarbonate copolymer having repeating the structural units represented by the following formula (PC-2). Specifically, examples of the specific polycarbonate copolymer include:

1) a polycarbonate copolymer having two or more repeating structural units represented by the following formula (PC-1), having different structures from each other, 2) a polycarbonate copolymer having two or more repeating structural units represented by the following formula (PC-2), having different structures from each other, and 3) a polycarbonate copolymer having one or two or more repeating structural units represented by the following formula (PC-1), having different structures from each other, and one or two or more repeating structural units represented by the following formula (PC-2), having different structures from each other.

Further, for the specific polycarbonate copolymer, each repeating structural unit (monomer) is selected so as to allow the SP value to be in the above range.

(PC-1)

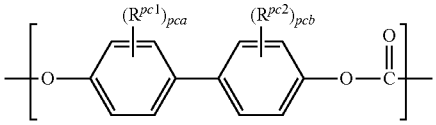

In the formula (PC-1), $R^{pc1}$ and $R^{pc2}$ each independently represent a halogen atom, an alkyl group having 1 to 6 carbon atoms, a cycloalkyl group having 5 to 7 carbon atoms, or an aryl group having 6 to 12 carbon atoms.

pca and pcb each independently represent an integer of 0 to 4.

In the formula (PC-1), $R^{pc1}$ and $R^{pc2}$ each independently preferably represent an alkyl group having 1 to 6 carbon atoms, and more preferably a methyl group.

In the formula (PC-1), pca and pcb each independently represent an integer of 0 to 2, and in particular, most preferably 0.

(PC-2)

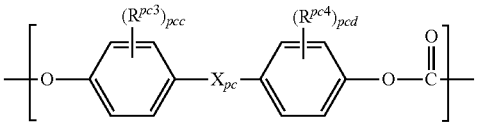

In the formula (PC-2), $R^{pc3}$ and $R^{pc4}$ each independently represent a halogen atom, an alkyl group having 1 to 6 carbon atoms, a cycloalkyl group having 5 to 7 carbon atoms, or an aryl group having 6 to 12 carbon atoms. pcc and pcd each independently represent an integer of 0 to 4. $X_{pc}$ represents —$CR^{pc5}R^{pc6}$— (provided that $R^{pc5}$ and $R^{pc6}$ each independently represent a hydrogen atom, a trifluoromethyl group, an alkyl group having 1 to 6 carbon atoms, or an aryl group having 6 to 12 carbon atoms), a 1,1-cycloalkylene group having 5 to 11 carbon atoms, an α,ω-alkylene group having 2 to 10 carbon atoms, —O—, —S—, —SO—, or —$SO_2$—.

In the formula (PC-2), $R^{pc3}$ and $R^{pc4}$ each independently preferably represent an alkyl group having 1 to 6 carbon atoms, and more preferably a methyl group.

pcc and pcd each independently preferably represent an integer of 0 to 2.

$X_{pc}$ preferably represents —$CR^{pc5}R^{pc6}$— (provided that $R^{pc5}$ and $R^{pc6}$ each independently preferably represent a hydrogen atom or an alkyl group having 1 to 6 carbon atoms), or a 1,1-cycloalkylene group having 5 to 11 carbon atoms.

For the specific polycarbonate copolymer, from the viewpoint of the suppression of uneven distribution of the fluorine-containing resin particles on the surface layer side of the outermost surface layer, the ratio (molar ratio) of the repeating structural unit represented by the formula (PC-1) may be from 20% by mole to 40% by mole, and preferably from 23% by mole to 37% by mole, based on the specific polycarbonate copolymer (the entire repeating structural units).

Further, from the viewpoint of the suppression of uneven distribution of the fluorine-containing resin particles on the surface layer side of the outermost surface layer, the ratio (molar ratio) of the repeating structural unit represented by the formula (PC-2) may be from 35% by mole to 55% by mole, and preferably from 38% by mole to 52% by mole, based on the specific polycarbonate copolymer (the entire repeating structural units).

Specific examples of the repeating unit constituting the specific polycarbonate copolymer are shown below. Further, specific examples of the repeating structural unit are shown by exemplifying the structures of the X moiety of the divalent phenol HO—(X)—OH that forms the repeating unit. Specifically, for example, the repeating structural unit represented by "(BP)-0" in the column of Unit No. represents a structural unit represented by [—O—(the structure shown in the column of the structure) —O—C(=O)—].

| Unit No. | Structure | Solubility parameter (SP value) |
|---|---|---|
| (BP)-0 | 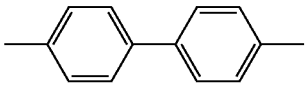 | 12.39 |
| (BP)-1 | 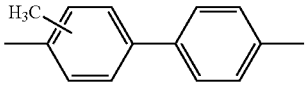 | 12.07 |
| (BP)-2-a | 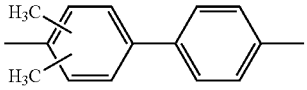 | 11.80 |
| (BP)-2-b | 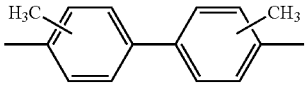 | 11.80 |
| (BP)-3 | 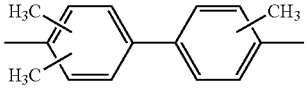 | 11.58 |
| (BP)-4 | 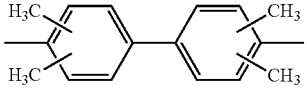 | 11.39 |
| (F)-0 | 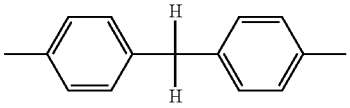 | 12.02 |
| (F)-1 | 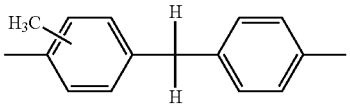 | 11.76 |
| (F)-2-a | 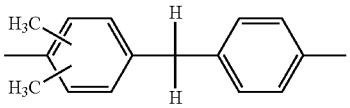 | 11.54 |
| (F)-2-b | 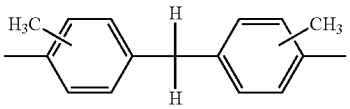 | 11.54 |
| (F)-3 | 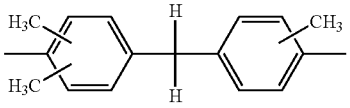 | 11.35 |
| (F)-4 | 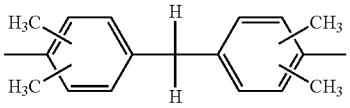 | 11.19 |
| (E)-0 | 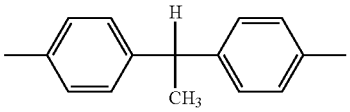 | 11.59 |
-continued
| Unit No. | Structure | Solubility parameter (SP value) |
|---|---|---|
| (E)-1 | 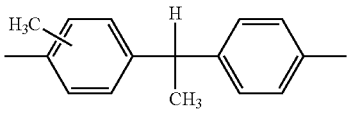 | 11.39 |
| (E)-2-a | 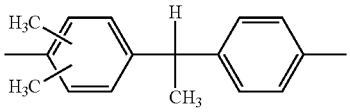 | 11.21 |
| (E)-2-b | 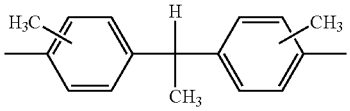 | 11.21 |
| (E)-3 | 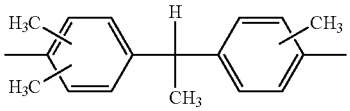 | 11.05 |
| (E)-4 | 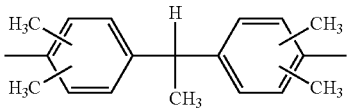 | 10.92 |
| (A)-0 | 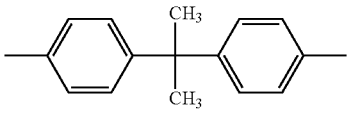 | 11.24 |
| (A)-1 | 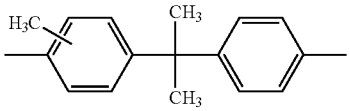 | 11.07 |
| (A)-2-b | 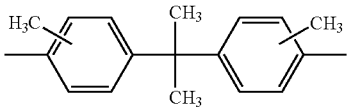 | 10.93 |
| (C)-0 | 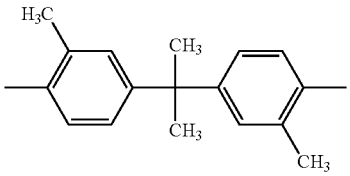 | 10.93 |
| (A)-2-a | 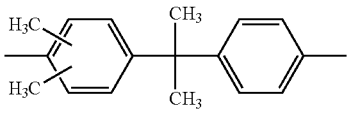 | 10.93 |
| (A)-3 | 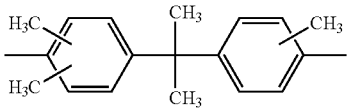 | 10.80 |

| Unit No. | Structure | Solubility parameter (SP value) |
|---|---|---|
| (A)-4 | 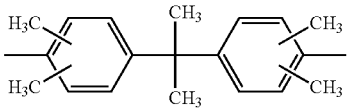 | 10.69 |
| (Oth)-1 | 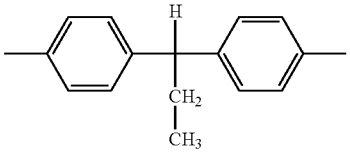 | 11.35 |
| (Oth)-2 | 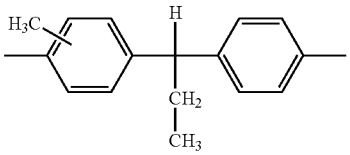 | 11.17 |
| (Oth)-3 | 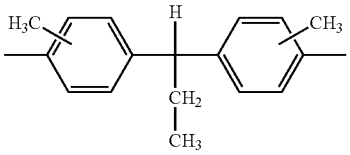 | 11.02 |
| (Oth)-4 | 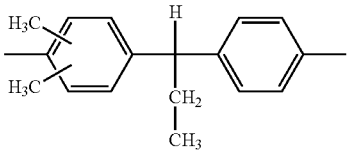 | 10.54 |
| (B)-0 | 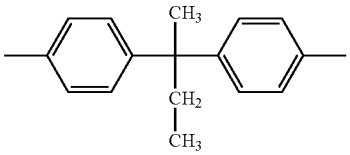 | 11.04 |
| (Oth)-5 | 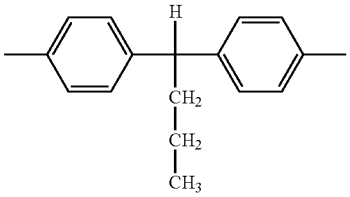 | 11.14 |
| (Oth)-6 | 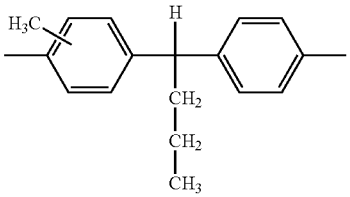 | 10.99 |
| Unit No. | Structure | Solubility parameter (SP value) |
|---|---|---|
| (Oth)-7 | 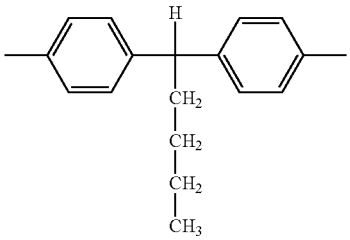 | 10.96 |
| (Oth)-8 | 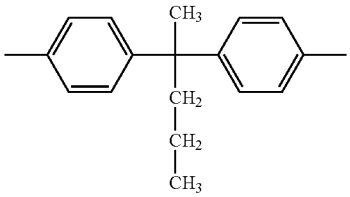 | 10.87 |
| (Oth)-9 | 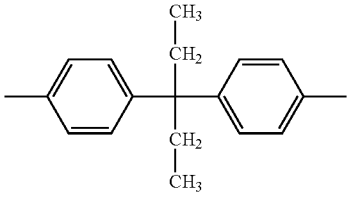 | 10.87 |
| (Oth)-10 | 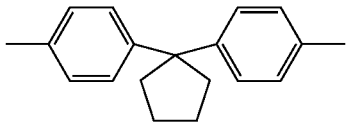 | 11.48 |
| (Oth)-11 | 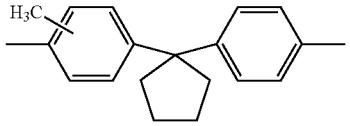 | 11.31 |
| (Oth)-12 | 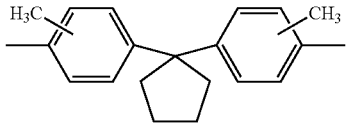 | 11.16 |
| (Oth)-13 | 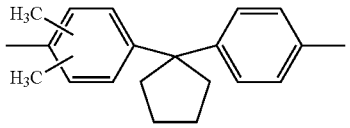 | 11.16 |
| (Oth)-14 | 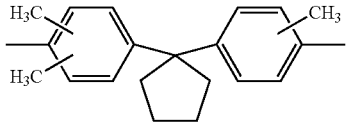 | 11.03 |
| (Oth)-15 | 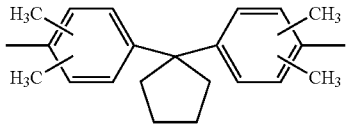 | 10.91 |

-continued

| Unit No. | Structure | Solubility parameter (SP value) |
|---|---|---|
| (Z)-0 | | 11.28 |
| (Z)-1 | $H_3C$ | 11.13 |
| (Z)-2-b | $H_3C$ $CH_3$ | 11.00 |
| (Z)-2-a | $H_3C$ $H_3C$ | 11.00 |
| (Z)-3 | $H_3C$ $H_3C$ $CH_3$ | 10.88 |
| (Z)-4 | $H_3C$ $H_3C$ $CH_3$ $CH_3$ | 10.78 |
| (AP)-0 | $CH_3$ | 11.59 |
| (TP)-0 | | 11.83 |

The specific polycarbonate copolymers may be used singly or in combination of two or more kinds thereof.

The viscosity average molecular weight of the specific polycarbonate copolymer is preferably 30,000 or more, and more preferably 45,000 or more. The upper limit of the viscosity average molecular weight of the specific polycarbonate copolymer is preferably 100,000 or less.

Here, the viscosity average molecular weight is a value measured by a capillary viscometer.

The specific polycarbonate copolymer is synthesized by a well-known method, for example, by using a method in which a divalent phenol is reacted with a carbonate precursor material such as phosgene and carbonate diesters. Hereinafter, the basic method for this synthesis method will be briefly described.

For example, in the reaction using, for example, phosgene as a carbonate precursor material, the reaction is usually carried out in the presence of an acid binder and a solvent. As the acid binder, for example, pyridine, alkali metal hydroxides such as sodium hydroxide and potassium hydroxide, and the like are used. As the solvent, for example, halogenated hydrocarbons such as methylene chloride and chlorobenzene are used. Further, in order to promote the reaction, for example, a catalyst such as a tertiary amine and a quaternary ammonium salt may be used. The reaction temperature is usually from 0° C. to 40° C., the reaction time is from several minutes to 5 hours, and the pH during the reaction may be usually 10 or more.

In the polymerization reaction, monofunctional phenols that are usually used as a chain-end terminator may be used. Examples of these monofunctional phenols include phenol, p-tert-butylphenol, p-cumylphenol, and isoctylphenol.

Here, for the polycarbonate representative of the specific polycarbonate copolymer, binder resins may be used in combination. However, the content of the binder resin other than the polycarbonate is, for example, 10% by weight or less, based on the entire binder resins.

Examples of the binder resin other than the specific polycarbonate copolymer include insulating resins such as an acrylic resin, a methacrylic resin, a polyarylate resin, a polyester resin, a polyvinyl chloride resin, a polystyrene resin, an acrylonitrile-styrene copolymer resin, an acrylonitrile-butadiene copolymer resin, a polyvinylacetate resin, a polyvinylformal resin, a polysulfone resin, a styrene-butadiene copolymer resin, a vinylidene chloride-acrylonitrile copolymer resin, a vinyl chloride-vinyl acetate-maleic anhydride resin, a silicone resin, a phenol-formaldehyde resin, a polyacrylamide resin, a polyamide resin, and chlorine rubber; and organic photoconductive polymers such as polyvinylcarbazole, polyvinylanthracene, and polyvinylpyrene. These binder resins may be used singly or in a mixture of two or more kinds thereof.

Further, the blending ratio of the charge transporting material to the binder resin is preferably, for example, from 10:1 to 1:5 in terms of the weight ratio.

The charge transporting layer may further contain known additives.

Formation of the charge transporting layer is not particularly limited, and a known forming method is used. For examples, the process is carried out by forming a coating film of a coating liquid for forming an charge transporting layer, formed by adding the components above to a solvent, and drying and, if necessary, heating the coating film.

As a method for coating the charge generating layer with the coating liquid for forming an charge transporting layer, an ordinary method such as a dip-coating method, an extrusion coating method, a wire-bar coating method, a spray coating method, a blade coating method, a knife coating method, and a curtain coating method is used.

In addition, in the case of dispersing the particles into the coating liquid for forming an charge transporting layer, in the dispersing method, a media dispersing machine such as a ball mill, a vibrating ball mill, an attritor, a sand mill, and a horizontal sand mill, or a medialess dispersing machine such as a stirrer, an ultrasonic dispersing machine, a roll mill, and a high-pressure homogenizer is used. Examples of the high-pressure homogenizer system include a collision system in which the particles are dispersed by causing the dispersion liquid to collide against liquid or against walls under a high pressure, and a penetration system in which the particles are dispersed by causing the dispersion liquid to penetrate through a fine flow path under a high pressure.

The film thickness of the charge transporting layer is set within a range of preferably 5 μm to 50 μm, and more preferably from 10 μm to 30 μm.

Protective Layer

The protective layer is an outermost surface layer in the electrophotographic photoreceptor, which is constituted with a cured film formed of a composition including a chain polymerizable compound. That is, the protective layer is preferably configured to include a polymer or crosslinked product of a chain polymerizable compound.

Furthermore, the curing method for the cured film involves performing radical polymerization with heat, light, radioactive rays, or the like. If the reaction is controlled not to proceed too quickly, the mechanic strength and the electrical characteristics of the protective layer (outermost surface layer) are improved, and further, staining of the film and generation of folds are suppressed, and accordingly, it is preferable to perform the polymerization under the condition where the generation of radicals occurs relatively slowly. From this viewpoint, thermal polymerization that allows the polymerization speed to be easily adjusted is suitable. That is, the composition for forming a cured film constituting the protective layer (outermost surface layer) may include a thermal radical generator or a derivative thereof.

Here, the details of the respective elements of the protective layer (outermost surface layer) constituted with the cured film will be described.

Chain Polymerizable Compound

The chain polymerizable compound is selected from known materials that are chain polymerizable compounds having at least a charge transporting skeleton and a chain polymerizable functional group in the same molecule. Here, the chain polymerizable group is preferably a functional group capable of obtaining radical polymerization, and it is, for example, a functional group having at least a carbon double bond. Specific examples of the chain polymerizable group include a functional group containing at least one selected from a vinyl group, a propenyl group, a vinyl ether group, a vinyl thioether group, an allyl ether group, an acryloyl group, a methacryloyl group, a styryl group, and a derivative thereof.

The chain polymerizable compound is preferably at least one chain polymerizable compound selected from chain polymerizable compounds represented by the formulae (I) and (II) (hereinafter sometimes referred to as a "specific chain polymerizable group-containing charge transporting material"), specifically from the viewpoints of electrical characteristics and mechanical strength.

The reason therefor is not clear, but is contemplated to be as follows.

It is thought that when a cured film of a composition including at least one selected from a specific chain polymerizable group-containing charge transporting material (polymer or crosslinked product of a specific chain polymerizable group-containing charge transporting material) is included in an outermost surface layer, the outermost surface layer has a combination of excellent electrical characteristics and mechanical strength, and the thickening of the outermost surface layer (for example, 10 μm or more) is achieved.

The reason therefor is thought to be that the chain polymerizable group-containing charge transporting material itself is excellent in the charge transporting performance and has a small number of polar groups disturbing the carrier transport, such as —OH and —NH—, and further, the material is linked with a styryl group having a π electron effective for the carrier transport by polymerization. Therefore, the residual strain is suppressed, and accordingly, formation of a structural trap capturing charges is suppressed.

Furthermore, it is thought that since the chain polymerizable group-containing charge transporting material tends to be more hydrophobic, and moisture is hardly exhausted, as compared with an acrylic material, the electrical characteristics are maintained for a long period of time.

(I)

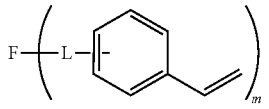

In the formula (I), F represents a charge transporting skeleton.

L represents a divalent linking group including two or more selected from the group consisting of an alkylene group, an alkenylene group, —C(═O)—, —N(R)—, —S—, and —O—. R represents a hydrogen atom, an alkyl group, an aryl group, or an aralkyl group.

m represents an integer of 1 to 8.

(II)

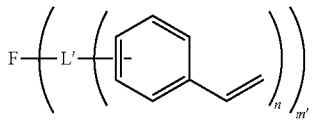

In the formula (II), F represents a charge transporting skeleton.

L' represents an (n+1)-valent linking group including two or more selected from the group consisting of a trivalent or tetravalent group derived from an alkane or an alkene, an alkylene group, an alkenylene group, —C(═O)—, —N(R)—, —S—, and —O—. R represents a hydrogen atom, an alkyl group, an aryl group, or an aralkyl group. Further, the trivalent or tetravalent group derived from an alkane or an alkene means a group formed by the removal of 3 or 4 hydrogen atoms from an alkane or an alkene. The same shall apply hereinafter.

m' represents an integer of 1 to 6. n represents an integer of 2 to 3.

In the formulae (I) and (II), F represents a charge transporting skeleton, that is, a structure having a charge transporting property, specifically, structures having a charge transporting property, such as a phthalocyanine compound, a phorphyrin compound, an azobenzene compound, a triarylamine compound, a benzidine compound, an arylalkane compound, an aryl-substituted ethylene compound, a stilbene compound, an anthracene compound, a hydrazone compound, a quinone compound, and a fluorenone compound.

In the formula (I), examples of the linking group represented by L include:

a divalent linking group having —C(=O)—O— inserted in an alkylene group, a divalent linking group having —C(=O)—N(R)— inserted in an alkylene group, a divalent linking group having —C(=O)—S— inserted in an alkylene group, a divalent linking group having —O— inserted in an alkylene group, a divalent linking group having —N(R)— inserted in an alkylene group, and a divalent linking group having —S— inserted in an alkylene group.

Furthermore, the linking group represented by L may have two groups of —C(=O)—O—, —C(=O)—N(R)—, —C(=O)—S—, —O—, or —S— inserted in an alkylene group.

In the formula (I), specific examples of the linking group represented by L include:

*—$(CH_2)_p$—C(=O)—O—$(CH_2)_q$—,

*—$(CH_2)_p$—O—C(=O)—$(CH_2)_r$—C(=O)—O—$(CH_2)_q$—,

*—$(CH_2)_p$—C(=O)—N(R)—$(CH_2)_q$—,

*—$(CH_2)_p$—C(=O)—S—$(CH_2)_q$—,

*—$(CH_2)_p$—O—$(CH_2)_q$—,

*—$(CH_2)_p$—N(R)—$(CH_2)_q$—,

*—$(CH_2)_p$—S—$(CH_2)_q$—, and

*—$(CH_2)_p$—O—$(CH_2)_r$—O—$(CH_2)_q$—.

Here, in the linking group represented by L, p represents 0, or an integer of 1 to 6 (preferably 1 to 5). q represents an integer of 1 to 6 (preferably 1 to 5). represents an integer of 1 to 6 (preferably 1 to 5).

Further, in the linking group represented by L, "*" represents a site linked to F.

On the other hand, in the formula (II), examples of the linking group represented by L' include:

an (n 1)-valent linking group having —C(=O)—O— inserted in an alkylene group linked in the branched shape, an (n+1)-valent linking group having —C(=O)—N(R)— inserted in an alkylene group linked in the branched shape, an (n+1)-valent linking group having —C(=O)—S— inserted in an alkylene group linked in the branched shape, an (n+1)-valent linking group having —O— inserted in an alkylene group linked in the branched shape, an (n+1)-valent linking group having —N(R)— inserted in an alkylene group linked in the branched shape, and an (n+1)-valent linking group having —S— inserted in an alkylene group linked in the branched shape.

Furthermore, the linkage represented by L' may have two groups of —C(=O)—O—, —C(=O)—N(R)—, —C(=O)—S—, —O—, or —S— inserted in an alkylene group linked in the branched shape.

In the formula (II), specific examples of the linking group represented by L' include:

*—$(CH_2)_p$—CH[C(=O)—O—$(CH_2)_q$—]$_2$,

*—$(CH_2)_p$—CH=C[C(=O)—O—$(CH_2)_q$—]$_2$,

*—$(CH_2)_p$—CH[C(=O)—N(R)—$(CH_2)_q$—]$_2$,

*—$(CH_2)_p$—CH[C(=O)—S—$(CH_2)_q$—]$_2$,

*—$(CH_2)_p$—CH[$(CH_2)_r$—O—$(CH_2)_q$—]$_2$,

*—$(CH_2)_p$—CH=C [$(CH_2)_r$—O—$(CH_2)_q$—]$_2$,

*—$(CH_2)_p$—CH[$(CH_2)_r$—N(R)—$(CH_2)_q$—]$_2$,

*—$(CH_2)_p$—CH[$(CH_2)_r$—S—$(CH_2)_q$—]$_2$,

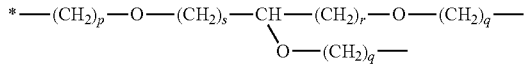

*—$(CH_2)_p$—O—C [$(CH_2)_r$—O—$(CH_2)_q$—]$_3$, and

*—$(CH_2)_p$—C(=O)—O—C[$(CH_2)_r$—O—$(CH_2)_q$—]$_3$.

Here, in the linking group represented by L', p represents 0, or an integer of 1 to 6 (preferably 1 to 5). q represents an integer of 1 to 6 (preferably 1 to 5). R represents an integer of 1 to 6 (preferably 1 to 5). s represents an integer of 1 to 6 (preferably 1 to 5).

Further, in the linking group represented by L', "*" represents a site linked to F.

Among these, in the formula (II), the linking group represented by L' is preferably:

*—$(CH_2)_p$—CH[C(=O)—O—$(CH_2)_q$—]$_2$,

*—$(CH_2)_p$—CH=C[C(=O)—O—$(CH_2)_q$—]$_2$,

*—$(CH_2)_p$—CH[$(CH_2)_r$—O—$(CH_2)_q$—]$_2$, and

*—$(CH_2)_p$—CH=C[$(CH_2)_r$—O—$(CH_2)_q$—]$_2$.

Specifically, the group (corresponding to a group represented by the formula (IIA-a)) linked to the charge transporting skeleton represented by F of the compound represented by the formula (II) may be a group represented by the following formula (IIA-a1), (IIA-a2), (IIA-a3), or (IIA-a4)

(IIA-a1)

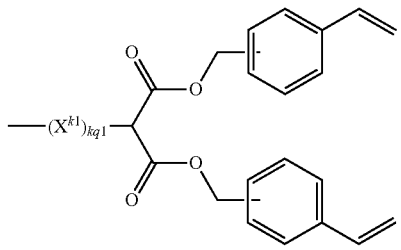

(IIA-a2)

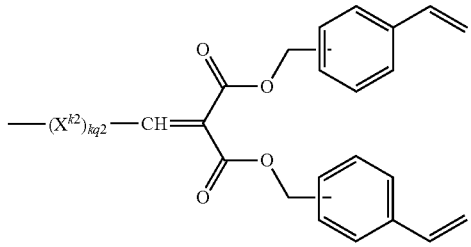

In the formula (IIA-a1) or (IIA-a2), $X^{k1}$ represents a divalent linking group. kq1 represents an integer of 0 or 1. $X^{k2}$ represents a divalent linking group. kq2 represents an integer of 0 or 1.

Here, examples of the divalent linking group represented by $X^{k1}$ and $X^{k2}$ include —$(CH_2)_p$— (provided that p represents an integer of 1 to 6, preferably 1 to 5). Examples of the divalent linking group include an alkyleneoxy group.

(IIA-a3)

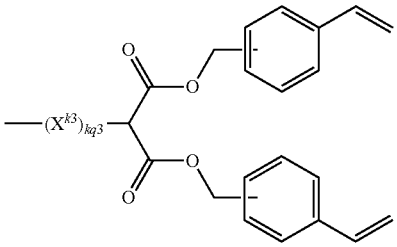

(IIA-a4)

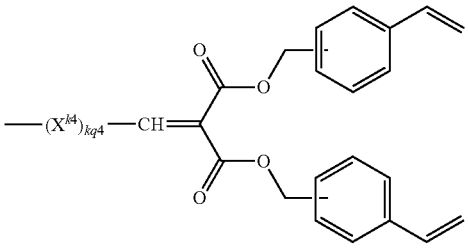

In the formula (IIA-a3) or (IIA-a4), $X^{k3}$ represents a divalent linking group. kq3 represents an integer of 0 or 1. $X^{k4}$ represents a divalent linking group. kq4 represents an integer of 0 or 1. Here, examples of the divalent linking group represented by $X^{k3}$ and $X^{k4}$ include —$(CH_2)_p$— (provided that p represents an integer of 1 to 6, preferably 1 to 5). Examples of the divalent linking group include an alkyleneoxy group.

In the formulae (I) and (II), in the linking groups represented by L and L', examples of the alkyl group represented by R of "—N(R)—" include linear or branched alkyl groups having 1 to 5 carbon atoms (preferably 1 to 4 carbon atoms), and specifically, a methyl group, an ethyl group, a propyl group, and a butyl group.

Examples of the aryl group represented by R of "—N(R)—" include aryl groups having 6 to 15 carbon atoms (preferably 6 to 12 carbon atoms), and specifically, a phenyl group, a tolyl group, a xylidyl group, and a naphthyl group.

Examples of the aralkyl group include aralkyl groups having 7 to 15 carbon atoms (preferably 7 to 14 carbon atoms), and specifically, a benzyl group, a phenethyl group, and a biphenylmethylene group.

In the formulae (I) and (II), m preferably represents an integer of 1 to 6.

m' preferably represents an integer of 1 to 6.

n preferably represents an integer of 2 to 3.

Next, suitable compounds of the chain polymerizable compounds represented by the formulae (I) and (II) will be described.

The chain polymerizable compounds represented by the formulae (I) and (II) are preferably chain polymerizable compounds having a charge transporting skeleton (structure having a charge transporting property) derived from a triarylamine compound as F.

Specifically, as the chain polymerizable compound represented by the formula (I), at least one compound selected from the chain polymerizable compounds represented by the formula (I-a), (I-b), (I-c), and (I-d) is suitable.

On the other hand, as the chain polymerizable compound represented by the formula (II), the chain polymerizable compound represented by the formula (II-a) is suitable.

Chain Polymerizable Compound Represented by Formula (I-a)

The chain polymerizable compound represented by the formula (I-a) will be described.

If the chain polymerizable compound represented by the formula (I-a) is applied as the chain polymerizable group-containing charge transporting material, the deterioration of the electrical characteristics due to the environmental change is easily suppressed. The reason therefor is not clear, but is thought to be as follows.

First, it may be thought that for the chain polymerizable compound having a (meth)acryl group used in the related art, the (meth)acryl group is highly hydrophilic with respect to the skeleton site exhibiting the charge transporting performance during the polymerization. As a result, it is thought that a certain kind of layer separation state is formed, and thus, the hopping conduction is disturbed. Therefore, it is thought that the charge transporting film including a polymer or crosslinked product of a (meth)acryl group-containing chain polymerizable compound exhibits deterioration of the efficiency in the charge transport, and further, the partial moisture adsorption or the like causes a decrease in the environmental stability.

Meanwhile, the chain polymerizable compound represented by the formula (I-a) has a vinyl chain polymerizable group having low hydrophilicity, and further, has several skeletons exhibiting the charge transporting performance in one molecule, and the skeletons are linked to each other with a flexible linking group having no aromatic ring and conjugated bond such as a covalent double bond. It is thought that such a structure promotes efficient charge transporting performance and high strength, and suppresses the formation of the layer separation state during the polymerization. As a result, it is thought that the protective layer (outermost surface layer) including the polymer or crosslinked product of the chain polymerizable compound represented by the formula (I-a) is excellent in both of the charge transporting performance and the mechanical strength, and further, the environment dependency (temperature and humidity dependency) of the charge transporting performance may be decreased.

As described above, it is thought that if the chain polymerizable compound represented by the formula (I-a) is applied, the deterioration of the electrical characteristics due to the environmental change is easily suppressed.

(I-a)

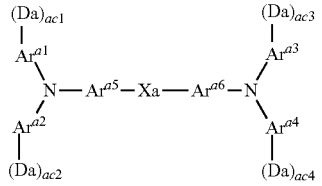

In the formula (I-a), $Ar^{a1}$ to $Ar^{a4}$ each independently represent a substituted or unsubstituted aryl group. $Ar^{a5}$ and $Ar^{a6}$ each independently represent a substituted or unsubstituted arylene group. Xa represents a divalent linking group formed by a combination of the groups selected from an alkylene group, —O—, —S—, and an ester group. Da represents a group represented by the following formula (TA-a). ac1 to ac4 each independently represent an integer of 0 to 2. Provided that, the total number of Da is 1 or 2.

(IA-a)

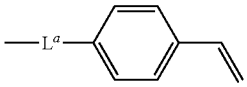

In the formula (IA-a), La is represented by *—$(CH_2)_{an}$—O—$CH_2$— and represents a divalent linking group linked to a group represented by $Ar^{a1}$ to $Ar^{a4}$ at *. an represents an integer of 1 or 2.

Hereinafter, the details of the formula (I-a) will be described.

In the formula (I-a), the substituted or unsubstituted aryl groups represented by $Ar^{a1}$ to $Ar^{a4}$ are the same as or different from each other.

Here, examples of the substituents in the substituted aryl group, those other than "Da", include an alkyl group having 1 to 4 carbon atoms, an alkoxy group having 1 to 4 carbon atoms, a phenyl group substituted with an alkoxy group having 1 to 4 carbon atoms, an unsubstituted phenyl group, an aralkyl group having 7 to 10 carbon atoms, and a halogen atom.

In the formula (I-a), $Ar^{a1}$ to $Ar^{a4}$ are preferably those represented by any one of the following formulae (1) to (7).

Furthermore, the following formulae (1) to (7) are described together with "-$(D)_c$", which totally refers to "-$(Da)_{ac1}$" to "-$(Da)_{ac1}$" that may be linked to each of $Ar^{a1}$ to $Ar^{a4}$.

(1)

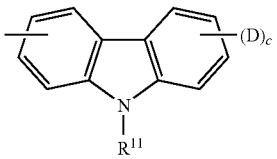

(2)

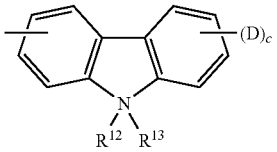

(3)

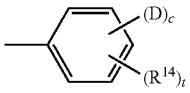

(4)

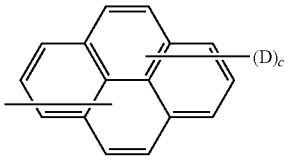

(5)

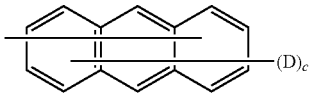

(6)

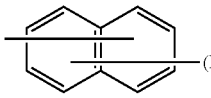

(7)

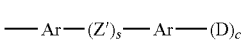

In the formulae (1) to (7), $R^{11}$ represents one selected from a hydrogen atom, an alkyl group having 1 to 4 carbon atoms, a phenyl group substituted with an alkyl group having 1 to 4 carbon atoms or an alkoxy group having 1 to 4 carbon atoms, an unsubstituted phenyl group, and an aralkyl group having 7 to 10 carbon atoms. $R^{12}$ and $R^{13}$ each independently represent one selected from the group consisting of a hydrogen atom, an alkyl group having 1 to 4 carbon atoms, a phenyl group substituted with an alkoxy group having 1 to 4 carbon atoms or an alkoxy group having 1 to 4 carbon atoms, an unsubstituted phenyl group, an aralkyl group having 7 to 10 carbon atoms, and a halogen atom. $R^{14}$'s each independently represent one selected from the group consisting of an alkyl group having 1 to 4 carbon atoms, an alkoxy group having 1 to 4 carbon atoms, a phenyl group substituted with an alkoxy group having 1 to 4 carbon atoms, an unsubstituted phenyl group, an aralkyl group having 7 to 10 carbon atoms, and a halogen atom. Ar represents a substituted or unsubstituted arylene group. s represents 0 or 1. t represents an integer of 0 to 3. Z' represents a divalent organic linking group.

Here, in the formula (7), Ar is preferably one represented by the following formula (8) or (9).

(8)

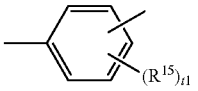

(9)

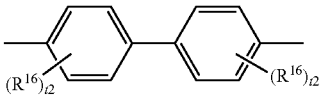

In the formulae (8) and (9), $R^{15}$ and $R^{16}$ each independently represent one selected from the group consisting of an alkyl group having 1 to 4 carbon atoms, an alkoxy group having 1 to 4 carbon atoms, a phenyl group substituted with an alkoxy group having 1 to 4 carbon atoms, an unsubstituted phenyl group, an aralkyl group having 7 to 10 carbon atoms, and a halogen atom, and t1 and t2 each represent an integer of 0 to 3.

Furthermore, in the formula (7), Z' is preferably one represented by any one of the following formulae (10) to (17)

(10)

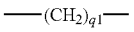

(11)

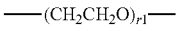

(12)

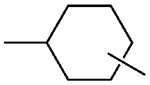

(13)

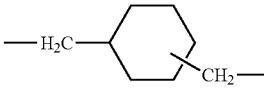

(14)

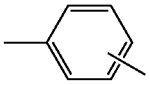

(15)

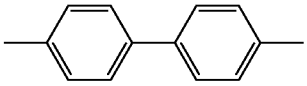

-continued (16)

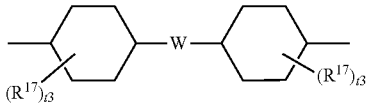

(17)

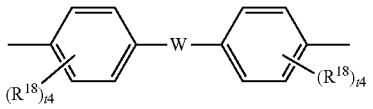

In the formulae (10) to (17), $R^{17}$ and $R^{18}$ each independently represent one selected from the group consisting of an alkyl group having 1 to 4 carbon atoms, an alkoxy group having 1 to 4 carbon atoms, a phenyl group substituted with an alkoxy group having 1 to 4 carbon atoms, an unsubstituted phenyl group, an aralkyl group having 7 to 10 carbon atoms, and a halogen atom. W represents a divalent group. q1 and r1 each independently represent an integer of 1 to 10. t3 and t4 each represent an integer of 0 to 3.

In the formulae (16) to (17), W is preferably any one of the divalent groups represented by the following formulae (18) to (26). Provided that, in the formula (25), u represents an integer of 0 to 3.

(18) $-CH_2-$

(19) $-C(CH_3)_2-$

(20) $-O-$

(21) $-S-$

(22) $-C(CF_3)_2-$

(23) $-Si(CH_3)_2-$ (24)

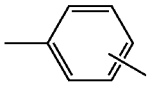

(25)

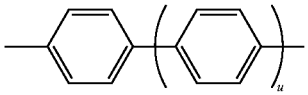

(26)

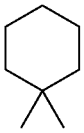

In the formula (I-a), in the substituted or unsubstituted arylene group represented by $Ar^{a5}$ and $Ar^{a6}$ examples of the arylene group include arylene groups formed by the removal of one hydrogen atom at a desired position from the aryl group exemplified in the description of $Ar^{a1}$ to $Ar^{a4}$ Further, examples of the substituent in the substituted arylene group are the same as those exemplified as the substituent other than "Da" in the substituted aryl group in the description of $Ar^{a1}$ to $Ar^{a4}$.

In the formula (I-a), the divalent linking group represented by Xa is an alkylene group, or a divalent group formed by the combination of the groups selected from alkylene group, —O—, —S—, and an ester group, and is a linking group including aromatic ring and conjugated bond such as a conjugated double bond.

Specifically, examples of the divalent linking group represented by Xa include an alkylene group having 1 to 10 carbon atoms, as well as a divalent group formed by a combination of an alkylene group having 1 to 10 carbon atoms with a group selected from —O—, —S—, —O—C(═O)—, and —C(═O)—O—.

In addition, when the divalent linking group represented by Xa is an alkylene group, the alkylene group may have a substituent such as alkyl, alkoxy, and halogen, and two of these substituents may be bonded to have the structure such as the divalent linking group represented by the formula (26) described as the specific examples of W in the formulae (16) to (17).

Chain Polymerizable Compound Represented by Formula (I-b)

The chain polymerizable compound represented by the formula (I-b) will be described.

If the chain polymerizable compound represented by the formula (I-b) is applied as the chain polymerizable group-containing charge transporting material, the abrasion of the protective layer (outermost surface layer) is suppressed, and further, the generation of the uneven concentrations of the image is easily suppressed. The reason therefor is not clear, but is thought to be as follows.

First, the bulky charge transporting skeleton and the polymerization site (styryl group) are structurally close to each other, and rigid, it is difficult for polymerization sites to move, residual strain due to a curing reaction easily remains, and the charge transporting skeleton is deformed, and therefore, there occurs a change in the level of HOMO (highest occupied molecular orbital) in charge of carrier transport and as a result, a state where the energy distribution spreads (disorder in energy: large σ) is easily caused.

Meanwhile, through a methylene group or an ether group, it is easy to provide the molecular structure with flexibility and a small σ is easily obtained. Further, the methylene group or the ether group has a small dipole moment, as compared with an ester group, an amide group, or the like, and this effect contributes to a decrease in σ, thereby improving the electrical characteristics. Further, by providing the molecular structure with flexibility, the degree of freedom of the movement of the reactive site is increased and the reaction rate is improved, which is thought to yield a film having a high strength.

From these, a structure where a linking chain having sufficient flexibility is inserted between the charge transporting skeleton and the polymerization site is preferable.

Consequently, it is thought that the chain polymerizable compound represented by the formula (I-b) has an increased molecular weight of the molecule itself by the curing reaction, it becomes difficult for the weight center to move, and the degree of freedom of the styryl group is high. As a result, it is thought that the protective layer (outermost surface layer) including a polymer or crosslinked product of the chain polymerizable compound represented by the formula (I-b) has excellent electrical characteristics and high strength.

From the above, if the chain polymerizable compound represented by the formula (I-b) is applied, the abrasion of the protective layer (outermost surface layer) is suppressed, and further, the generation of the uneven concentrations of the image is easily suppressed.

(I-b)

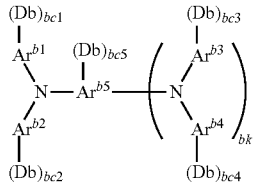

In the formula (I-b), $Ar^{b1}$ to $Ar^{b4}$ each independently represent a substituted or unsubstituted aryl group. $Ar^{b5}$ represents a substituted or unsubstituted aryl group, or a substituted or unsubstituted arylene group. Db represents a group represented by the following formula (IA-b). bc1 to bc5 each independently represent an integer of 0 to 2. bk represents 0 or 1. Provided that, the total number of Db is 1 or 2.

(IA-b)

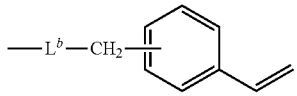

In the formula (IA-b), $L^b$ includes a group represented by *—$(CH_2)_{bn}$—O— and represents a divalent linking group linked to a group represented by $Ar^{b1}$ to $Ar^{b5}$ at *. bn represents an integer of 3 to 6.

Hereinafter, the details of the formula (I-b) will be described.

In the formula (I-b), the substituted or unsubstituted aryl groups represented by $Ar^{b1}$ to $Ar^{b4}$ are the same as the substituted or unsubstituted aryl groups represented by $Ar^{a1}$ to $Ar^{a4}$ in the formula (I-a).

When bk is 0, $Ar^{b5}$ represents a substituted or unsubstituted aryl group, and the substituted or unsubstituted aryl group is the same as the substituted or unsubstituted aryl groups represented by $Ar^{a1}$ to $Ar^{a4}$ in the formula (I-a).

When bk is 1, $Ar^{b5}$ represents a substituted or unsubstituted arylene group, and the substituted or unsubstituted arylene group is the same as the substituted or unsubstituted arylene groups represented by $Ar^{a5}$ and $Ar^{a6}$ in the formula (I-a).

Next, the details of the formula (IA-b) will be described.

In the formula (IA-b), examples of the divalent linking group represented by $L^b$ include:

*—$(CH_2)_{bp}$—O—, and

*—$(CH_2)_{bp}$—O— $(CH_2)_{bq}$—O—.

Here, in the linking group represented by $L^b$, bp represents an integer of 3 to 6 (preferably 3 to 5). bq represents an integer of 1 to 6 (preferably 1 to 5).

Further, in the linking group represented by $L^b$, "*" represents a site linked to a group represented by $Ar^{b1}$ to $Ar^{b5}$.

Chain Polymerizable Compound Represented by Formula (I-c)

The chain polymerizable compound represented by the formula (I-c) will be described.

If the chain polymerizable compound represented by the formula (I-c) is applied as the chain polymerizable group-containing charge transporting material, it is difficult to generate scratches on the surface even when used repeatedly, and further, deterioration of the image quality is easily suppressed. The reason therefor is not clear, but is thought to be as follows.

First, it is thought that film shrinkage accompanying a polymerization reaction or a crosslinking reaction, or aggregation of the charge transporting structure, and the structure in the vicinity of a chain polymerizable group occurs when an outermost surface layer including a polymer or crosslinked product of the chain polymerizable group-containing charge transporting material is formed. Therefore, it is thought that when a mechanic load is applied to an electrophotographic photoreceptor surface due to repeated use, the film itself is abraded or the chemical structure in the molecule is cut, and the film shrinkage or the aggregation state changes, the electrical characteristics as the electrophotographic photoreceptor changes, and thus, deterioration of the image quality occurs.

On the other hand, it is thought that since the chain polymerizable compound represented by the formula (I-c) has a styrene skeleton as the chain polymerizable group, the compatibility with an aryl group which is a main skeleton of the charge transporting material is favorable, and the film shrinkage or the aggregation of the charge transporting structure, and the aggregation of the structure in the vicinity of the chain polymerizable group due to the polymerization reaction or the crosslinking reaction is suppressed. As a result, it is thought that the electrophotographic photoreceptor including the protective layer (outermost surface layer) including a polymer or crosslinked product of the chain polymerizable compound represented by the formula (I-c) suppresses deterioration of the image quality due to the repeated use.

In addition, it is thought that for the chain polymerizable compound represented by the formula (I-c), a charge transporting skeleton and a styrene skeleton are linked via a linking group including a specific group such as —C(=O)—, —N(R)—, and —S—, and thus, the interactions between the specific group and a nitrogen atom in the charge transporting skeleton, and between the specific groups, and the like occur, and as a result, it is also thought that the protective layer (outermost surface layer) including a polymer or crosslinked product of the chain polymerizable compound represented by the formula (I-c) has a further improved strength.

From the description above, it is thought that if the chain polymerizable compound represented by the formula (I-c) is applied, it is difficult to generate scratches on the surface even when used repeatedly, and further, the deterioration of the image quality is easily suppressed.

In addition, it is thought that a specific group such as —C(=O)—, —N(R)—, —S—, and the like causes deterioration of a charge transport property and deterioration of the image quality under the conditions of high humidity due to its polarity or hydrophilicity, but the chain polymerizable compound represented by the formula (I-c) has a styrene skeleton having higher hydrophobicity than (meth)acryl or the like as a chain polymerizable group, and thus, it is not likely to deteriorate the charge transporting property and deterioration of the image quality, such as development of the residual image (ghost) caused by the history of the previous cycle.

(I-c)

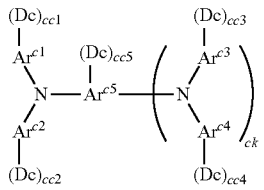

In the formula (I-c), $Ar^{c1}$ to $Ar^{c4}$ each independently represent a substituted or unsubstituted aryl group. $Ar^{c5}$ represents a substituted or unsubstituted aryl group, or a substituted or unsubstituted arylene group. Dc represents a group represented by the following formula (IA-c). cc1 to cc5 each independently represent an integer of 0 to 2. ck represents 0 or 1. Provided that, the total number of Dc is from 1 to 8.

(IA-c)

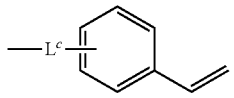

In the formula (IA-c), $L^c$ represents a divalent linking group including one or more groups selected from the group consisting of —C(=O)—, —N(R)—, —S—, or the groups formed by a combination of —C(=O)—, and —O—, —N(R)—, or —S—. R represents a hydrogen atom, an alkyl group, an aryl group, or an aralkyl group.

Hereinafter, the details of the formula (I-c) will be described.

In the formula (I-c), the substituted or unsubstituted aryl groups represented by $Ar^{c1}$ to $Ar^{c4}$ are the same as the substituted or unsubstituted aryl groups represented by $Ar^{a1}$. to $Ar^{a4}$ in the formula (I-a).

When ck is 0, $Ar^{c5}$ represents a substituted or unsubstituted aryl group, and the substituted or unsubstituted aryl group is the same as the substituted or unsubstituted aryl groups represented by $Ar^{a1}$ to $Ar^{a4}$ in the formula (I-a).

When ck is 1, $Ar^{c5}$ represents a substituted or unsubstituted arylene group, and the substituted or unsubstituted arylene group is the same as the substituted or unsubstituted arylene groups represented by $Ar^{a5}$ and $Ar^{a6}$ in the formula (I-a).

From the viewpoint of obtaining a protective layer (outermost surface layer) having a higher strength, the total number of Dc is preferably 2 or more, and more preferably 4 or more. Generally, if the number of the chain polymerizable groups in one molecule is too large, as the polymerization (crosslinking) reaction proceeds, it is difficult for the molecule to move, the chain polymerization reactivity is decreased, and the ratio of the chain polymerizable groups before the reaction is increased, and thus, the total number of Dc is preferably 7 or less, and more preferably 6 or less.

Next, the details of the formula (IA-c) will be described.

In the formula (IA-c), $L^c$ represents a divalent linking group including one or more groups (hereinafter also referred to as "specific linking groups") selected from the group consisting of —C(=O)—, —N(R)—, —S—, or the groups formed by a combination of —C(=O)—, and —O—, —N(R)—, or —S—.

Here, from the viewpoint of a balance of the strength and the polarity (hydrophilicity/hydrophobicity) of the protective layer (outermost surface layer), the specific linking group is, for example, —C(=O)—, —N(R)—, —S—, —C(=O)—O—, —C(=O)—N(R)—, —C(=O)—S—, —O—C(=O)—O—, —O—C(=O)—N(R)—, preferably —N(R)—, —S—, —C(=O)—O—, —C(=O)—N(H)—, or —C(=O)—O—, and more preferably —C(=O)—O—.

Furthermore, examples of the divalent linking group represented by $L^c$ include divalent linking groups formed by the combination of the specific linking group with a residue of saturated hydrocarbon (including linear, branched, or cyclic ones) or aromatic hydrocarbon, and an oxygen atom, and in particular, divalent linking groups formed by the combination of the specific linking group with a residue of a linear saturated hydrocarbon and an oxygen atom.

The total number of the carbon atoms included in the divalent linking group represented by $L^c$ is, for example, from 1 to 20, and preferably from 2 to 10, from the viewpoint of the density of a styrene skeleton in the molecule and the chain polymerization reactivity.

In the formula (IA-c), specific examples of the divalent linking group represented by $L^c$ include:

*—$(CH_2)_{cp}$—C(=O)—O—$(CH_2)_{cq}$—,

*—$(CH_2)_{cp}$—O—C(=O)—$(CH_2)_{cr}$—C(=O)—O—$(CH_2)_{cq}$—,

*—$(CH_2)_{cp}$—C(=O)—N(R)—$(CH_2)_{cq}$—,

*—$(CH_2)_{cp}$—C(=O)—S—$(CH_2)_{cq}$—,

*—$(CH_2)_{cp}$—N(R)—$(CH_2)_{cq}$—, and

*—$(CH_2)_{cp}$—S—$(CH_2)_{cq}$—.

Here, in the linking group represented by $L^c$, cp represents 0, or an integer of 1 to 6 (preferably 1 to 5). cq represents an integer of 1 to 6 (preferably 1 to 5) cr represents an integer of 1 to 6 (preferably 1 to 5).

Furthermore, in the linking group represented by $L^c$, "*" represents a site linked to a group represented by $Ar^{c1}$ to $Ar^{c5}$.

Among these, in the formula (IA-c), the divalent linking group represented by $L^c$ is preferably *—$(CH_2)_{cp}$—C(=O)—O—$CH_2$—. That is, the group represented by the formula (IA-c) is preferably a group represented by the following formula (IA-c1). Provided that, in the formula (IA-c1), cp1 represents an integer of 0 to 4.

(IA-c1)

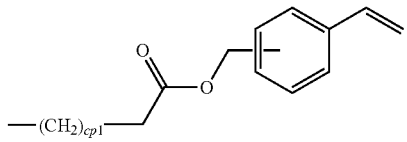

Chain Polymerizable Compound Represented by Formula (I-d)

The chain polymerizable compound represented by the formula (I-d) will be described.

If the chain polymerizable compound represented by the formula (I-d) is applied as the chain polymerizable group-containing charge transporting material, the abrasion of the protective layer (outermost surface layer) is suppressed, and further, the generation of the uneven concentrations of the image is easily suppressed. The reason therefor is not clear, but is thought to be the same as for the chain polymerizable compound represented by the formula (I-b).

Particularly, it is thought that since the chain polymerizable compound represented by the formula (I-d) has a total number of Dd of 3 to 8, larger than that of the formula (I-b), in the crosslinked product thus formed, a more highly crosslinked structure (crosslinked network) is easily formed, and the abrasion of the protective layer (outermost surface layer) is more easily suppressed.

(I-d)

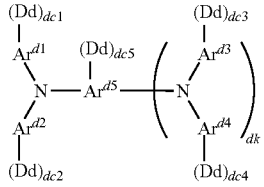

In the formula (I-d), $Ar^{d1}$ to $Ar^{d4}$ each independently represent a substituted or unsubstituted aryl group. $Ar^{d5}$ represents a substituted or unsubstituted aryl group, or a substituted or unsubstituted arylene group. Dd represents a group represented by the following formula (IA-d). dc1 to dc5 each independently represent an integer of 0 to 2. dk represents 0 or 1. Provided that, the total number of Dd is from 3 to 8.

(IA-d)

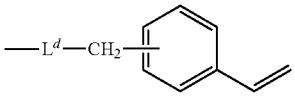

In the formula (IA-d), $L^d$ includes a group represented by $*—(CH_2)_{dn}—O—$, and represents a divalent linking group linked to a group represented by $Ar^{d1}$ to $Ar^{d5}$ at *. dn represents an integer of 1 to 6.

Hereinafter, the details of the formula (I-d) will be described.

In the formula (I-d), the substituted or unsubstituted aryl groups represented by $Ar^{d1}$ to $Ar^{d4}$ are the same as the substituted or unsubstituted aryl groups represented by $Ar^{a1}$ to $Ar^{a4}$ in the formula (I-a).

When dk is 0, $Ar^{d5}$ represents a substituted or unsubstituted aryl group, and the substituted or unsubstituted aryl group is the same as the substituted or unsubstituted aryl groups represented by $Ar^{a1}$ to $Ar^{a4}$ in the formula (I-a).

When dk is 1, $Ar^{d5}$ represents a substituted or unsubstituted arylene group, and the substituted or unsubstituted arylene group is the same as the substituted or unsubstituted arylene groups represented by $Ar^{a5}$ and $Ar^{a6}$ in the formula (I-a).

The total number of Dd is preferably 4 or more, from the viewpoint of obtaining a protective layer (outermost surface layer) having a higher strength.

Next, the details of the formula (IA-d) will be described.

In the formula (IA-d), examples of the divalent linking group represented by $L^d$ include:

$*—(CH_2)_{dp}—O—$, and $*—(CH_2)_{dp}—O—(CH_2)_{dq}—O—$.

Here, in the linking group represented by $L^d$, dp represents an integer of 1 to 6 (preferably 1 to 5). dq represents an integer of 1 to 6 (preferably 1 to 5).

Furthermore, in the linking group represented by $L^d$, "*" represents a site linked to a group represented by $Ar^{d1}$ to $Ar^{d5}$.

Chain Polymerizable Compound Represented by Formula (II-a)

The chain polymerizable compound represented by the formula (II-a) will be described.

When the chain polymerizable compound represented by the formula (II) (in particular, the formula (II-a)) is applied as the chain polymerizable group-containing charge transporting material, the deterioration of the electrical characteristics is easily suppressed even when used repeatedly for a long period of time. The reason therefor is not clear, but is thought to be as follows.

First, the chain polymerizable compound represented by the formula (II) (in particular, the formula (II-a)) is a compound having 2 or 3 chain polymerizable reactive groups (styrene groups) via one linking group from the charge transporting skeleton.

Consequently, it is thought that the chain polymerizable compound represented by the formula (II) (in particular, the formula (II-a)) hardly causes strain in the charge transporting skeleton when polymerized or crosslinked by the presence of the linking group while maintaining high curing degrees and number of crosslinked moieties, and excellent charge transporting performance is also easily satisfied with a high curing degree.

Furthermore, the charge transporting compound having a (meth)acryl group, which has been used in the related art, easily causes strain as described above, the reactive site has high hydrophilicity, and the charge transporting site has high hydrophobicity, and as a result, a microscopic phase separation (microphase separation) easily occurs. However, it is thought that the chain polymerizable compound represented by the formula (II) (in particular, the formula (II-a)) has a styrene group as a chain polymerizable group, and further, it has a structure having a linking group that hardly causes strain in the charge transporting skeleton when cured (crosslinked), the reactive site and the charge transporting site are both hydrophobic, and the phase separation hardly occurs, and as a result, efficient charge transporting performance and high strength are promoted. As a result, it is thought that the protective layer (outermost surface layer) including the polymer or crosslinked product of the chain polymerizable compound represented by the formula (II) (in particular, the formula (II-a)) has excellent mechanical strength as well as superior charge transporting performance (electrical characteristics).

As a result, if the chain polymerizable compound represented by the formula (II) (in particular, the formula (II-a)) is applied, it is thought that the deterioration of the electrical characteristics even when used repeatedly for a long period of time is easily suppressed.

(II-a)

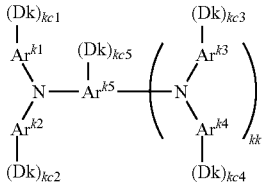

In the formula (II-a), $Ar^{k1}$ to $Ar^{k4}$ each independently represent a substituted or unsubstituted aryl group. $Ar^{k5}$ represents a substituted or unsubstituted aryl group, or a substituted or unsubstituted arylene group. Dk represents a group represented by the following formula (IIA-a). kc1 to kc5 each independently represent an integer of 0 to 2. kk represents 0 or 1. Provided that, the total number of Dk is from 1 to 8.

[Chem. 51]

(IIA-a)

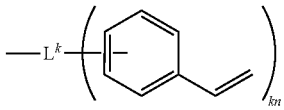

In the formula (IIA-a), $L^k$ represents a (kn+1)-valent linking group including two or more selected from the group consisting of a trivalent or tetravalent group derived from an alkane or an alkene, and an alkylene group, an alkenylene group, —C(═O)—, —N(R)—, —S—, and —O—. R represents a hydrogen atom, an alkyl group, an aryl group, or an aralkyl group. kn represents an integer of 2 to 3.

Hereinafter, the details of the formula (II-a) will be described.

In the formula (II-a), the substituted or unsubstituted aryl groups represented by $Ar^{k1}$ to $Ar^{k4}$ are the same as the substituted or unsubstituted aryl groups represented by $Ar^{a1}$ to $Ar^{a4}$ in the formula (I-a).

When kk is 0, $Ar^{k5}$ represents a substituted or unsubstituted aryl group, and the substituted or unsubstituted aryl group is the same as the substituted or unsubstituted aryl groups represented by $Ar^{a1}$ to $Ar^{a4}$ in the formula (I-a).

When kk is 1, $Ar^{k5}$ represents a substituted or unsubstituted arylene group, and the substituted or unsubstituted arylene group is the same as the substituted or unsubstituted arylene groups represented by $Ar^{a5}$ and $Ar^{a6}$ in the formula (I-a).

From the viewpoint of obtaining a protective layer (outermost surface layer) having a higher strength, the total number of Dk is preferably 2 or more, and more preferably 4 or more. Generally, if the number of the chain polymerizable groups in one molecule is too large, as the polymerization (crosslinking) reaction proceeds, it is difficult for the molecule to move, the chain polymerization reactivity is decreased, and the ratio of the chain polymerizable groups before the reaction is increased, and thus, the total number of Dk is preferably 7 or less, and more preferably 6 or less.

Next, the details of the formula (IIA-a) will be described.

In the formula (IIA-a), the (kn+1)-valent linking group represented by $L^k$ is the same as, for example, the (n+1)-valent linking group represented by L' in the formula (II-a).

Next, the specific examples of the chain polymerizable group-containing charge transporting material are shown.

Specifically, specific examples of the charge transporting skeleton F (for example, a site corresponding to the skeleton excluding Da in the formula (I-a) and Dk in the formula (II-a)) of the formulae (I) and (II), and specific examples of the functional group linked to the charge transporting skeleton F (for example, the site corresponding to Da in the formula (I-a) and Dk in the formula (II-a)), as well as specific examples of the chain polymerizable compounds represented by the formulae (I) and (II) are shown below, but are not limited thereto.

Furthermore, the "*" moiety of the specific examples of the charge transporting skeleton F of the formulae (I) and (II) means that the "*" moiety of the functional group linked to the charge transporting skeleton F is linked.

That is, for example, the exemplary compound (I-b)-1 is shown as a specific example of the charge transporting skeleton F: (M1)-1 and a specific example of the functional group: (R2)-1, but the specific structures are shown as the following structures.

(I-b)-1

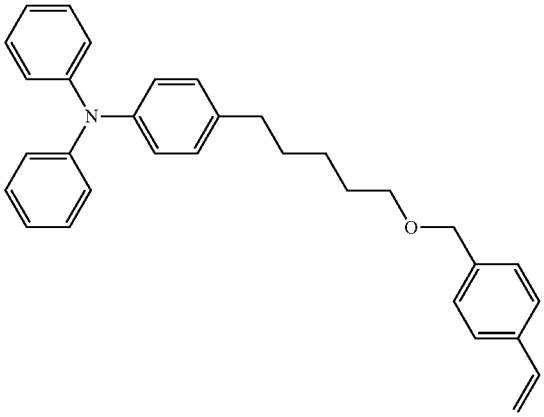

First, specific examples of the charge transporting skeleton F are shown below.

(M1)-1

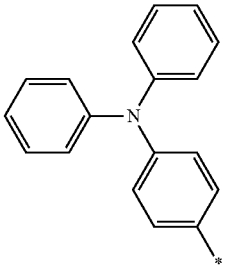

(M1)-2

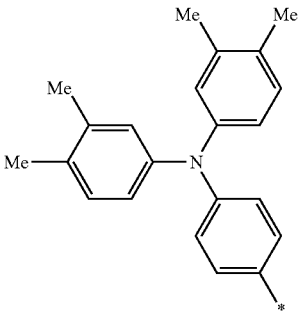

(M1)-3

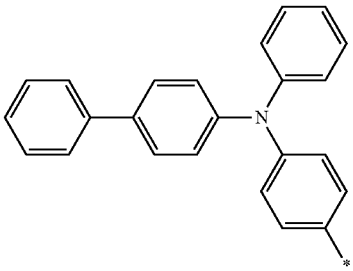

(M1)-4

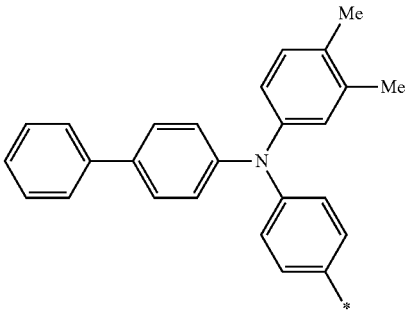

(M1)-5

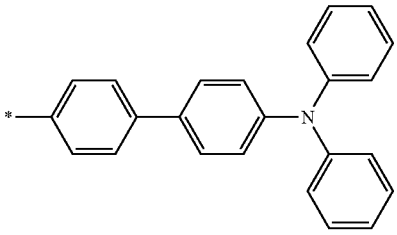

-continued
(M1)-6
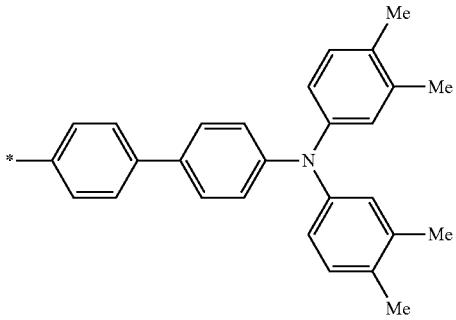
(M1)-7
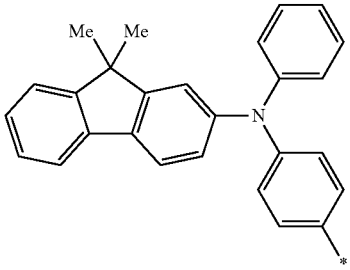
(M1)-8
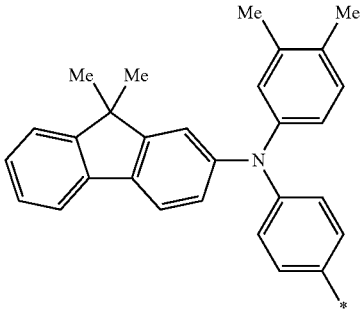
(M1)-9
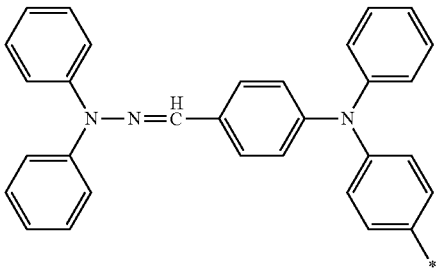
(M1)-10
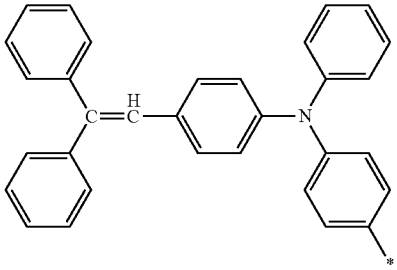
-continued
(M1)-11
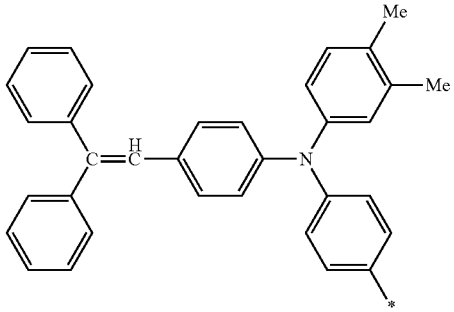
(M1)-12
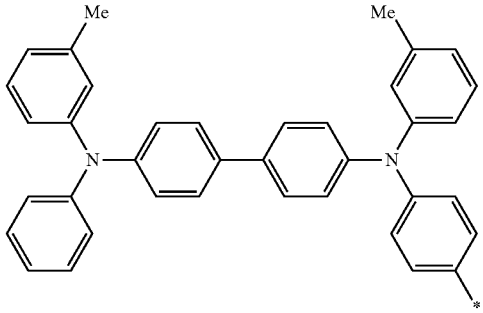
(M1)-13
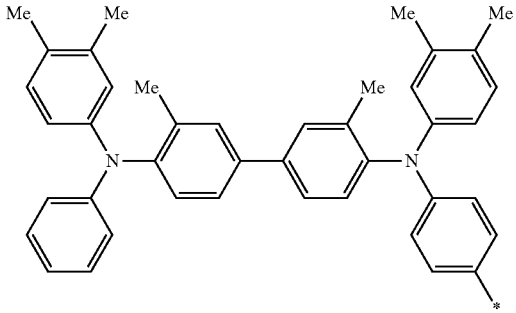
(M1)-14
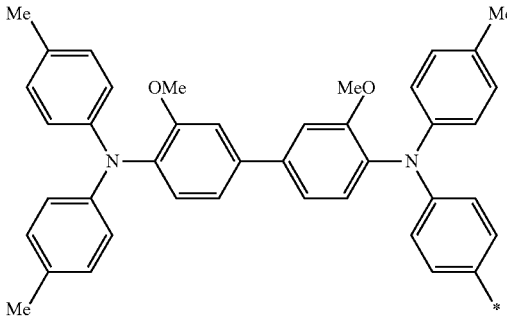

-continued
(M1)-15
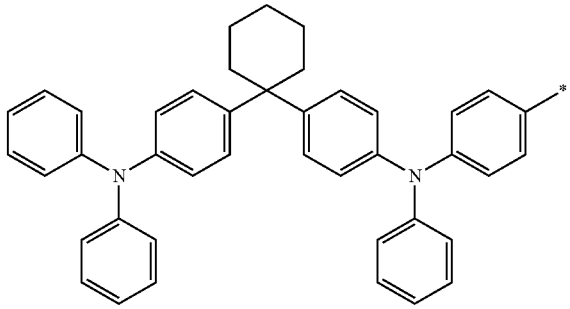
(M1)-16
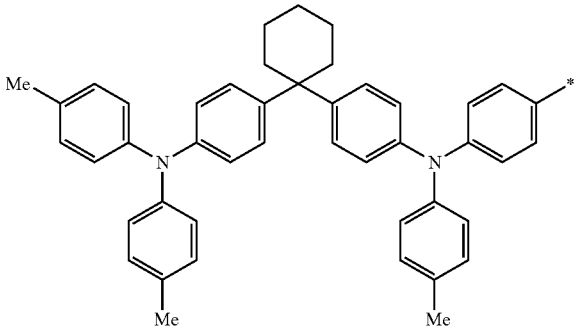
(M1)-17
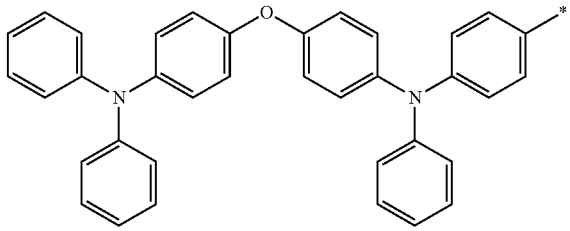
(M1)-18
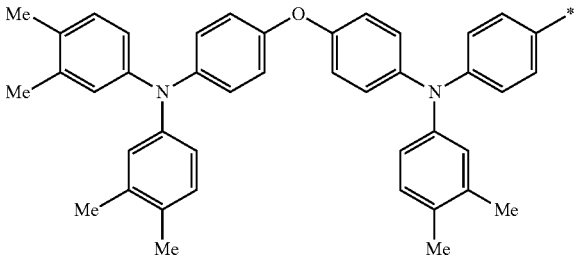
(M1)-19
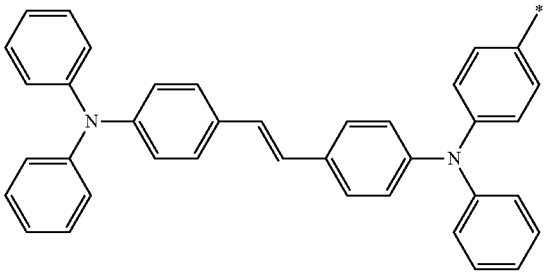
-continued
(M1)-20
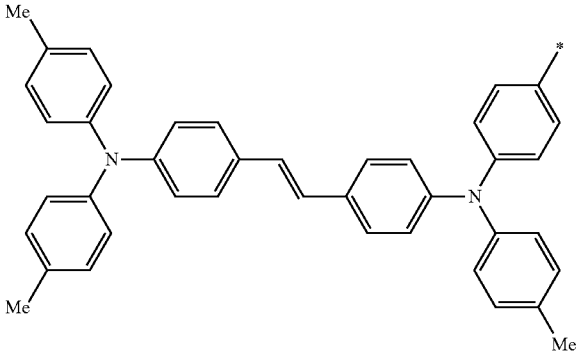
(M1)-21
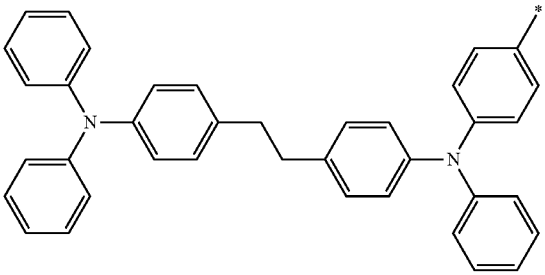
(M1)-22
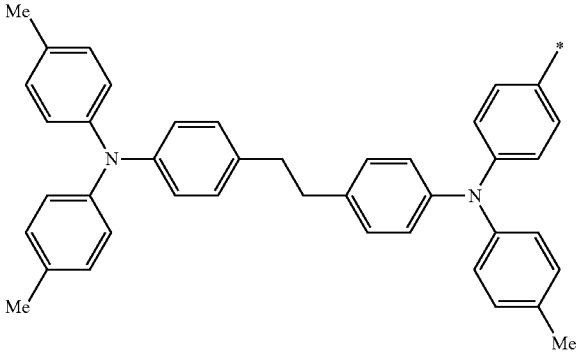
(M2)-1
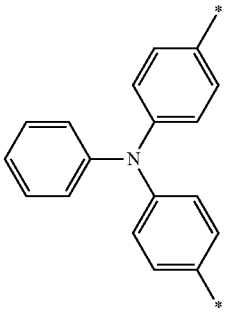

-continued
(M2)-2
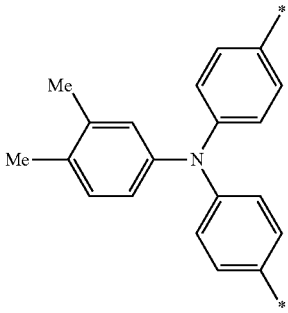
(M2)-3
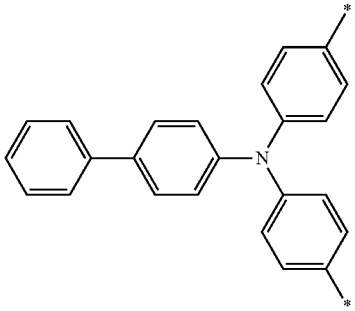
(M2)-4
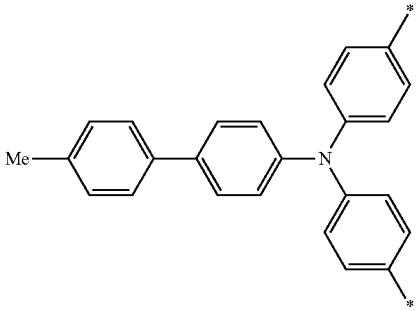
(M2)-5
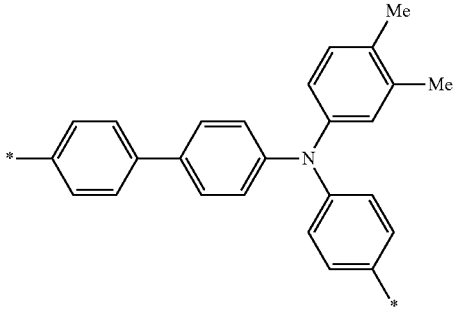
(M2)-6
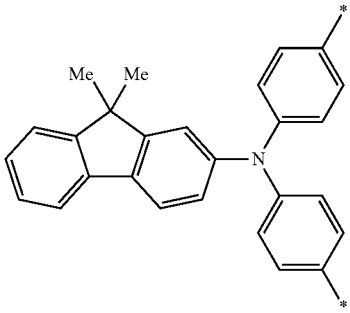
-continued
(M2)-7
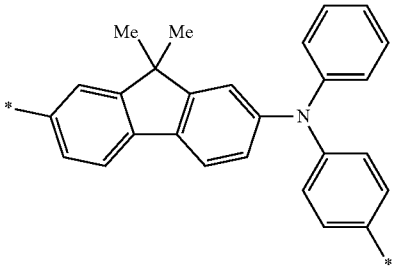
(M2)-8
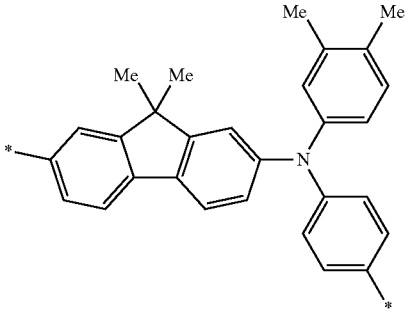
(M2)-9
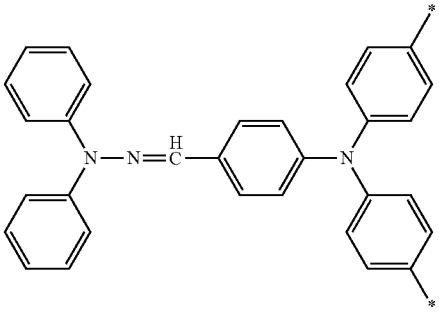
(M2)-10
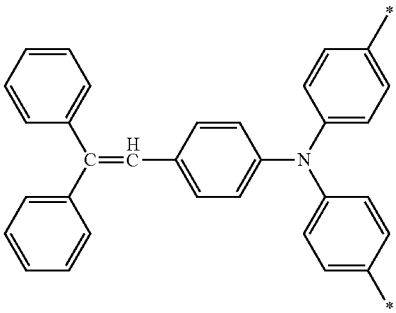
(M2)-11
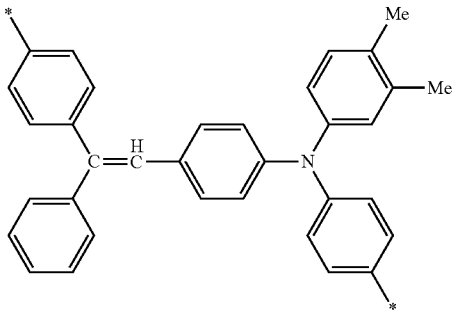

-continued
(M2)-12
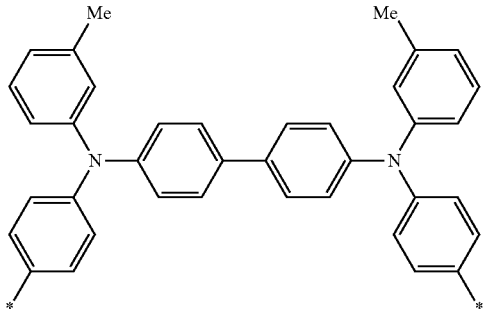
(M2)-13
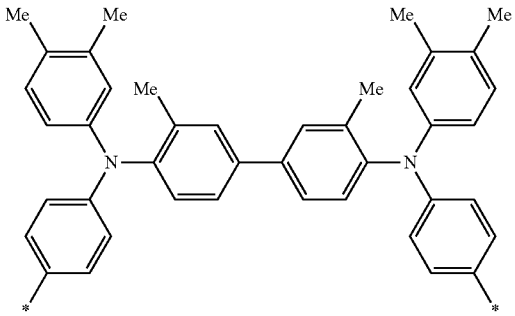
(M2)-14
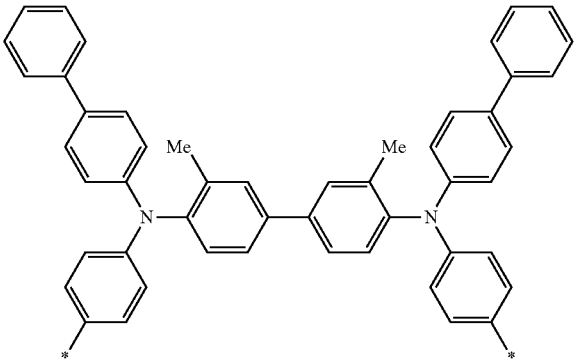
(M2)-15
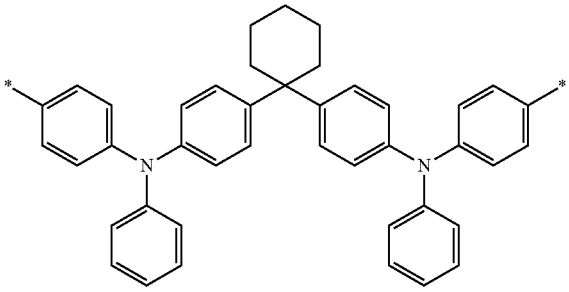
-continued
(M2)-16
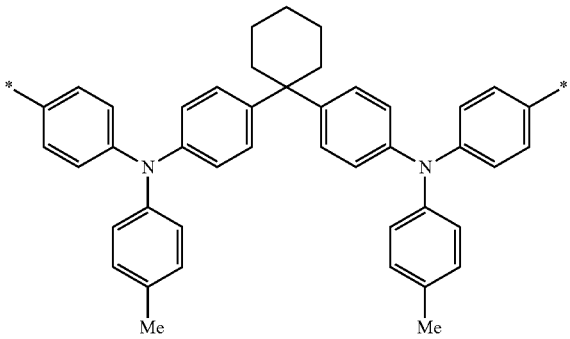
(M2)-17
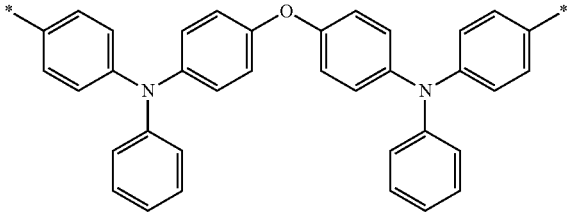
(M2)-18
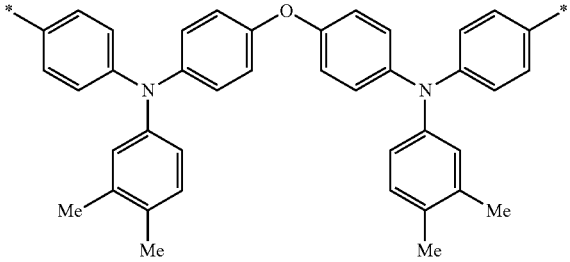
(M2)-19
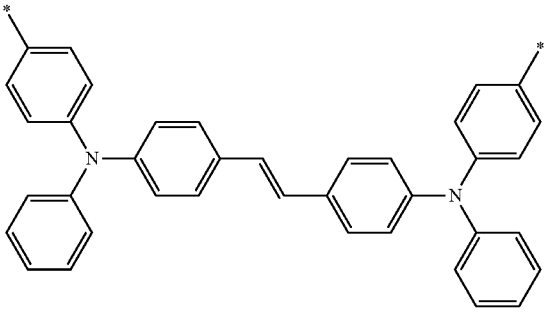
(M2)-20
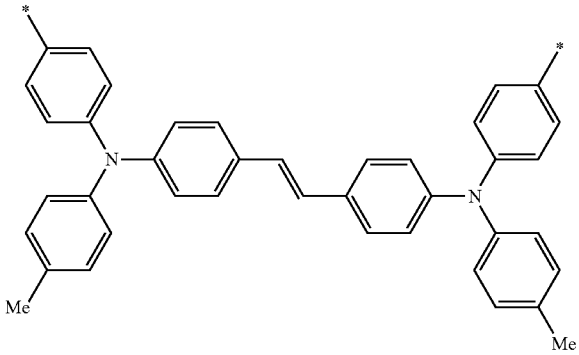

-continued
(M2)-21
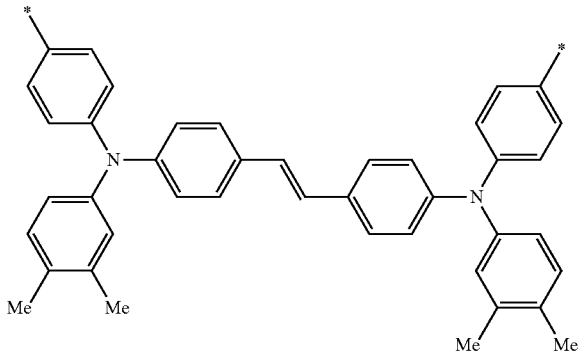
(M2)-22
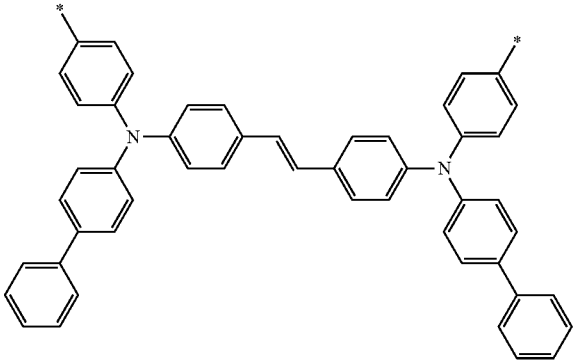
(M2)-23
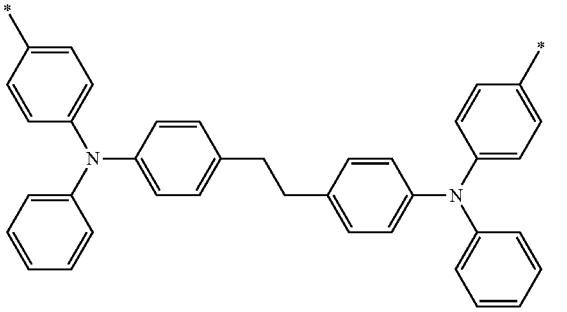
(M2)-24
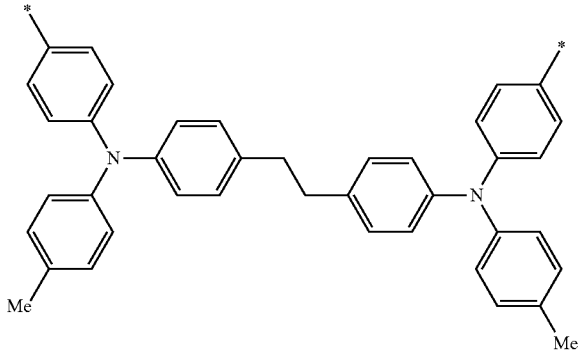
-continued
(M2)-25
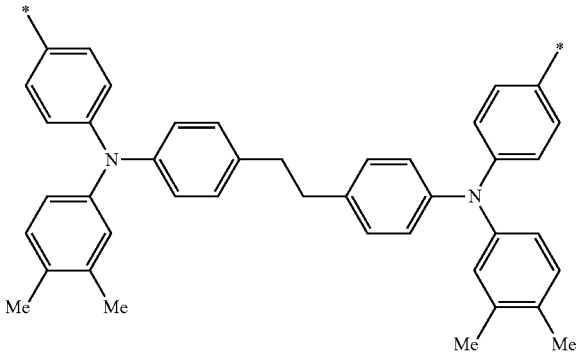
(M2)-26
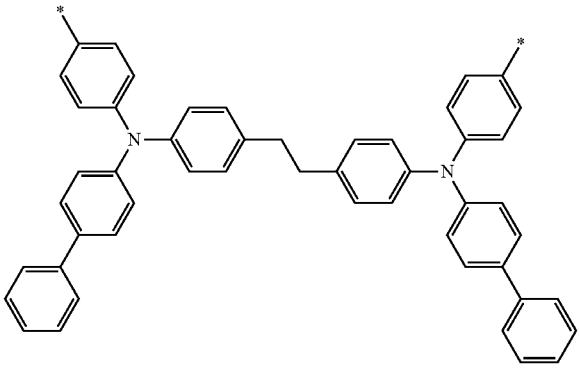
(M2)-27
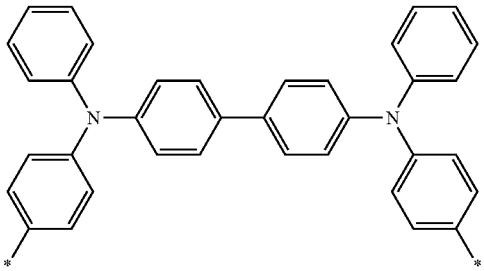
(M2)-28
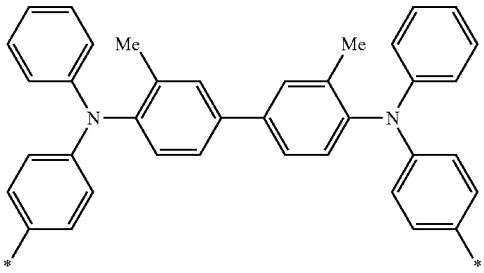

-continued
(M3)-1
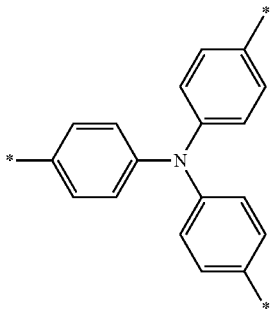
(M3)-2
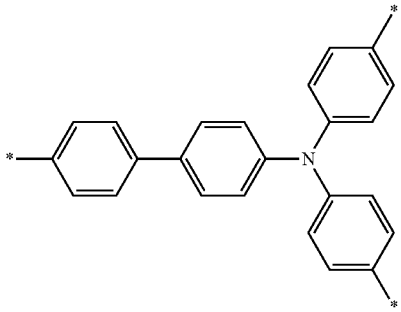
(M3)-3
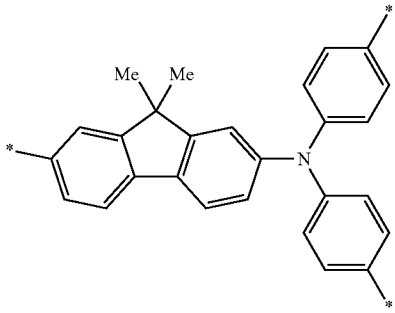
(M3)-4
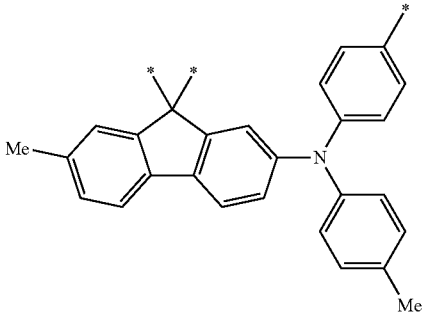
(M3)-5
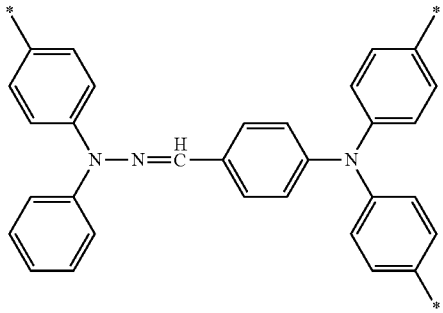
-continued
(M3)-6
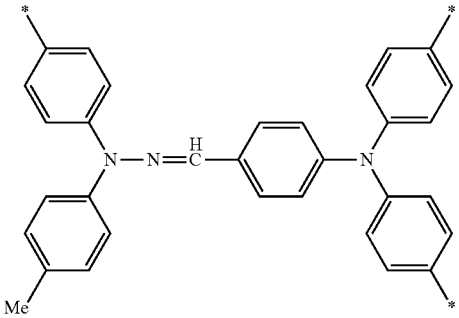
(M3)-7
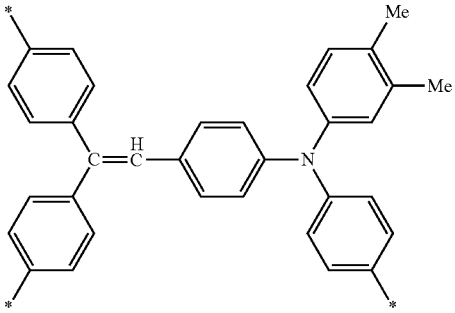
(M3)-8
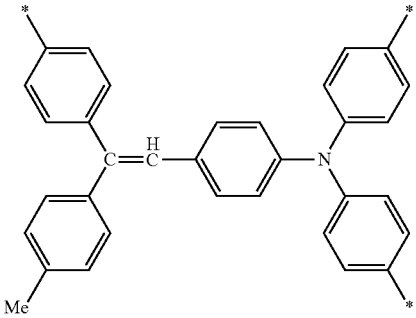
(M3)-9
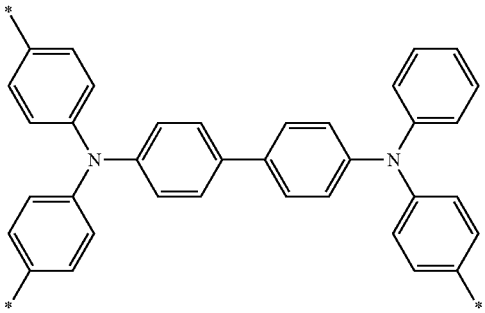
(M3)-10
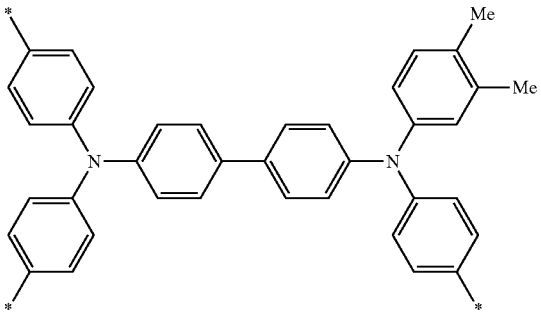

-continued
(M3)-11
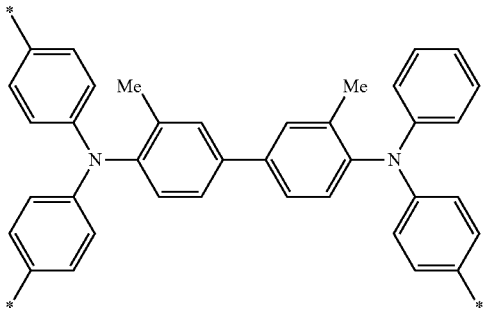
(M3)-12
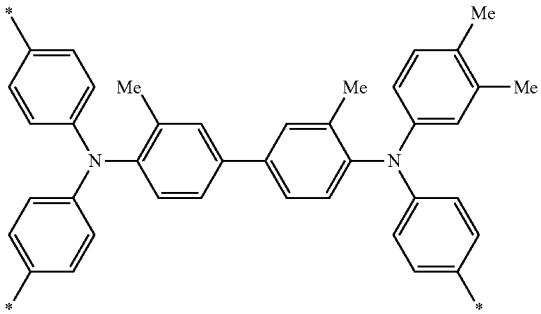
(M3)-13
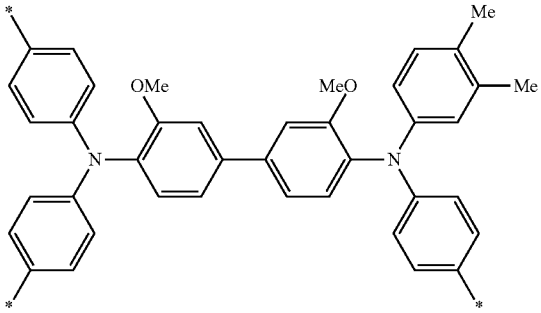
(M3)-14
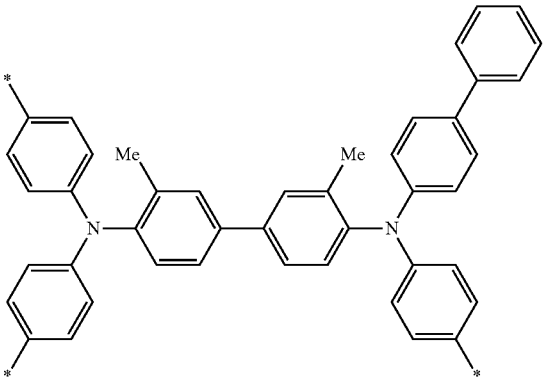
-continued
(M3)-15
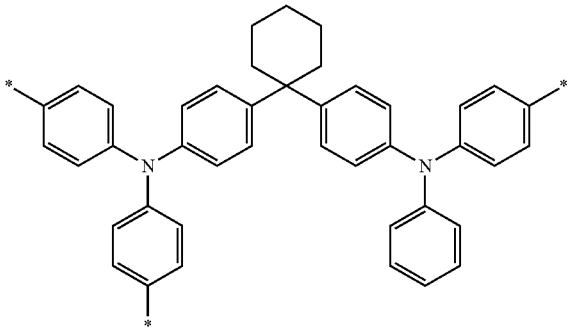
(M3)-16
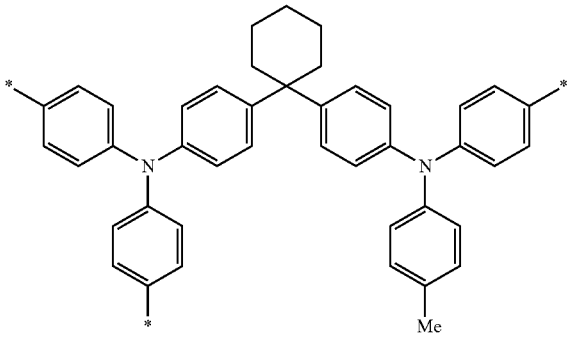
(M3)-17
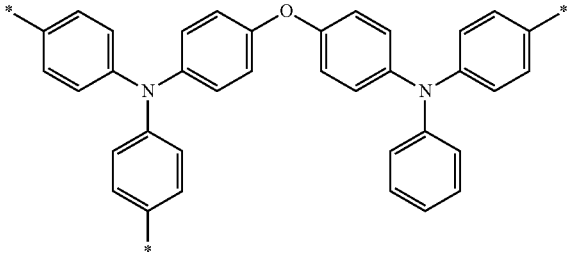
(M3)-18
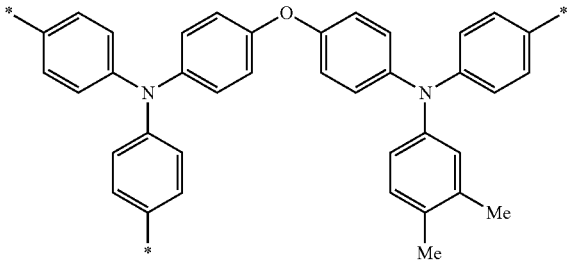
(M3)-19
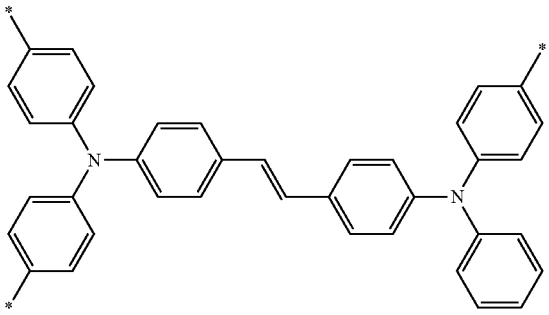

-continued
(M3)-20
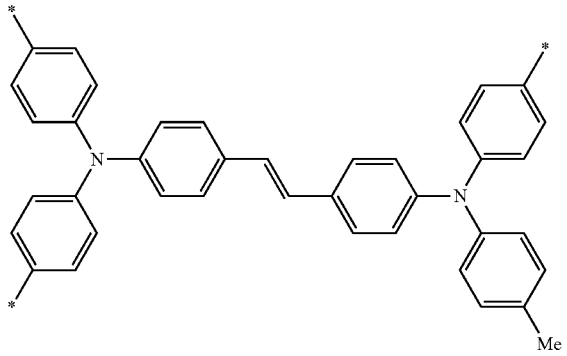
(M3)-21
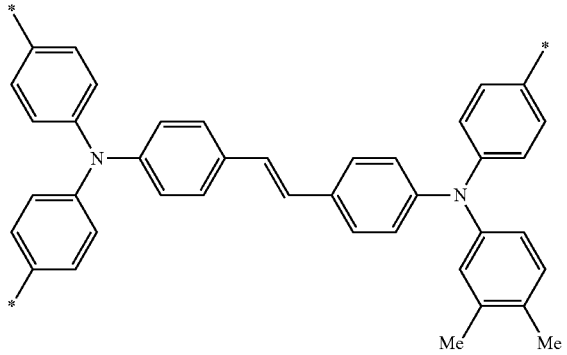
(M3)-22
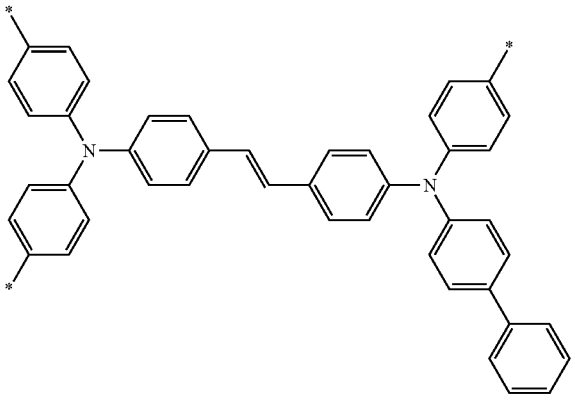
(M3)-23
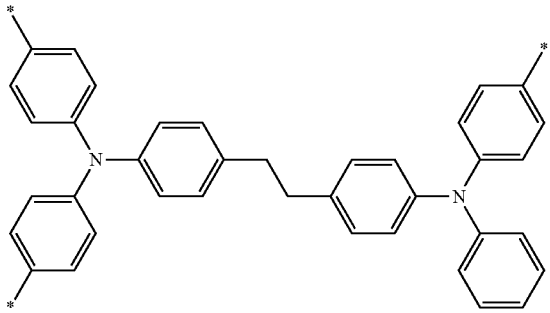
-continued
(M3)-24
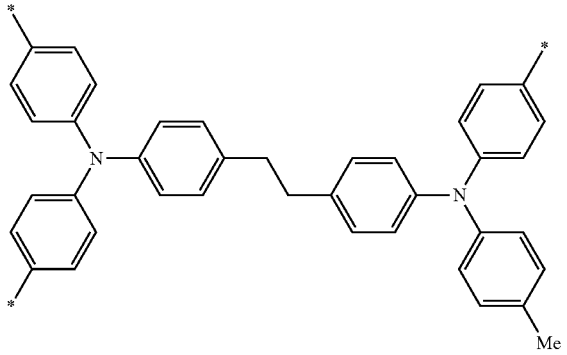
(M3)-25
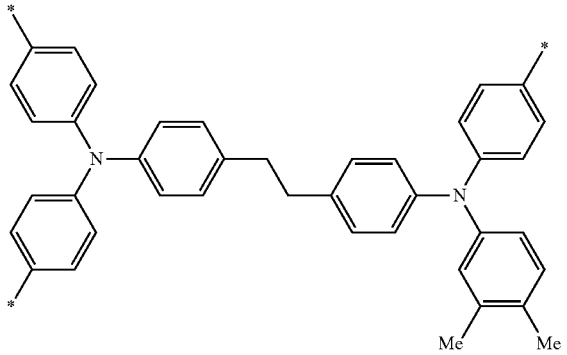
(M3)-26
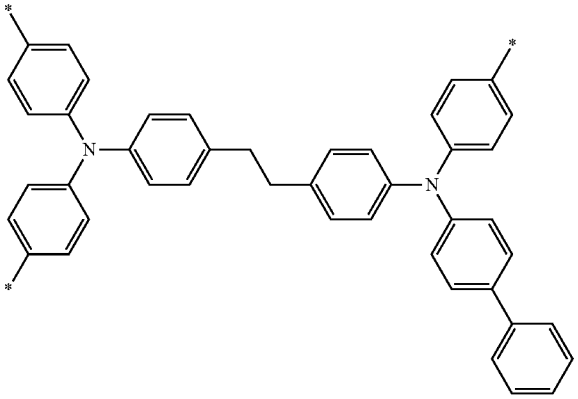
(M4)-1
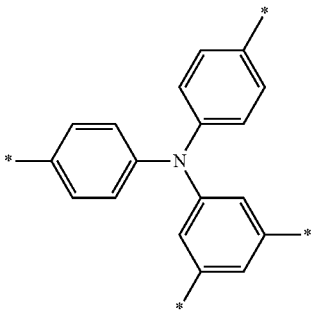

-continued
(M4)-2
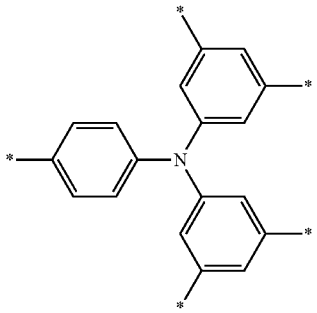
(M4)-3
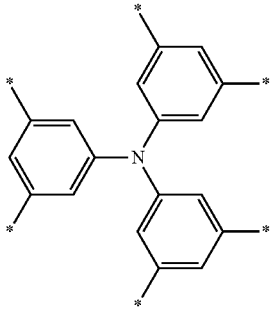
(M4)-4
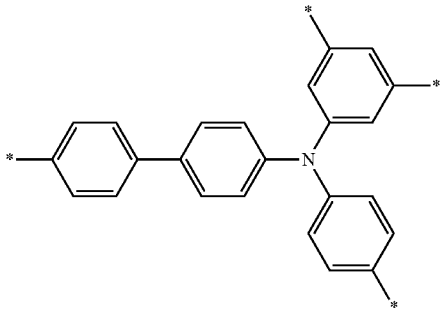
(M4)-5
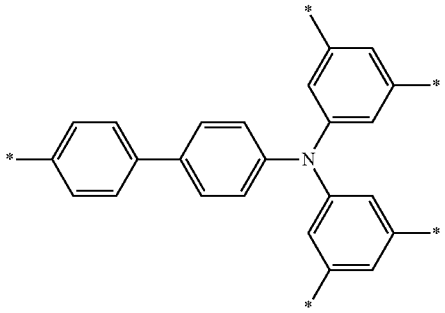
(M4)-6
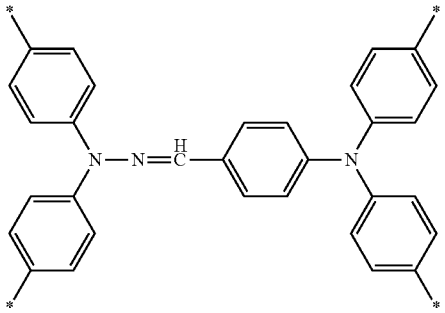
-continued
(M4)-7
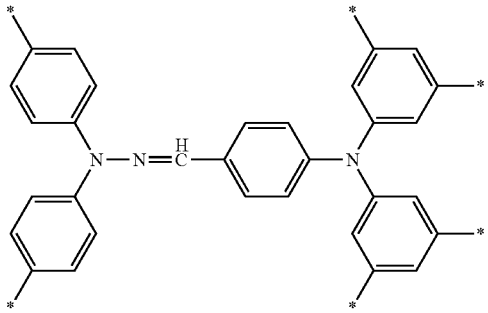
(M4)-8
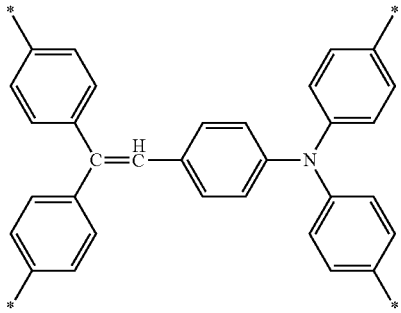
(M4)-9
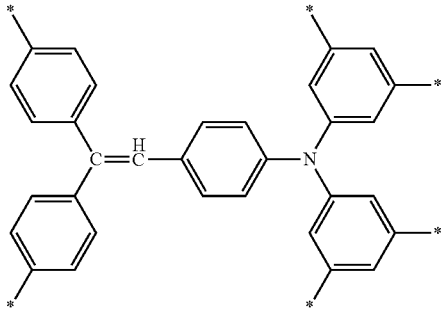
(M4)-10
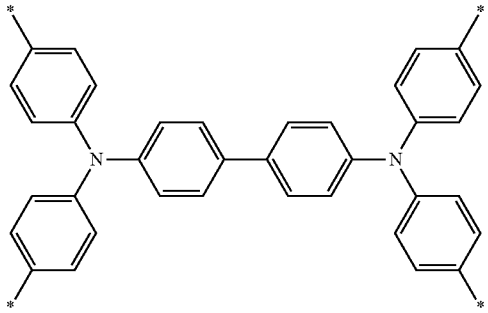
(M4)-11
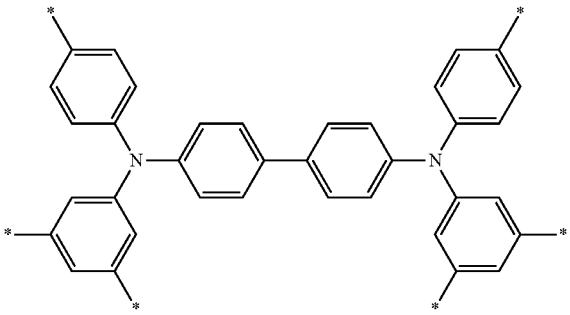

-continued
(M4)-12
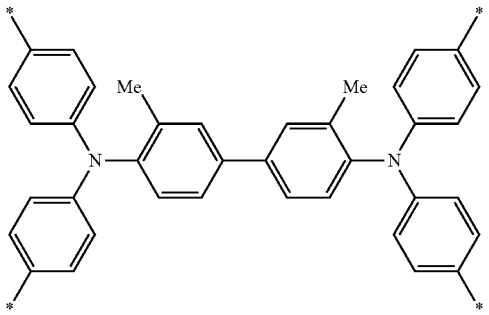
(M4)-13
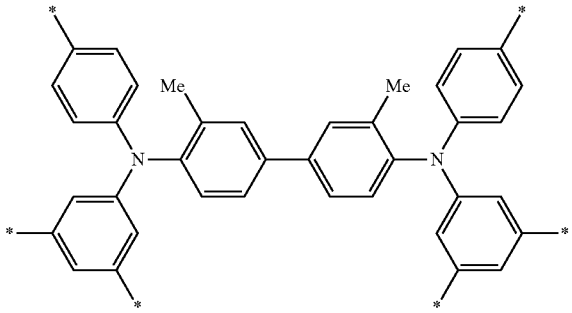
(M4)-14
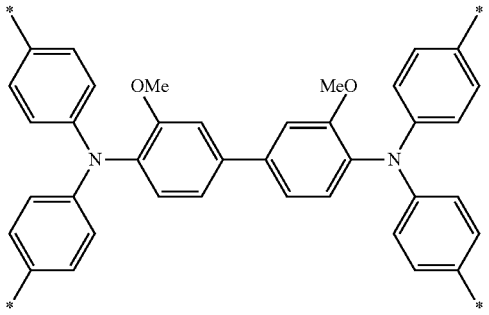
(M4)-15
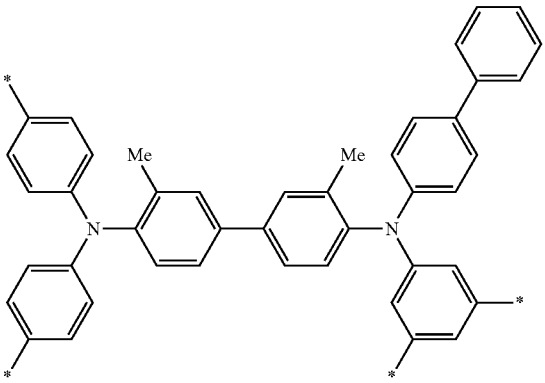
-continued
(M4)-16
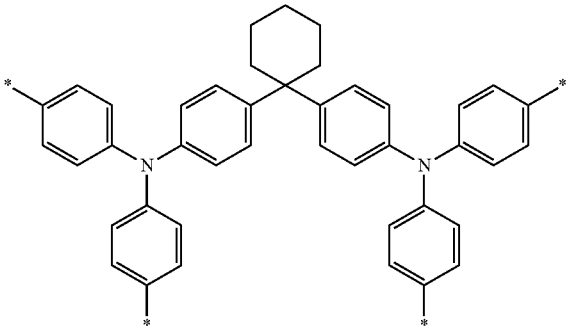
(M4)-17
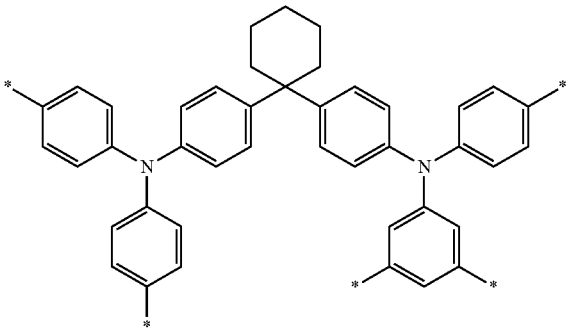
(M4)-18
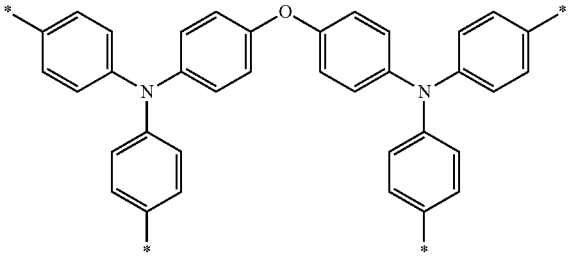
(M4)-19
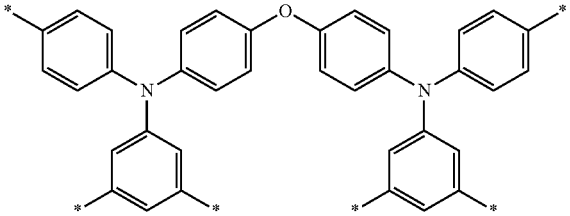
(M4)-20
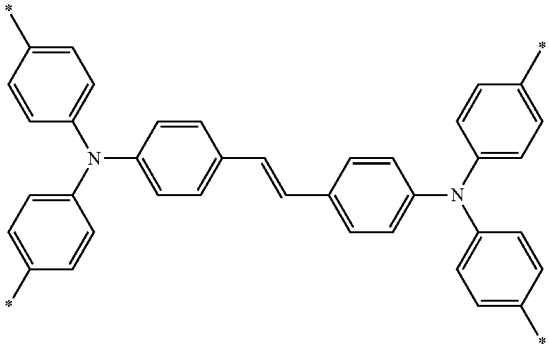

-continued
(M4)-21
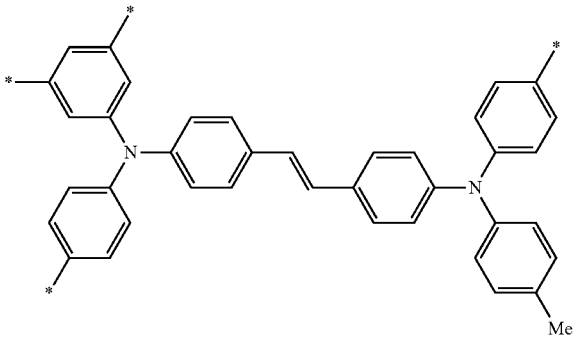
(M4)-22
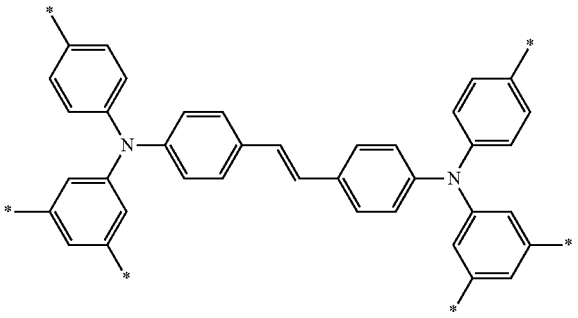
(M4)-23
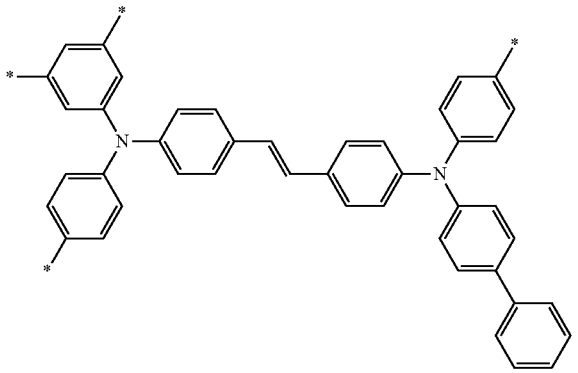
(M4)-24
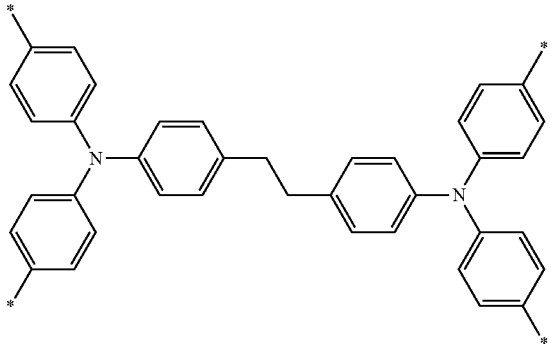
-continued
(M4)-25
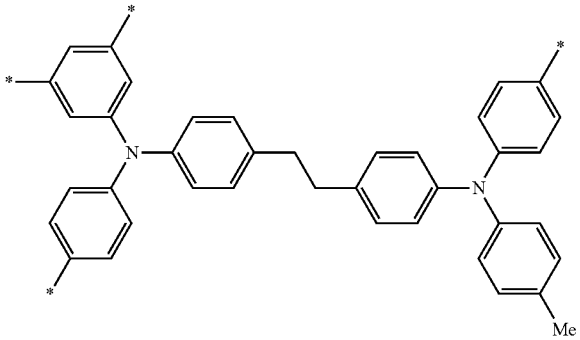
(M4)-26
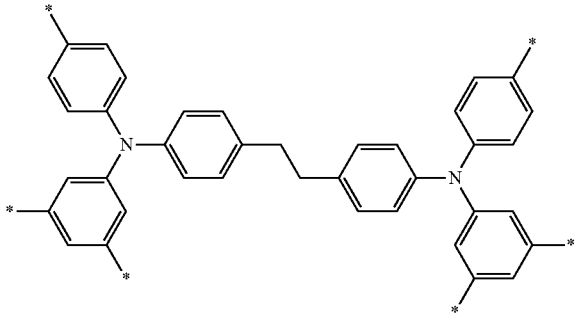
(M4)-27
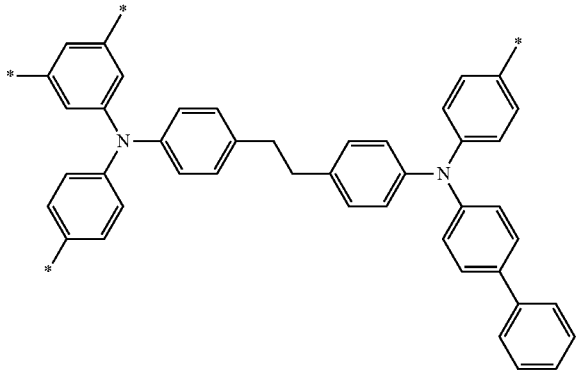
(M4)-28
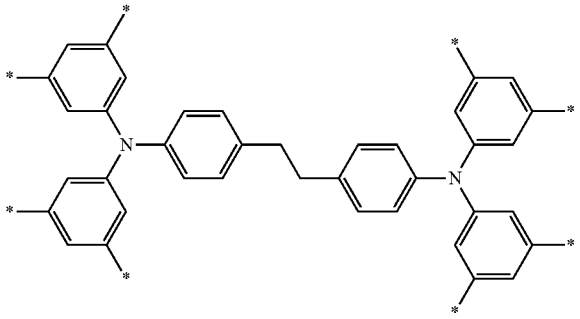
Next, specific examples of the functional group linked to the charge transporting skeleton F are shown.

(R1)-1
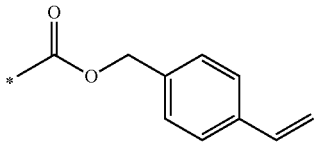
(R1)-2
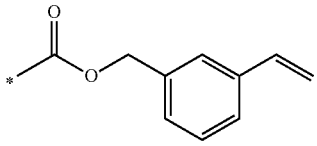
(R1)-3
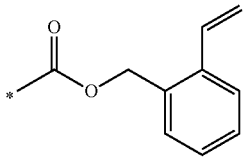
(R1)-4
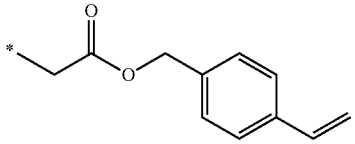
(R1)-5
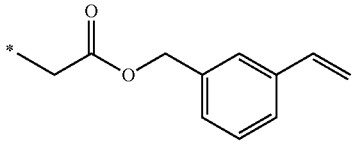
(R1)-6
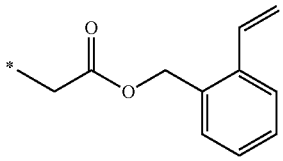
(R1)-7
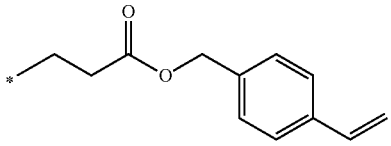
(R1)-8
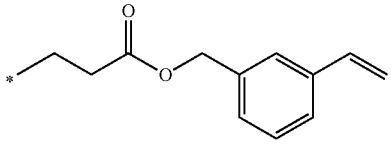
(R1)-9
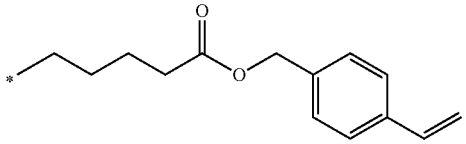
(R1)-10
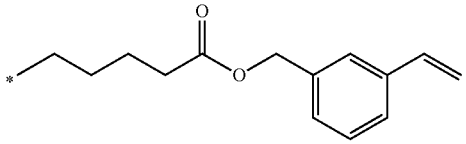
-continued
(R1)-11
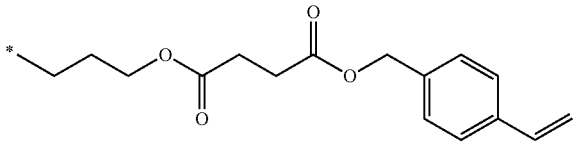
(R1)-12
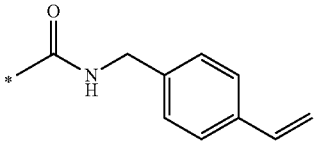
(R1)-13
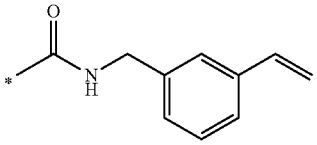
(R1)-14
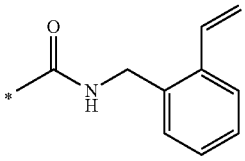
(R1)-15
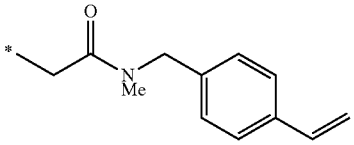
(R1)-16
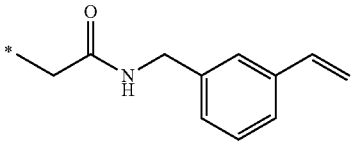
(R1)-17
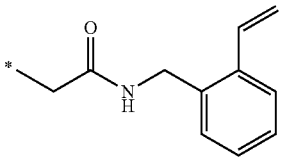
(R1)-18
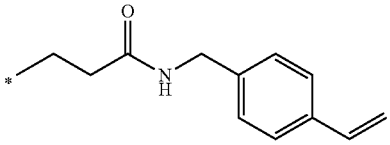
(R1)-19
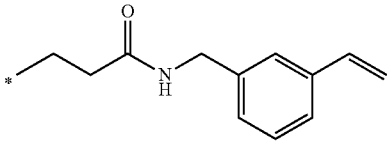
(R1)-20
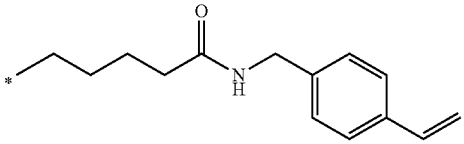

-continued
(R1)-21
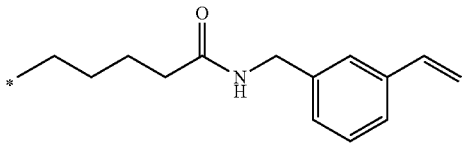
(R1)-22
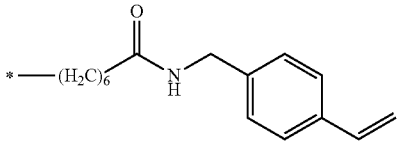
(R1)-23
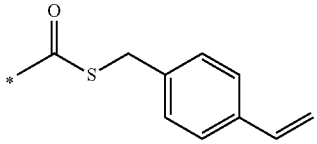
(R1)-24
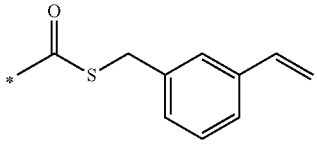
(R1)-25
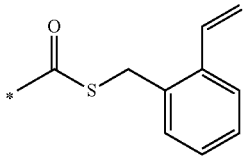
(R1)-26
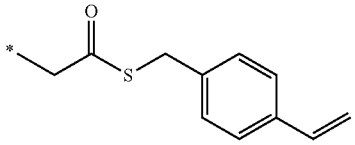
(R1)-27
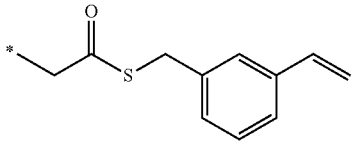
(R1)-28
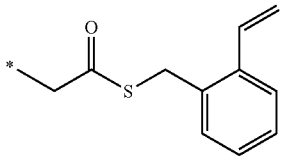
(R1)-29
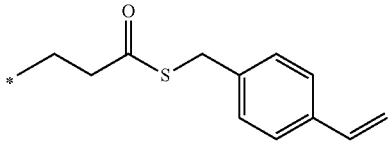
(R1)-30
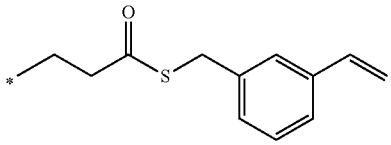
-continued
(R1)-31
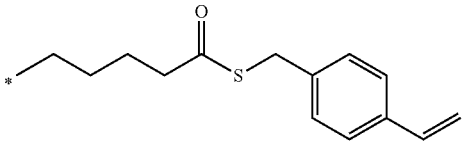
(R1)-32
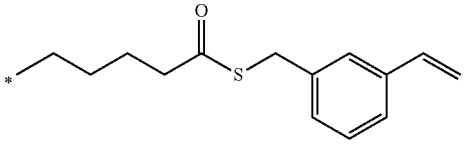
(R1)-33
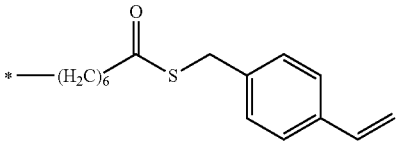
(R1)-34
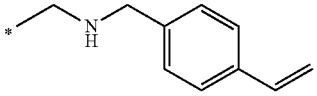
(R1)-35
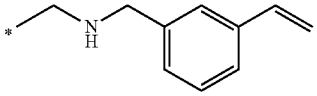
(R1)-36
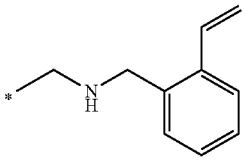
(R1)-37
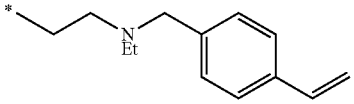
(R1)-38
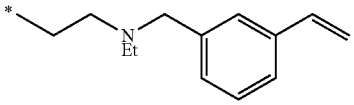
(R1)-39
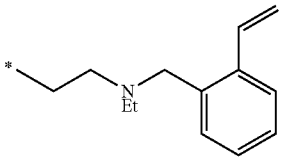
(R1)-40
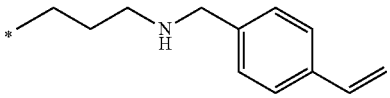
(R1)-41
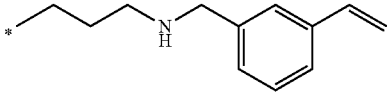

-continued
(R1)-42
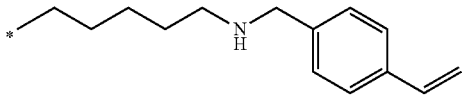
(R1)-43
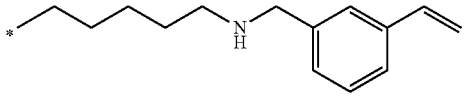
(R1)-44
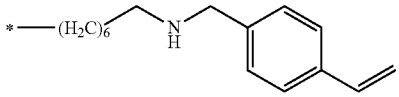
(R1)-45
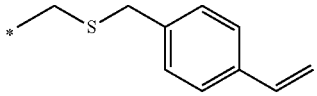
(R1)-46
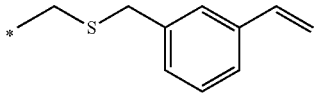
(R1)-47
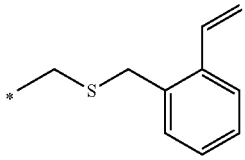
(R1)-48
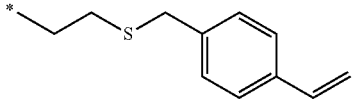
(R1)-49
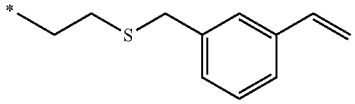
(R1)-50
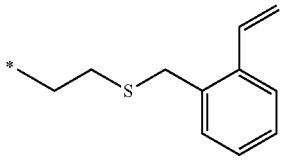
(R1)-51
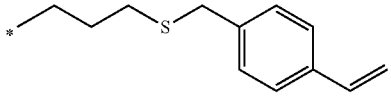
(R1)-52
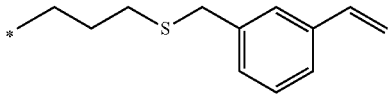
(R1)-53
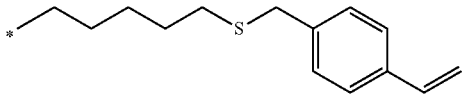
-continued
(R1)-54
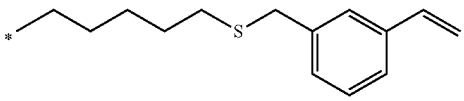
(R1)-55
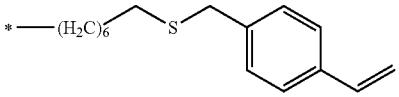
(R2)-1
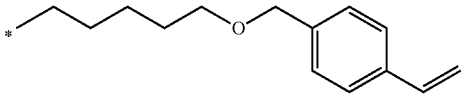
(R2)-2
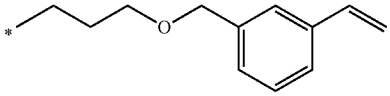
(R2)-3
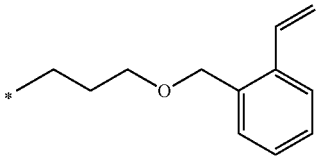
(R2)-4
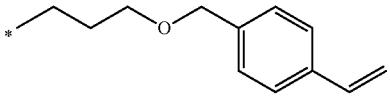
(R2)-5
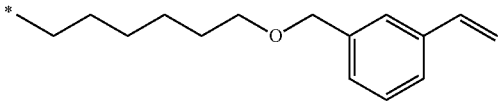
(R2)-6
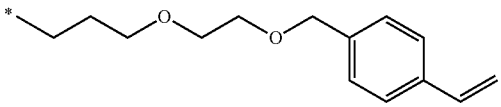
(R2)-7
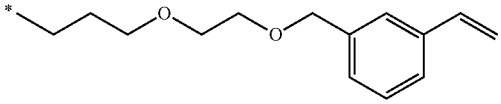
(R2)-8
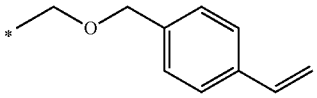
(R2)-9
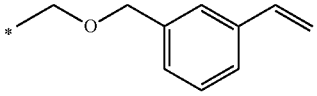
(R2)-10
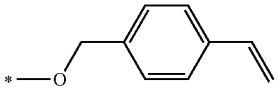
(R2)-11
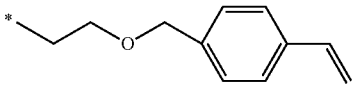

-continued
(R3)-1
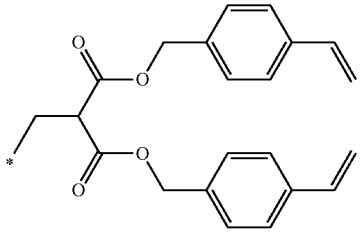
(R3)-2
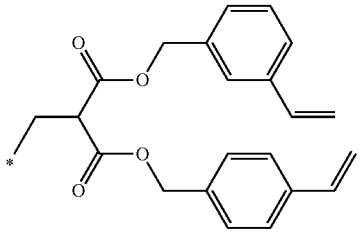
(R3)-3
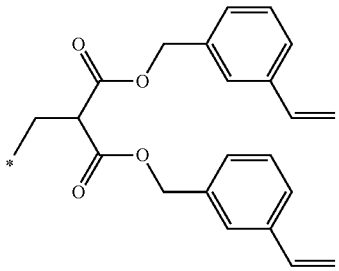
(R3)-4
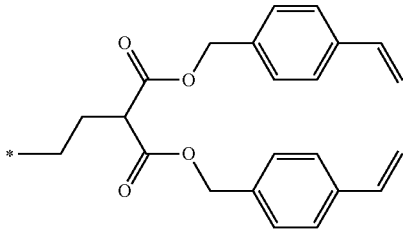
(R3)-5
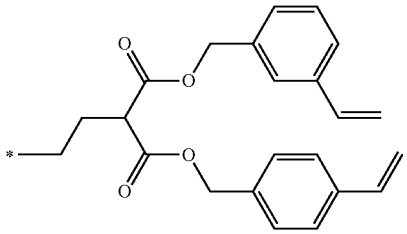
(R3)-6
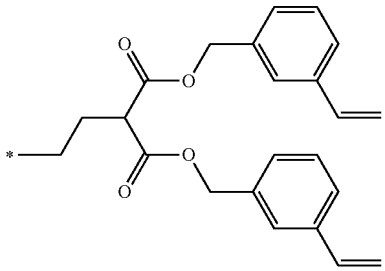
-continued
(R3)-7
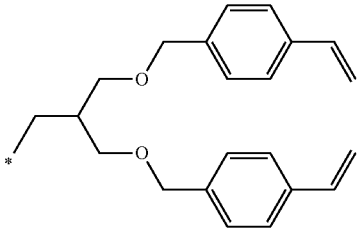
(R3)-8
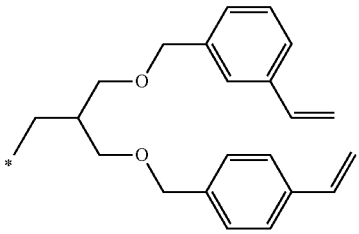
(R3)-9
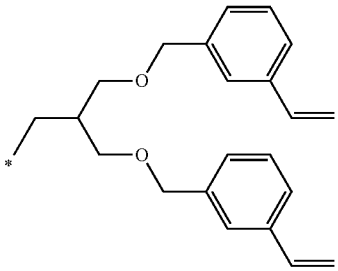
(R3)-10
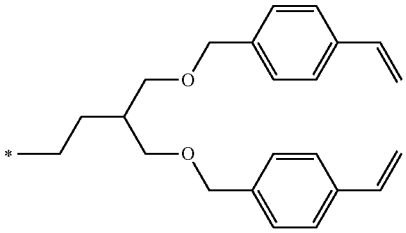
(R3)-11
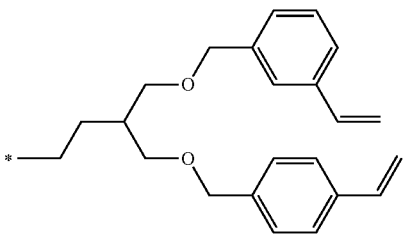
(R3)-12
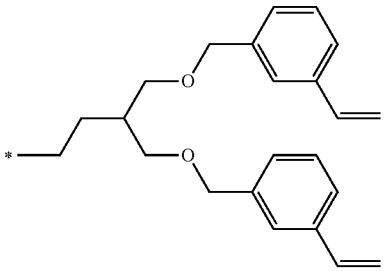

-continued
(R3)-13
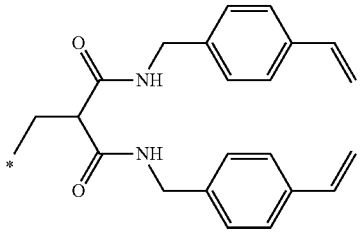
(R3)-14
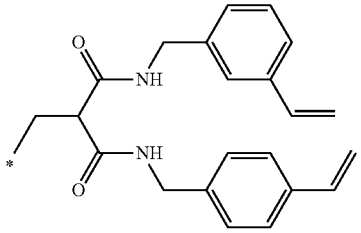
(R3)-15
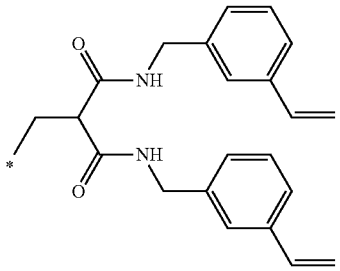
(R3)-16
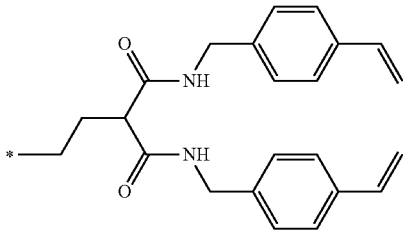
(R3)-17
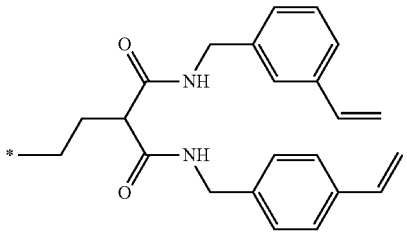
(R3)-18
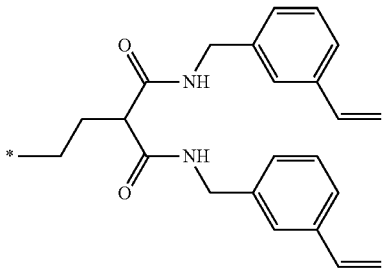
-continued
(R3)-19
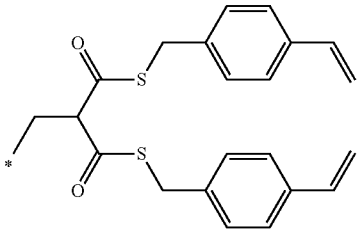
(R3)-20
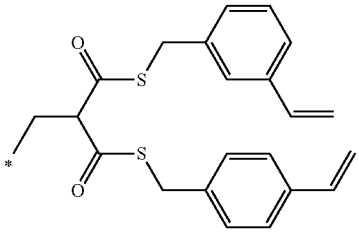
(R3)-21
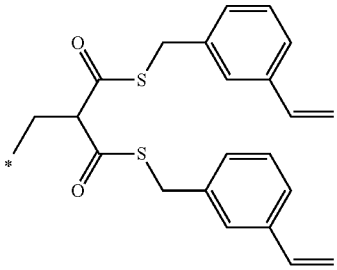
(R3)-22
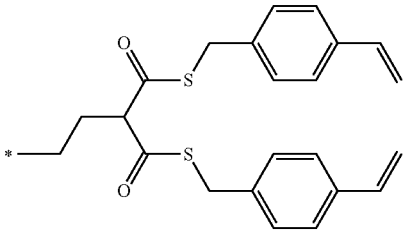
(R3)-23
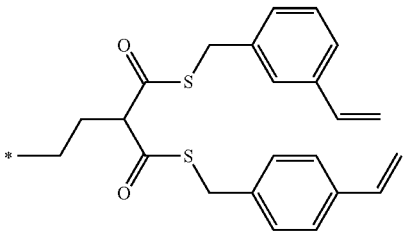
(R3)-24
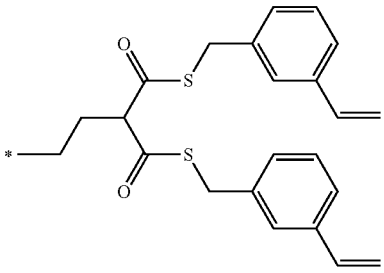

-continued
(R3)-25
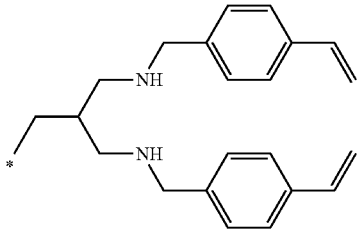
(R3)-26
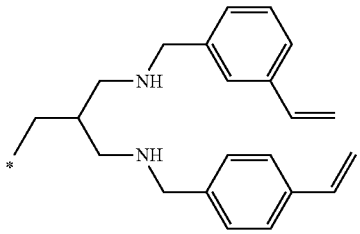
(R3)-27
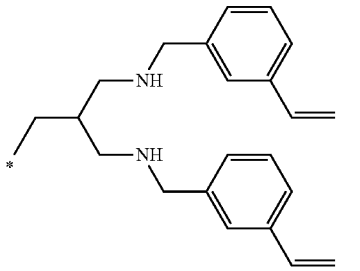
(R3)-28
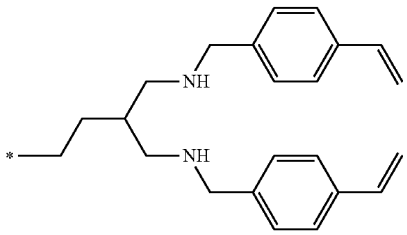
(R3)-29
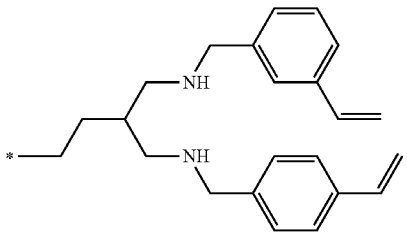
(R3)-30
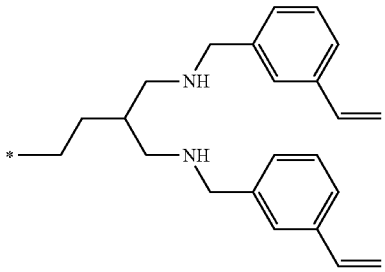
-continued
(R3)-31
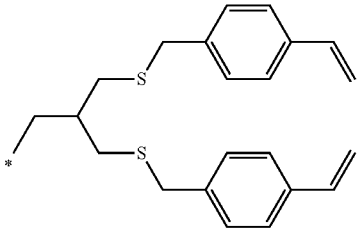
(R3)-32
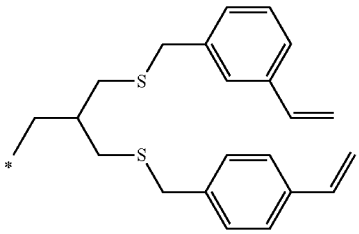
(R3)-33
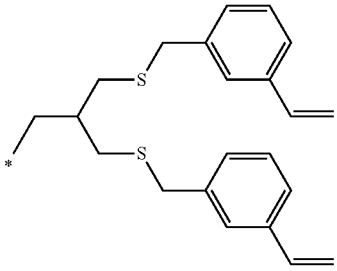
(R3)-34
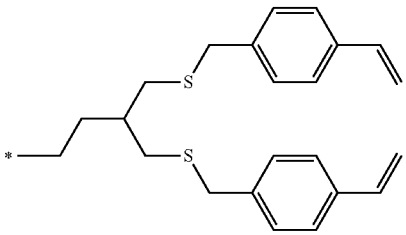
(R3)-35
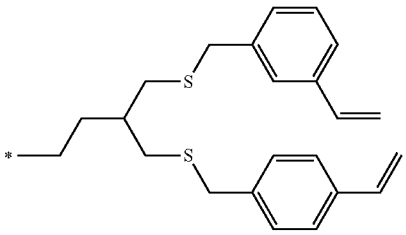
(R3)-36
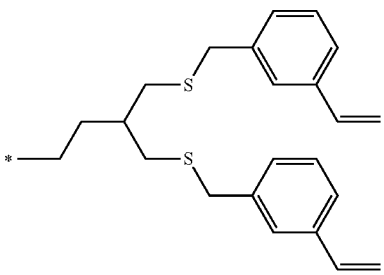

-continued
(R3)-37
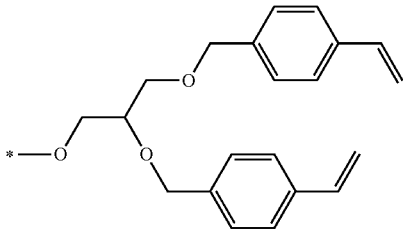
(R3)-38
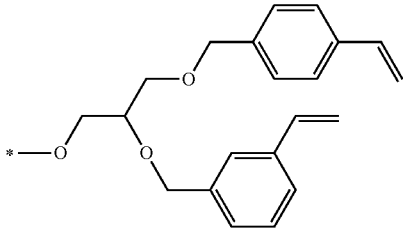
(R3)-39
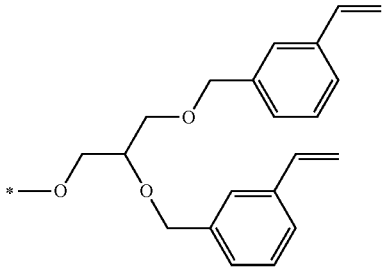
(R3)-40
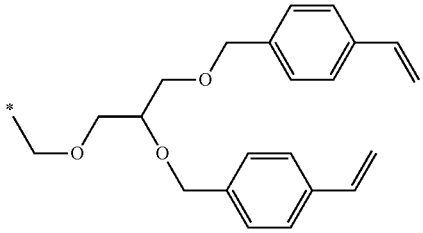
(R3)-41
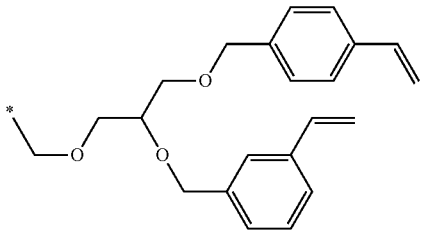
(R3)-42
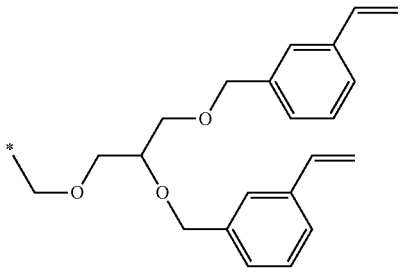
-continued
(R3)-43
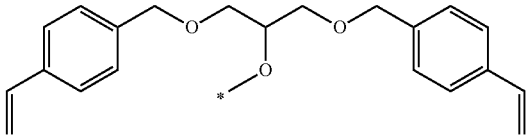
(R3)-44
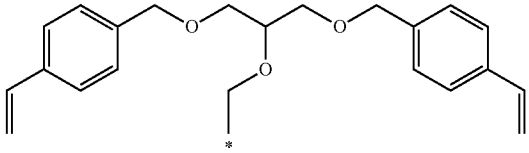
(R3)-45
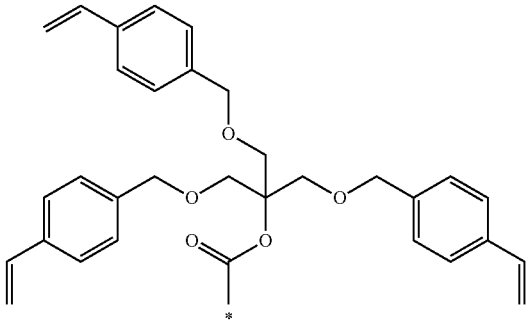
(R3)-46
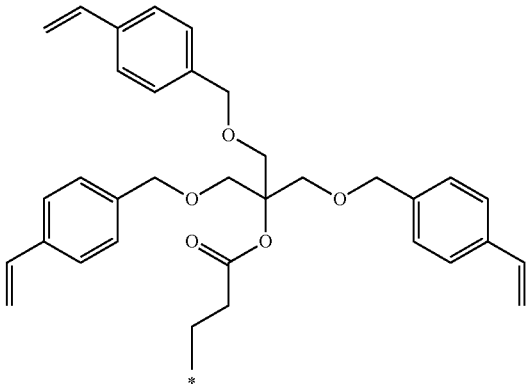
(R3)-47
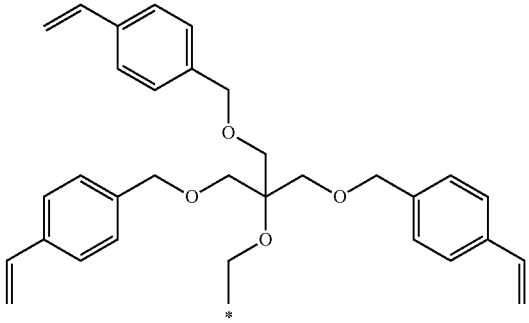

-continued (R3)-48

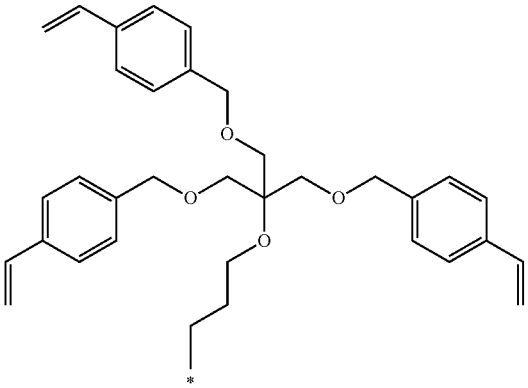

(R4)-1

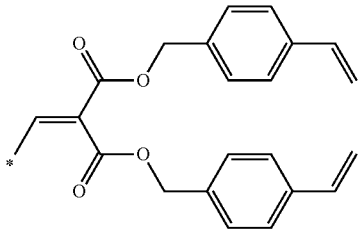

(R4)-2

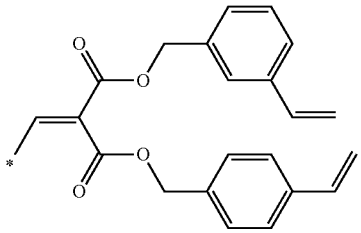

(R4)-3

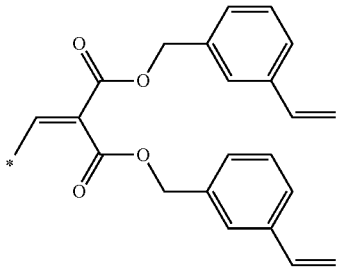

(R4)-4

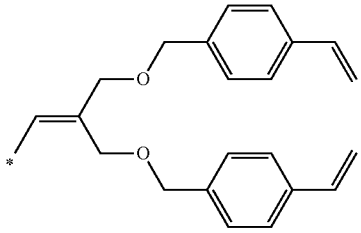

-continued (R4)-5

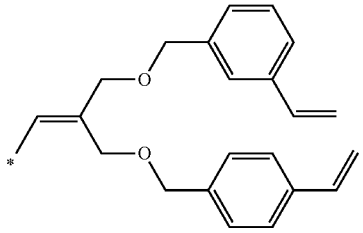

(R4)-6

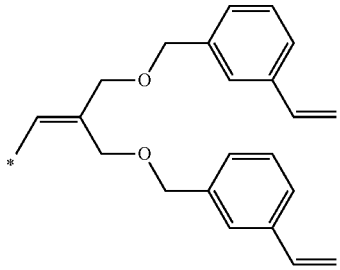

Next, specific examples of the compound represented by the formula (I), specifically the formula (I-a) are shown below.

Specific Examples of Formula (I) [Formula (I-a)]

| Exemplary compound | Charge transporting skeleton F | Functional group |
|---|---|---|
| (I-a)-1 | (M1)-15 | (R2)-8 |
| (I-a)-2 | (M1)-15 | (R2)-9 |
| (I-a)-3 | (M1)-15 | (R2)-10 |
| (I-a)-4 | (M1)-16 | (R2)-8 |
| (I-a)-5 | (M1)-17 | (R2)-8 |
| (I-a)-6 | (M1)-17 | (R2)-9 |
| (I-a)-7 | (M1)-17 | (R2)-10 |
| (I-a)-8 | (M1)-18 | (R2)-8 |
| (I-a)-9 | (M1)-18 | (R2)-9 |
| (I-a)-10 | (M1)-18 | (R2)-10 |
| (I-a)-11 | (M1)-19 | (R2)-8 |
| (I-a)-12 | (M1)-21 | (R2)-8 |
| (I-a)-13 | (M1)-22 | (R2)-8 |
| (I-a)-14 | (M2)-15 | (R2)-8 |
| (I-a)-15 | (M2)-15 | (R2)-9 |
| (I-a)-16 | (M2)-15 | (R2)-10 |
| (I-a)-17 | (M2)-16 | (R2)-8 |
| (I-a)-18 | (M2)-17 | (R2)-8 |
| (I-a)-19 | (M2)-23 | (R2)-8 |
| (I-a)-20 | (M2)-23 | (R2)-9 |
| (I-a)-21 | (M2)-23 | (R2)-10 |
| (I-a)-22 | (M2)-24 | (R2)-8 |
| (I-a)-23 | (M2)-24 | (R2)-9 |
| (I-a)-24 | (M2)-24 | (R2)-10 |
| (I-a)-25 | (M2)-25 | (R2)-8 |
| (I-a)-26 | (M2)-25 | (R2)-9 |
| (I-a)-27 | (M2)-25 | (R2)-10 |
| (I-a)-28 | (M2)-26 | (R2)-8 |
| (I-a)-29 | (M2)-26 | (R2)-9 |
| (I-a)-30 | (M2)-26 | (R2)-10 |
| (I-a)-31 | (M2)-21 | (R2)-11 |

Next, specific examples of the compound represented by the formula (I), specifically the formula (I-b), are shown below.

Specific Examples of Formula (I) [Formula (I-b)]

| Exemplary compound | Charge transporting skeleton F | Functional group |
|---|---|---|
| (I-b)-1 | (M1)-1 | (R2)-1 |
| (I-b)-2 | (M1)-1 | (R2)-2 |

-continued

| Exemplary compound | Charge transporting skeleton F | Functional group |
|---|---|---|
| (I-b)-3 | (M1)-1 | (R2)-4 |
| (I-b)-4 | (M1)-2 | (R2)-5 |
| (I-b)-5 | (M1)-2 | (R2)-7 |
| (I-b)-6 | (M1)-4 | (R2)-3 |
| (I-b)-7 | (M1)-4 | (R2)-5 |
| (I-b)-8 | (M1)-5 | (R2)-6 |
| (I-b)-9 | (M1)-8 | (R2)-4 |
| (I-b)-10 | (M1)-16 | (R2)-5 |
| (I-b)-11 | (M1)-20 | (R2)-1 |
| (I-b)-12 | (M1)-22 | (R2)-1 |
| (I-b)-13 | (M2)-2 | (R2)-1 |
| (I-b)-14 | (M2)-2 | (R2)-3 |
| (I-b)-15 | (M2)-2 | (R2)-4 |
| (I-b)-16 | (M2)-6 | (R2)-4 |
| (I-b)-17 | (M2)-6 | (R2)-5 |
| (I-b)-18 | (M2)-6 | (R2)-6 |
| (I-b)-19 | (M2)-10 | (R2)-4 |
| (I-b)-20 | (M2)-10 | (R2)-5 |
| (I-b)-21 | (M2)-13 | (R2)-1 |
| (I-b)-22 | (M2)-13 | (R2)-3 |
| (I-b)-23 | (M2)-13 | (R2)-4 |
| (I-b)-24 | (M2)-13 | (R2)-5 |
| (I-b)-25 | (M2)-13 | (R2)-6 |
| (I-b)-26 | (M2)-16 | (R2)-4 |
| (I-b)-27 | (M2)-21 | (R2)-5 |
| (I-b)-28 | (M2)-25 | (R2)-4 |
| (I-b)-29 | (M2)-25 | (R2)-5 |
| (I-b)-30 | (M2)-25 | (R2)-7 |
| (I-b)-31 | (M2)-13 | (R2)-4 |

Next, specific examples of the compound represented by the formula (I), specifically the formula (I-c), are shown below.

Specific Examples of Formula (I) [Formula (I-c)]

| Exemplary compound | Charge transporting skeleton F | Functional group |
|---|---|---|
| (I-c)-1 | (M1)-1 | (R1)-1 |
| (I-c)-2 | (M1)-1 | (R1)-2 |
| (I-c)-3 | (M1)-1 | (R1)-4 |
| (I-c)-4 | (M1)-2 | (R1)-5 |
| (I-c)-5 | (M1)-2 | (R1)-7 |
| (I-c)-6 | (M1)-4 | (R1)-3 |
| (I-c)-7 | (M1)-4 | (R1)-7 |
| (I-c)-8 | (M1)-7 | (R1)-6 |
| (I-c)-9 | (M1)-11 | (R1)-4 |
| (I-c)-10 | (M1)-15 | (R1)-5 |
| (I-c)-11 | (M1)-25 | (R1)-1 |
| (I-c)-12 | (M1)-22 | (R1)-1 |
| (I-c)-13 | (M2)-2 | (R1)-1 |
| (I-c)-14 | (M2)-2 | (R1)-3 |
| (I-c)-15 | (M2)-2 | (R1)-7 |
| (I-c)-16 | (M2)-3 | (R1)-4 |
| (I-c)-17 | (M2)-3 | (R1)-7 |
| (I-c)-18 | (M2)-5 | (R1)-6 |
| (I-c)-19 | (M2)-10 | (R1)-4 |
| (I-c)-20 | (M2)-10 | (R1)-5 |
| (I-c)-21 | (M2)-13 | (R1)-1 |
| (I-c)-22 | (M2)-13 | (R1)-3 |
| (I-c)-23 | (M2)-13 | (R1)-7 |
| (I-c)-24 | (M2)-16 | (R1)-5 |
| (I-c)-25 | (M2)-23 | (R1)-7 |
| (I-c)-26 | (M2)-23 | (R1)-4 |
| (I-c)-27 | (M2)-25 | (R1)-7 |
| (I-c)-28 | (M2)-25 | (R1)-4 |
| (I-c)-29 | (M2)-26 | (R1)-5 |
| (I-c)-30 | (M2)-26 | (R1)-7 |

Specific Examples of Formula (I) [Formula (I-c)]

| Exemplary compound | Charge transporting skeleton F | Functional group |
|---|---|---|
| (I-c)-31 | (M3)-1 | (R1)-2 |
| (I-c)-32 | (M3)-1 | (R1)-7 |
| (I-c)-33 | (M3)-5 | (R1)-2 |
| (I-c)-34 | (M3)-7 | (R1)-4 |
| (I-c)-35 | (M3)-7 | (R1)-2 |
| (I-c)-36 | (M3)-19 | (R1)-4 |
| (I-c)-37 | (M3)-26 | (R1)-1 |
| (I-c)-38 | (M3)-26 | (R1)-3 |
| (I-c)-39 | (M4)-3 | (R1)-3 |
| (I-c)-40 | (M4)-3 | (R1)-4 |
| (I-c)-41 | (M4)-8 | (R1)-5 |
| (I-c)-42 | (M4)-8 | (R1)-6 |
| (I-c)-43 | (M4)-12 | (R1)-7 |
| (I-c)-44 | (M4)-12 | (R1)-4 |
| (I-c)-45 | (M4)-12 | (R1)-2 |
| (I-c)-46 | (M4)-12 | (R1)-11 |
| (I-c)-47 | (M4)-16 | (R1)-3 |
| (I-c)-48 | (M4)-16 | (R1)-4 |
| (I-c)-49 | (M4)-20 | (R1)-1 |
| (I-c)-50 | (M4)-20 | (R1)-4 |
| (I-c)-51 | (M4)-20 | (R1)-7 |
| (I-c)-52 | (M4)-24 | (R1)-4 |
| (I-c)-53 | (M4)-24 | (R1)-7 |
| (I-c)-54 | (M4)-24 | (R1)-3 |
| (I-c)-55 | (M4)-24 | (R1)-4 |
| (I-c)-56 | (M4)-25 | (R1)-1 |
| (I-c)-57 | (M4)-26 | (R1)-3 |
| (I-c)-58 | (M4)-28 | (R1)-4 |
| (I-c)-59 | (M4)-28 | (R1)-5 |
| (I-c)-60 | (M4)-28 | (R1)-6 |

Specific Examples of Formula (I) [Formula (I-c)]

| Exemplary compound | Charge transporting skeleton F | Functional group |
|---|---|---|
| (I-c)-61 | (M1)-1 | (R1)-15 |
| (I-c)-62 | (M1)-1 | (R1)-27 |
| (I-c)-63 | (M1)-1 | (R1)-37 |
| (I-c)-64 | (M1)-2 | (R1)-52 |
| (I-c)-65 | (M1)-2 | (R1)-18 |
| (I-c)-66 | (M1)-4 | (R1)-31 |
| (I-c)-67 | (M1)-4 | (R1)-44 |
| (I-c)-68 | (M1)-7 | (R1)-45 |
| (I-c)-69 | (M1)-11 | (R1)-45 |
| (I-c)-70 | (M1)-15 | (R1)-45 |
| (I-c)-71 | (M1)-25 | (R1)-15 |
| (I-c)-72 | (M1)-22 | (R1)-15 |
| (I-c)-73 | (M2)-2 | (R1)-15 |
| (I-c)-74 | (M2)-2 | (R1)-27 |
| (I-c)-75 | (M2)-2 | (R1)-37 |
| (I-c)-76 | (M2)-3 | (R1)-52 |
| (I-c)-77 | (M2)-3 | (R1)-18 |
| (I-c)-78 | (M2)-5 | (R1)-31 |
| (I-c)-79 | (M2)-10 | (R1)-44 |
| (I-c)-80 | (M2)-10 | (R1)-45 |
| (I-c)-81 | (M2)-13 | (R1)-45 |
| (I-c)-82 | (M2)-13 | (R1)-45 |
| (I-c)-83 | (M2)-13 | (R1)-15 |
| (I-c)-84 | (M2)-16 | (R1)-15 |
| (I-c)-85 | (M2)-23 | (R1)-27 |
| (I-c)-86 | (M2)-23 | (R1)-37 |
| (I-c)-87 | (M2)-25 | (R1)-52 |
| (I-c)-88 | (M2)-25 | (R1)-18 |
| (I-c)-89 | (M2)-26 | (R1)-31 |
| (I-c)-90 | (M2)-26 | (R1)-44 |

Specific Examples of Formula (I) [Formula (I-c)]

| Exemplary compound | Charge transporting skeleton F | Functional group |
|---|---|---|
| (I-c)-91 | (M3)-1 | (R1)-15 |
| (I-c)-92 | (M3)-1 | (R1)-27 |
| (I-c)-93 | (M3)-5 | (R1)-37 |
| (I-c)-94 | (M3)-7 | (R1)-52 |

-continued

| Exemplary compound | Charge transporting skeleton F | Functional group |
|---|---|---|
| (I-c)-95 | (M3)-7 | (R1)-18 |
| (I-c)-96 | (M3)-19 | (R1)-31 |
| (I-c)-97 | (M3)-26 | (R1)-44 |
| (I-c)-98 | (M3)-26 | (R1)-45 |
| (I-c)-99 | (M4)-3 | (R1)-45 |
| (I-c)-100 | (M4)-3 | (R1)-45 |
| (I-c)-101 | (M4)-8 | (R1)-15 |
| (I-c)-102 | (M4)-8 | (R1)-15 |
| (I-c)-103 | (M4)-12 | (R1)-15 |
| (I-c)-104 | (M4)-12 | (R1)-27 |
| (I-c)-105 | (M4)-12 | (R1)-37 |
| (I-c)-106 | (M4)-12 | (R1)-52 |
| (I-c)-107 | (M4)-16 | (R1)-18 |
| (I-c)-108 | (M4)-16 | (R1)-31 |
| (I-c)-109 | (M4)-20 | (R1)-44 |
| (I-c)-110 | (M4)-20 | (R1)-45 |
| (I-c)-111 | (M4)-20 | (R1)-45 |
| (I-c)-112 | (M4)-24 | (R1)-45 |
| (I-c)-113 | (M4)-24 | (R1)-15 |
| (I-c)-114 | (M4)-24 | (R1)-15 |
| (I-c)-115 | (M4)-24 | (R1)-27 |
| (I-c)-116 | (M4)-25 | (R1)-37 |
| (I-c)-117 | (M4)-26 | (R1)-52 |
| (I-c)-118 | (M4)-28 | (R1)-18 |
| (I-c)-119 | (M4)-28 | (R1)-31 |
| (I-c)-120 | (M4)-28 | (R1)-44 |

Next, specific examples of the compound represented by the formula (I), specifically the formula (I-d), are shown below.

Specific Examples of Formula (I) [Formula (I-d)]

| Exemplary compound | Charge transporting skeleton F | Functional group |
|---|---|---|
| (I-d)-1 | (M3)-1 | (R2)-2 |
| (I-d)-2 | (M3)-1 | (R2)-7 |
| (I-d)-3 | (M3)-2 | (R2)-2 |
| (I-d)-4 | (M3)-2 | (R2)-4 |
| (I-d)-5 | (M3)-3 | (R2)-2 |
| (I-d)-6 | (M3)-3 | (R2)-4 |
| (I-d)-7 | (M3)-12 | (R2)-1 |
| (I-d)-8 | (M3)-21 | (R2)-3 |
| (I-d)-9 | (M3)-25 | (R2)-3 |
| (I-d)-10 | (M3)-25 | (R2)-4 |
| (I-d)-11 | (M3)-25 | (R2)-5 |
| (I-d)-12 | (M3)-25 | (R2)-6 |
| (I-d)-13 | (M4)-1 | (R2)-7 |
| (I-d)-14 | (M4)-3 | (R2)-4 |
| (I-d)-15 | (M4)-3 | (R2)-2 |
| (I-d)-16 | (M4)-8 | (R2)-1 |
| (I-d)-17 | (M4)-8 | (R2)-3 |
| (I-d)-18 | (M4)-8 | (R2)-4 |
| (I-d)-19 | (M4)-10 | (R2)-1 |
| (I-d)-20 | (M4)-10 | (R2)-4 |
| (I-d)-21 | (M4)-10 | (R2)-7 |
| (I-d)-22 | (M4)-12 | (R2)-4 |
| (I-d)-23 | (M4)-12 | (R2)-1 |
| (I-d)-24 | (M4)-12 | (R2)-3 |
| (I-d)-25 | (M4)-22 | (R2)-4 |
| (I-d)-26 | (M4)-24 | (R2)-1 |
| (I-d)-27 | (M4)-24 | (R2)-3 |
| (I-d)-28 | (M4)-24 | (R2)-4 |
| (I-d)-29 | (M4)-24 | (R2)-5 |
| (I-d)-30 | (M4)-28 | (R2)-6 |

Specific Examples of Formula (I) [Formula (I-d)]

| Exemplary compound | Charge transporting skeleton F | Functional group |
|---|---|---|
| (I-d)-31 | (M3)-1 | (R2)-8 |
| (I-d)-32 | (M3)-1 | (R2)-9 |
| (I-d)-33 | (M3)-2 | (R2)-8 |

-continued

| Exemplary compound | Charge transporting skeleton F | Functional group |
|---|---|---|
| (I-d)-34 | (M3)-2 | (R2)-9 |
| (I-d)-35 | (M3)-3 | (R2)-8 |
| (I-d)-36 | (M3)-3 | (R2)-9 |
| (I-d)-37 | (M3)-12 | (R2)-8 |
| (I-d)-38 | (M3)-12 | (R2)-9 |
| (I-d)-39 | (M4)-12 | (R2)-8 |
| (I-d)-40 | (M4)-12 | (R2)-9 |
| (I-d)-41 | (M4)-12 | (R2)-10 |
| (I-d)-42 | (M4)-24 | (R2)-8 |
| (I-d)-43 | (M4)-24 | (R2)-9 |
| (I-d)-44 | (M4)-24 | (R2)-10 |
| (I-d)-45 | (M4)-28 | (R2)-8 |
| (I-d)-46 | (M4)-28 | (R2)-9 |
| (I-d)-47 | (M4)-28 | (R2)-10 |

Next, specific examples of the compound represented by the formula (II), specifically the formula (II-a), are shown below.

Specific Examples of Formula (II) [Formula (II-a)]

| Exemplary compound | Charge transporting skeleton F | Functional group |
|---|---|---|
| (II)-1 | (M1)-1 | (R3)-1 |
| (II)-2 | (M1)-1 | (R3)-2 |
| (II)-3 | (M1)-1 | (R3)-7 |
| (II)-4 | (M1)-2 | (R3)-1 |
| (II)-5 | (M1)-2 | (R3)-2 |
| (II)-6 | (M1)-2 | (R3)-3 |
| (II)-7 | (M1)-2 | (R3)-5 |
| (II)-8 | (M1)-2 | (R3)-7 |
| (II)-9 | (M1)-2 | (R3)-8 |
| (II)-10 | (M1)-2 | (R3)-10 |
| (II)-11 | (M1)-2 | (R3)-11 |
| (II)-12 | (M1)-4 | (R3)-1 |
| (II)-13 | (M1)-4 | (R3)-2 |
| (II)-14 | (M1)-4 | (R3)-3 |
| (II)-15 | (M1)-4 | (R3)-5 |
| (II)-16 | (M1)-4 | (R3)-7 |
| (II)-17 | (M1)-4 | (R3)-8 |
| (II)-18 | (M1)-8 | (R3)-1 |
| (II)-19 | (M1)-8 | (R3)-2 |
| (II)-20 | (M1)-8 | (R3)-3 |
| (II)-21 | (M1)-8 | (R3)-5 |
| (II)-22 | (M1)-8 | (R3)-7 |
| (II)-23 | (M1)-8 | (R3)-8 |
| (II)-24 | (M1)-11 | (R3)-1 |
| (II)-25 | (M1)-11 | (R3)-3 |
| (II)-26 | (M1)-11 | (R3)-7 |
| (II)-27 | (M1)-11 | (R3)-9 |
| (II)-28 | (M1)-16 | (R3)-4 |
| (II)-29 | (M1)-22 | (R3)-6 |
| (II)-30 | (M1)-22 | (R3)-9 |

Specific Examples of Formula (II) [Formula (II-a)]

| Exemplary compound | Charge transporting skeleton F | Functional group |
|---|---|---|
| (II)-31 | (M2)-2 | (R3)-1 |
| (II)-32 | (M2)-2 | (R3)-3 |
| (II)-33 | (M2)-2 | (R3)-7 |
| (II)-34 | (M2)-2 | (R3)-9 |
| (II)-35 | (M2)-3 | (R3)-1 |
| (II)-36 | (M2)-3 | (R3)-2 |
| (II)-37 | (M2)-3 | (R3)-3 |
| (II)-38 | (M2)-3 | (R3)-7 |
| (II)-39 | (M2)-3 | (R3)-8 |
| (II)-40 | (M2)-5 | (R3)-8 |
| (II)-41 | (M2)-5 | (R3)-10 |
| (II)-42 | (M2)-10 | (R3)-1 |
| (II)-43 | (M2)-10 | (R3)-3 |
| (II)-44 | (M2)-10 | (R3)-7 |
| (II)-45 | (M2)-10 | (R3)-9 |

-continued

| Exemplary compound | Charge transporting skeleton F | Functional group |
|---|---|---|
| (II)-46 | (M2)-13 | (R3)-1 |
| (II)-47 | (M2)-13 | (R3)-2 |
| (II)-48 | (M2)-13 | (R3)-3 |
| (II)-49 | (M2)-13 | (R3)-5 |
| (II)-50 | (M2)-13 | (R3)-7 |
| (II)-51 | (M2)-13 | (R3)-8 |
| (II)-52 | (M2)-16 | (R3)-1 |
| (II)-53 | (M2)-16 | (R3)-7 |
| (II)-54 | (M2)-21 | (R3)-1 |
| (II)-55 | (M2)-21 | (R3)-7 |
| (II)-56 | (M2)-25 | (R3)-1 |
| (II)-57 | (M2)-25 | (R3)-3 |
| (II)-58 | (M2)-25 | (R3)-7 |
| (II)-59 | (M2)-25 | (R3)-8 |
| (II)-60 | (M2)-25 | (R3)-9 |

Specific Examples of Formula (II) [Formula (II-a)]

| Exemplary compound | Charge transporting skeleton F | Functional group |
|---|---|---|
| (II)-61 | (M3)-1 | (R3)-1 |
| (II)-62 | (M3)-1 | (R3)-2 |
| (II)-63 | (M3)-1 | (R3)-7 |
| (II)-64 | (M3)-1 | (R3)-8 |
| (II)-65 | (M3)-3 | (R3)-1 |
| (II)-66 | (M3)-3 | (R3)-7 |
| (II)-67 | (M3)-7 | (R3)-1 |
| (II)-68 | (M3)-7 | (R3)-2 |
| (II)-69 | (M3)-7 | (R3)-7 |
| (II)-70 | (M3)-7 | (R3)-8 |
| (II)-71 | (M3)-18 | (R3)-5 |
| (II)-72 | (M3)-18 | (R3)-12 |
| (II)-73 | (M3)-25 | (R3)-7 |
| (II)-74 | (M3)-25 | (R3)-8 |
| (II)-75 | (M3)-25 | (R3)-5 |
| (II)-76 | (M3)-25 | (R3)-12 |
| (II)-77 | (M4)-2 | (R3)-1 |
| (II)-78 | (M4)-2 | (R3)-7 |
| (II)-79 | (M4)-4 | (R3)-7 |
| (II)-80 | (M4)-4 | (R3)-8 |
| (II)-81 | (M4)-4 | (R3)-5 |
| (II)-82 | (M4)-4 | (R3)-12 |
| (II)-83 | (M4)-7 | (R3)-1 |
| (II)-84 | (M4)-7 | (R3)-2 |
| (II)-85 | (M4)-7 | (R3)-7 |
| (II)-86 | (M4)-7 | (R3)-8 |
| (II)-87 | (M4)-9 | (R3)-7 |
| (II)-88 | (M4)-9 | (R3)-8 |
| (II)-89 | (M4)-9 | (R3)-5 |
| (II)-90 | (M4)-9 | (R3)-12 |

Specific Examples of Formula (II) [Formula (II-a)]

| Exemplary compound | Charge transporting skeleton F | Functional group |
|---|---|---|
| (II)-91 | (M1)-1 | (R3)-13 |
| (II)-92 | (M1)-1 | (R3)-15 |
| (II)-93 | (M1)-1 | (R3)-47 |
| (II)-94 | (M1)-2 | (R3)-13. |
| (II)-95 | (M1)-2 | (R3)-15 |
| (II)-96 | (M1)-2 | (R3)-19 |
| (II)-97 | (M1)-2 | (R3)-21 |
| (II)-98 | (M1)-2 | (R3)-28 |
| (II)-99 | (M1)-2 | (R3)-31 |
| (II)-100 | (M1)-2 | (R3)-33 |
| (II)-101 | (M1)-2 | (R3)-37 |
| (II)-102 | (M1)-2 | (R3)-38 |

-continued

| Exemplary compound | Charge transporting skeleton F | Functional group |
|---|---|---|
| (II)-103 | (M1)-2 | (R3)-43 |
| (II)-104 | (M1)-4 | (R3)-13 |
| (II)-105 | (M1)-4 | (R3)-15 |
| (II)-106 | (M1)-4 | (R3)-43 |
| (II)-107 | (M1)-4 | (R3)-48 |
| (II)-108 | (M1)-8 | (R3)-13 |
| (II)-109 | (M1)-8 | (R3)-15 |
| (II)-110 | (M1)-8 | (R3)-19 |
| (II)-111 | (M1)-8 | (R3)-28 |
| (II)-112 | (M1)-8 | (R3)-31 |
| (II)-113 | (M1)-8 | (R3)-33 |
| (II)-114 | (M1)-11 | (R3)-33 |
| (II)-115 | (M1)-11 | (R3)-33 |
| (II)-116 | (M1)-11 | (R3)-33 |
| (II)-117 | (M1)-11 | (R3)-33 |
| (II)-118 | (M1)-16 | (R3)-13 |
| (II)-119 | (M1)-22 | (R3)-15 |
| (II)-120 | (M1)-22 | (R3)-47 |

Specific Examples of Formula (II) [Formula (II-a)]

| Exemplary compound | Charge transporting skeleton F | Functional group |
|---|---|---|
| (II)-121 | (M2)-2 | (R3)-13 |
| (II)-122 | (M2)-2 | (R3)-15 |
| (II)-123 | (M2)-2 | (R3)-14 |
| (II)-124 | (M2)-2 | (R3)-17 |
| (II)-125 | (M2)-3 | (R3)-15 |
| (II)-126 | (M2)-3 | (R3)-19 |
| (II)-127 | (M2)-3 | (R3)-21 |
| (II)-128 | (M2)-3 | (R3)-28 |
| (II)-129 | (M2)-3 | (R3)-31 |
| (II)-130 | (M2)-5 | (R3)-33 |
| (II)-131 | (M2)-5 | (R3)-37 |
| (II)-132 | (M2)-10 | (R3)-38 |
| (II)-133 | (M2)-10 | (R3)-43 |
| (II)-134 | (M2)-10 | (R3)-13 |
| (II)-135 | (M2)-10 | (R3)-15 |
| (II)-136 | (M2)-13 | (R3)-16 |
| (II)-137 | (M2)-13 | (R3)-48 |
| (II)-138 | (M2)-13 | (R3)-13 |
| (II)-139 | (M2)-13 | (R3)-26 |
| (II)-140 | (M2)-13 | (R3)-19 |
| (II)-141 | (M2)-13 | (R3)-28 |
| (II)-142 | (M2)-16 | (R3)-31 |
| (II)-143 | (M2)-16 | (R3)-33 |
| (II)-144 | (M2)-21 | (R3)-33 |
| (II)-145 | (M2)-21 | (R3)-34 |
| (II)-146 | (M2)-25 | (R3)-35 |
| (II)-147 | (M2)-25 | (R3)-36 |
| (II)-148 | (M2)-25 | (R3)-37 |
| (II)-149 | (M2)-25 | (R3)-15 |
| (II)-150 | (M2)-25 | (R3)-47 |
| (II)-151 | (M3)-1 | (R3)-13 |
| (II)-152 | (M3)-1 | (R3)-15 |
| (II)-153 | (M3)-1 | (R3)-14 |
| (II)-154 | (M3)-1 | (R3)-17 |
| (II)-155 | (M3)-3 | (R3)-15 |
| (II)-156 | (M3)-3 | (R3)-19 |
| (II)-157 | (M3)-7 | (R3)-21 |
| (II)-158 | (M3)-7 | (R3)-28 |
| (II)-159 | (M3)-7 | (R3)-31 |
| (II)-160 | (M3)-7 | (R3)-33 |

Specific Examples of Formula (II) [Formula (II-a)]

| Exemplary compound | Charge transporting skeleton F | Functional group |
|---|---|---|
| (II)-161 | (M3)-18 | (R3)-37 |
| (II)-162 | (M3)-18 | (R3)-38 |
| (II)-163 | (M3)-25 | (R3)-43 |
| (II)-164 | (M3)-25 | (R3)-13 |

-continued

| Exemplary compound | Charge transporting skeleton F | Functional group |
|---|---|---|
| (II)-165 | (M3)-25 | (R3)-15 |
| (II)-166 | (M3)-25 | (R3)-16 |
| (II)-167 | (M4)-2 | (R3)-48 |
| (II)-168 | (M4)-2 | (R3)-13 |
| (II)-169 | (M4)-4 | (R3)-26 |
| (II)-170 | (M4)-4 | (R3)-19 |
| (II)-171 | (M4)-4 | (R3)-28 |
| (II)-172 | (M4)-4 | (R3)-31 |
| (II)-173 | (M4)-7 | (R3)-32 |
| (II)-174 | (M4)-7 | (R3)-33 |
| (II)-175 | (M4)-7 | (R3)-34 |
| (II)-176 | (M4)-7 | (R3)-35 |
| (II)-177 | (M4)-9 | (R3)-36 |
| (II)-178 | (M3)-9 | (R3)-37 |
| (II)-179 | (M3)-9 | (R3)-15 |
| (II)-180 | (M3)-9 | (R3)-47 |

-continued

| Exemplary compound | Charge transporting skeleton F | Functional group |
|---|---|---|
| (II)-181 | (M2)-27 | (R4)-1 |
| (II)-182 | (M2)-27 | (R4)-4 |

The chain polymerizable group-containing charge transporting material (in particular, the chain polymerizable compound represented by the formula (I)) is synthesized in the following manner, for example.

That is, the chain polymerizable group-containing charge transporting material is synthesized by, for example, etherification of a carboxylic acid as a precursor, or an alcohol with chloromethylstyrene or the like corresponding thereto.

An example of the synthesis route for the exemplary compound (I-d)-22 of the specific chain polymerizable group-containing charge transporting material is shown below.

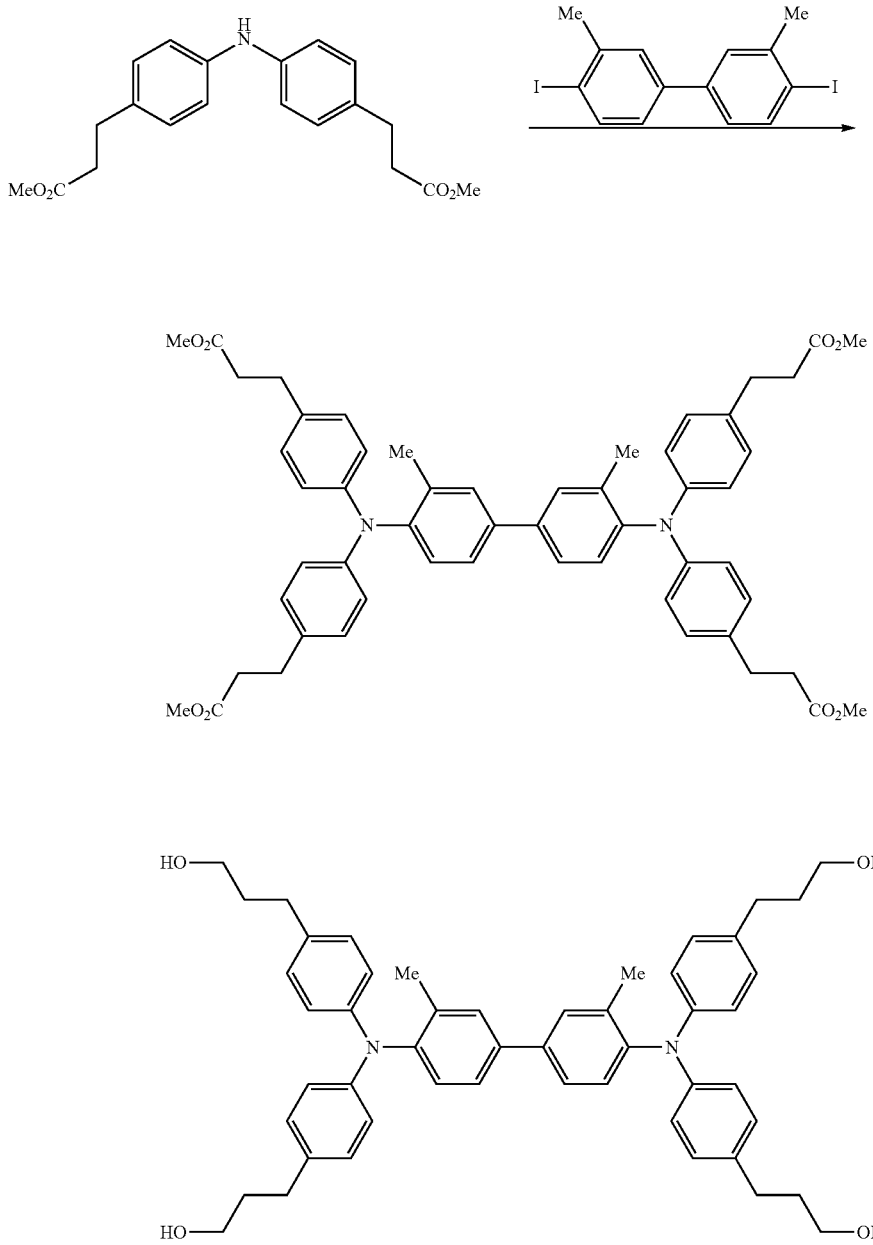

-continued

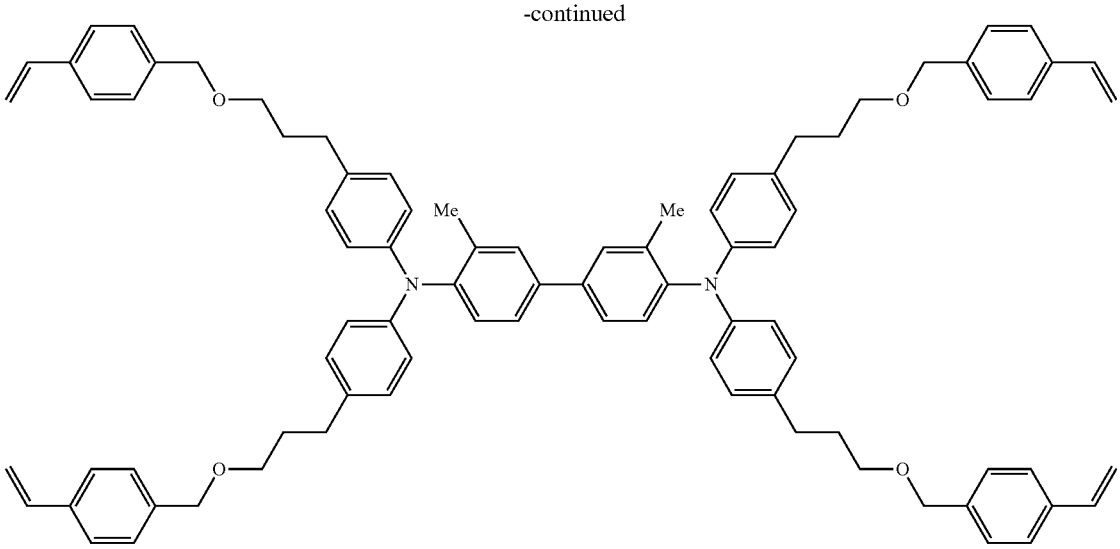

A carboxylic acid of the arylamine compound is obtained by subjecting an ester group of the arylamine compound to hydrolysis using, for example, a basic catalyst (NaOH, $K_2CO_3$, and the like) and an acidic catalyst (for example, phosphoric acid, sulfuric acid, and the like) as described in Experimental Chemistry Lecture, $4^{th}$ Ed., Vol. 20, p. 51, or the like.

Here, examples of the solvent include various types of the solvents, and an alcohol solvent such as methanol, ethanol, and ethylene glycol, or a mixture thereof with water may be preferably used.

Incidentally, in the case where the solubility of the arylamine compound is low, methylene chloride, chloroform, toluene, dimethylsulfoxide, ether, tetrahydrofuran, or the like may be added.

The amount of the solvent is not particularly limited, but it may be, for example, from 1 part by weight to 100 parts by weight, and preferably from 2 parts by weight to 50 parts by weight, based on 1 part by weight of the ester group-containing arylamine compound.

The reaction temperature is set to be, for example, in a range of room temperature (for example, 25° C.) to the boiling point of the solvent, and in terms of the reaction rate, preferably 50° C. or higher.

The amount of the catalyst is not particularly limited, but may be, for example, from 0.001 part by weight to 1 part by weight, and preferably from 0.01 part by weight to 0.5 part by weight, based on 1 part by weight of the ester group-containing arylamine compound.

After the hydrolysis reaction, in the case where the hydrolysis is carried out with a basic catalyst, the produced salt is neutralized with an acid (for example, hydrochloric acid) to be free. Further, after sufficiently washing with water, the product is dried and used, or may be, if necessary, purified by recrystallization with a suitable solvent such as methanol, ethanol, toluene, ethyl acetate, and acetone, and then dried and used.

Furthermore, the alcohol form of the arylamine compound is synthesized by reducing an ester group of the arylamine compound to a corresponding alcohol using aluminum lithium hydride, sodium borohydride, or the like as described in, for example, Experimental Chemistry Lecture, $4^{th}$ Ed., Vol. 20, P. 10, or the like.

For example, in the case of introducing a reactive group with an ester bond, ordinary esterification in which a carboxylic acid of the arylamine compound and hydroxymethylstyrene are dehydrated and condensed using an acid catalyst, or a method in which a carboxylic acid of the arylamine compound and halogenated methylstyrene are condensed using a base such as pyridine, piperidine, triethylamine, dimethylaminopyridine, trimethylamine, DBU, sodium hydride, sodium hydroxide, and potassium hydroxide may be used, but the method using halogenated methylstyrene is suitable since it suppresses by-products.

The halogenated methylstyrene may be added in an amount of 1 equivalent or more, preferably 1.2 equivalents or more, and more preferably 1.5 equivalents or more, based on the acid of the carboxylic acid of the arylamine compound, and the base may be added in an amount of from 0.8 equivalent to 2.0 equivalents, and preferably from 1.0 equivalent to 1.5 equivalents, based on the halogenated methylstyrene.

As the solvent, an aprotic polar solvent such as N-methylpyrrolidone, dimethylsulfoxide, and N,N-dimethylformamide; a ketone solvent such as acetone and methyl ethyl ketone; an ether solvent such as diethyl ether and tetrahydrofuran; an aromatic solvent such as toluene, chlorobenzene, and 1-chloronaphthalene; and the like are effective, and the solvent may be used in an amount in the range of from 1 part by weight to 100 parts by weight, and preferably from 2 parts by weight to 50 parts by weight, based on 1 part by weight of the carboxylic acid of the arylamine compound.

The reaction temperature is not particularly limited. After completion of the reaction, the reaction liquid may be poured into water, extracted with a solvent such as toluene, hexane, and ethyl acetate, washed with water, and if necessary, purified using an adsorbent such as activated carbon, silica gel, porous alumina, and activated white clay.

Furthermore, in the case of introduction with an ether bond, a method in which an alcohol of an arylamine compound and a halogenated methylstyrene are condensed using a base such as pyridine, piperidine, triethylamine, dimethylaminopyridine, trimethylamine, DBU, sodium hydride, sodium hydroxide, and potassium hydroxide may be preferably used.

The halogenated methylstyrene may be added in an amount of 1 equivalent or more, preferably 1.2 equivalents or more, and more preferably 1.5 equivalents or more, based on the alcohol of the arylamine compound, and the base may be used in an amount of from 0.8 equivalent to 2.0 equivalents, and preferably from 1.0 equivalent to 1.5 equivalents, based on the halogenated methylstyrene.

As the solvent, an aprotic polar solvent such as N-methylpyrrolidone, dimethylsulfoxide, and N,N-dimethylformamide; a ketone solvent such as acetone and methyl ethyl ketone; an ether solvent such as diethyl ether and tetrahydrofuran; an aromatic solvent such as toluene, chlorobenzene, and 1-chloronaphthalene; and the like are effective, and the solvent may be used in an amount in the range of from 1 part by weight to 100 parts by weight, and preferably from 2 parts by weight to 50 parts by weight, based on 1 part by weight of the alcohol of the arylamine compound.

The reaction temperature is not particularly limited. After completion of the reaction, the reaction liquid is poured into water, extracted with a solvent such as toluene, hexane, and ethyl acetate, washed with water, and if necessary, purification may be carried out using an adsorbent such as activated carbon, silica gel, porous alumina, and activated white clay.

The specific chain polymerizable group-containing charge transporting material (in particular, the chain polymerizable compound represented by the formula (II)) is synthesized using, for example, the general method for synthesizing an ordinary charge transporting material as shown below (formylation, esterification, etherification, or hydrogenation).

Formylation: a reaction which is suitable for introducing a formyl group into an aromatic compound, a heterocyclic compound, and an alkene, each having an electron donating group. DMF and phosphorous oxytrichloride are generally used and is commonly carried out at a reaction temperature from room temperature (for example, 25° C.) to 100° C.

Esterification: A condensation reaction of an organic acid with a hydroxyl group-containing compound such as an alcohol and a phenol. A method in which a dehydrating agent coexists or water is excluded from the system to move the equilibrium toward the ester side is preferably used.

Etherification: A Williamson synthesis method in which an alkoxide and an organic halogen compound are condensed is general.

Hydrogenation: A method in which hydrogen is reacted with an unsaturated bond using various catalysts.

The content of the specific chain polymerizable group-containing charge transporting material is, for example, from 40% by weight to 95% by weight, and preferably from 50% by weight to 95% by weight, based on the total solid content of the composition for forming a layer.

Fluorine-Containing Resin Particles

The film constituting the protective layer (outermost surface layer) may contain fluorine-containing resin particles.

Examples of the fluorine-containing resin particles include particles of a homopolymer or a copolymer of two or more kinds of a fluorolefin, or a copolymer of one kind or two or more kinds of a fluorolefin with non-fluorinated monomers.

Examples of the fluorolefin include perhalolefins such as tetrafluoroethylene (TFE), perfluorovinyl ether, hexafluoropropylene (HFP), and chlorotrifluoroethylene (CTFE), and non-perfluorolefins such as vinylidene fluoride (VdF), trifluoroethylene, and vinyl fluoride, with VdF, TFE, CTFE, HFP, and the like being preferable.

On the other hand, examples of the non-fluorinated monomer include hydrocarbon olefins such as ethylene, propylene, and butene; alkyl vinyl ethers such as cyclohexyl vinyl ether (CHVE), ethyl vinyl ether (EVE), butyl vinyl ether, and methyl vinyl ether; alkenyl vinyl ethers such as polyoxyethylene allyl ether (POEAE), and ethyl allyl ether; reactive α,β-unsaturated group-containing organosilicon compounds such as vinyltrimethoxysilane (VSi), vinyltriethoxysilane, and vinyltris(methoxyethoxy)silane; acrylic esters such as methyl acrylate and ethyl acrylate; methacrylic esters such as methyl methacrylate and ethyl methacrylate; and vinyl esters such as vinyl acetate, vinyl benzoate, and "BEOBA" (trade name, vinyl ester manufactured by Shell Chemical Co., Ltd.), with alkyl vinyl ether, allyl vinyl ether, vinyl ester, and reactive α,β-unsaturated group-containing organosilicon compounds being preferable.

Among these, those having a high degree of fluorination are preferable, and polytetrafluoroethylene (PTFE), a tetrafluoroethylene-hexafluoropropylene copolymer (FEP), a tetrafluoroethylene-perfluoro(alkyl vinyl ether) copolymer (PFA), an ethylene-tetrafluoroethylene copolymer (ETFE), an ethylene-chlorotrifluoroethylene copolymer (ECTFE), and the like are more preferable. Among these, PTFE, FEP, and PFA are particularly preferable.

As the fluorine-containing resin particles, for example, particles (fluorine resin aqueous dispersion) prepared by a method such as emulsion polymerization of fluorinated monomers may be used as being uncharged or may be used after washing the particles sufficiently with water, and drying.

The average particle diameter of the fluorine-containing resin particles is preferably from 0.01 μm to 100 μm, and particularly preferably from 0.03 μm to 5 μm.

Furthermore, the average particle diameter of the fluorine-containing resin particles refers to a value measured using a laser diffraction-type particle size distribution measurement device LA-700 (manufactured by Horiba, Ltd.).

As the fluorine-containing resin particles, ones that are commercially available may be used, and examples of the PTFE particles include FLUON L173JE (manufactured by Asahi Glass Co., Ltd.), DANIION THV-221 AZ and DANIION 9205 (both manufactured by Sumitomo 3M Limited), and LUBRON L2 and LUBRON L5 (both manufactured by Daikin Industries, Ltd.).

The fluorine-containing resin particles may be those irradiated with laser light having the oscillation wavelength of an ultraviolet ray band. The laser light irradiated to the fluorine-containing resin particles is not particularly limited, and examples thereof include excimer laser. As the excimer laser light, ultraviolet laser light having a wavelength of 400 nm or less, and particularly from 193 nm to 308 nm is suitable. In particular, KrF excimer laser light (wavelength: 248 nm), ArF excimer laser light (wavelength: 193 nm), and the like are preferable. Irradiation of excimer laser light is usually carried out at room temperature (25° C.) in air, but may be carried out under an oxygen atmosphere.

Moreover, the irradiation condition for excimer laser light depends on the type of a fluorine resin and the required degree of surface modification, but general irradiation conditions are as follows.

Fluence: 50 mJ/cm$^2$/pulse or more

Incident energy: 0.1 J/cm$^2$ or more

Number of shots: 100 or less

Particularly suitable irradiation conditions that are commonly used with for KrF excimer laser light and ArF excimer laser light are as follows.

KrF

Fluence: from 100 mJ/cm$^2$/pulse to 500 mJ/cm$^2$/pulse

Incident energy: from 0.2 J/cm$^2$ to 2.0 J/cm$^2$

Number of shots: from 1 to 20

ArF

Fluence: from 50 mJ/cm$^2$/pulse to 150 mJ/cm$^2$/pulse

Incident energy: from 0.1 J/cm$^2$ to 1.0 J/cm$^2$

Number of shots: from 1 to 20

The content of the fluorine-containing resin particles is preferably from 1% by weight to 20% by weight, and more preferably from 1% by weight to 12% by weight, based on the total solid content of the protective layer (outermost surface layer).

Fluorine-Containing Dispersant

The film constituting the protective layer (outermost surface layer) may further contain a fluorine-containing dispersant in combination with the fluorine-containing resin particles.

The fluorine-containing dispersant is used to disperse the fluorine-containing resin particles in a protective layer (outermost surface layer), and thus, preferably has a surfactant action, that is, it is preferably a substance having a hydrophilic group and a hydrophobic group in the molecule.

Examples of the fluorine-containing dispersant include a resin formed by the polymerization of the following reactive monomers (hereinafter referred to as a "specific resin"). Specific examples thereof include a random or block copolymer of an acrylate having a perfluoroalkyl group with monomer having no fluorine, a random or block copolymer of a methacrylate homopolymer and an acrylate having the perfluoroalkyl group with the monomer having no fluorine, and a random or block copolymer of a methacrylate with the monomer having no fluorine. Further, examples of the acrylate having a perfluoroalkyl group include 2,2,2-trifluoroethyl methacrylate and 2,2,3,3,3-pentafluoropropyl methacrylate.

Furthermore, examples of the monomer having no fluorine include isobutyl acrylate, t-butyl acrylate, isoctyl acrylate, lauryl acrylate, stearyl acrylate, isobornyl acrylate, cyclohexyl acrylate, 2-methoxyethyl acrylate, methoxytriethylene glycol acrylate, 2-ethoxyethyl acrylate, tetrahydrofurfuryl acrylate, benzyl acrylate, ethylcarbitol acrylate, phenoxyethyl acrylate, 2-hydroxyacrylate, 2-hydroxypropyl acrylate, 4-hydroxybutyl acrylate, methoxypolyethylene glycol acrylate, methoxypolyethylene glycol methacrylate, phenoxypolyethylene glycol acrylate, phenoxypolyethylene glycol methacrylate, hydroxyethyl-o-phenylphenol acrylate, and o-phenylphenol glycidyl ether acrylate. Further, other examples thereof include the block or branch polymers disclosed in the specifications of U.S. Pat. No. 5,637,142, Japanese Patent Nos. 4251662 and 4251662, and the like. Further, in addition, fluorinated surfactants may also be included. Specific examples of the fluorinated surfactant include SURFLON S-611 and SURFLON S-385 (both manufactured by AGC Seimi Chemical Co., Ltd.), FTERGENT 730FL and FTERGENT 750FL (both manufactured by NEOS Co., Ltd.), PF-636 and PF-6520 (both manufactured by Kitamura Chemicals Co., Ltd.), MEGAFACE EXP, TF-1507, MEGAFACE EXP, and TF-1535 (all manufactured by DIC Corporation), and FC-4430 and FC-4432 (both manufactured by 3M Corporation).

Furthermore, the weight average molecular weight of the specific resin is preferably from 100 to 50000.

The content of the fluorine-containing dispersant is preferably from 0.1% by weight to 1% by weight, and more preferably from 0.2% by weight to 0.5% by weight, based on the total solid content of the protective layer (outermost surface layer).

As a method for attaching the fluorine-containing dispersant to the surface of the fluorine-containing resin particles, the fluorine-containing dispersant may be directly attached on the surface of the fluorine-containing resin particles, or first, the monomers are adsorbed on the surface of the fluorine-containing resin particles, and then polymerized to form the specific resin on the surface of the fluorine-containing resin particles.

The fluorine-containing dispersant may be used in combination with other surfactants. However, the amount of the fluorine-containing dispersant is preferably extremely little, and the amount of the other surfactants is preferably from 0 part by weight to 0.1 part by weight, more preferably from 0 part by weight to 0.05 part by weight, and particularly preferably from 0 part by weight to 0.03 part by weight, based on 1 part by weight of the fluorine-containing resin particles.

As the other surfactant, nonionic surfactants are preferable, and examples thereof include polyoxyethylene alkyl ethers, polyoxyethylene alkylphenyl ethers, polyoxyethylene alkylesters, sorbitan alkylesters, polyoxyethylene sorbitan alkylesters, glycerin esters, fluorinated surfactants, and derivatives thereof.

Specific examples of the polyoxyethylenes include EMULGEN 707 (manufactured by Kao Corporation), NAROACTY CL-70 and NAROACTY CL-85 (both manufactured by Sanyo Chemical Industries, Ltd.), and LEOCOL TD-120 (manufactured by Lion Corporation).

Compound Having Unsaturated Bond

The film constituting the protective layer (outermost surface layer) may use a compound having an unsaturated bond in combination.

The compound having an unsaturated bond may be any one of a monomer, an oligomer, and a polymer, and may further have a charge transporting skeleton.

Examples of the compound having an unsaturated bond, which has no charge transporting skeleton, include the following compounds.

Specifically, as the monofunctional monomers, for example, isobutyl acrylate, t-butyl acrylate, isoctyl acrylate, lauryl acrylate, stearyl acrylate, isobornyl acrylate, cyclohexyl acrylate, 2-methoxyethyl acrylate, methoxytriethylene glycol acrylate, 2-ethoxyethyl acrylate, tetrahydrofurfuryl acrylate, benzyl acrylate, ethylcarbitol acrylate, phenoxyethyl acrylate, 2-hydroxyacrylate, 2-hydroxypropyl acrylate, 4-hydroxybutyl acrylate, methoxypolyethylene glycol acrylate, methoxypolyethylene glycol methacrylate, phenoxypolyethylene glycol acrylate, phenoxypolyethylene glycol methacrylate, hydroxyethyl-o-phenylphenol acrylate, o-phenylphenol glycidyl ether acrylate, and styrene are exemplified.

As the difunctional monomers, diethylene glycol di(meth) acrylate, polyethylene glycol di(meth)acrylate, polypropylene glycol di(meth)acrylate, neopentyl glycol di(meth)acrylate, 1,6-hexanediol di(meth)acrylate, divinylbenzene, and diallyl phthalate are exemplified.

As the trifunctional monomers, trimethylol propane tri (meth)acrylate, pentaerythritol tri(meth)acrylate, aliphatic tri (meth)acrylate, and trivinylcyclohexane are exemplified.

As the tetrafunctional monomers, pentaerythritol tetra (meth)acrylate, ditrimethylol propanetetra(meth)acrylate, aliphatic tetra(meth)acrylate are exemplified.

As the pentafunctional or higher functional monomers, for example, (meth)acrylates having a polyester skeleton, a urethane skeleton, and a phosphagen skeleton, in addition to dipentaerythritol penta(meth)acrylate, dipentaerythritol hexa (meth)acrylate are exemplified.

In addition, examples of the reactive polymer include those disclosed in, for example, JP-A-5-216249, JP-A-5-323630, JP-A-11-52603, JP-A-2000-264961, and JP-A-2005-2291.

In the case where a compound has an unsaturated bond, which has no charge transporting component, it is used singly or in a mixture of two or more kinds thereof.

The content of the compound having an unsaturated bond, which has no charge transporting component, may be 60% by weight or less, preferably 55% by weight or less, and more preferably 50% by weight or less, based on the total solid content of the composition used to form the protective layer (outermost surface layer).

Meanwhile, examples of the compound having an unsaturated bond, which has a charge transporting skeleton, include the following compounds.

Compound Having Chain Polymerizable Functional Group (Chain Polymerizable Functional Group Other Than Styryl Group) and Charge Transporting Skeleton in the Same Molecule The chain polymerizable functional group in the compound having a chain polymerizable functional group and a charge transporting skeleton in the same molecule is not particularly limited as long as it is a functional group that is capable of radical polymerization, and it is, for example, a functional group having at least carbon double bonds. Specific examples thereof include a group containing at least one selected from a vinyl group, a vinyl ether group, a vinyl thioether group, a styryl group, an acryloyl group, a methacryloyl group, and derivatives thereof. Among these, in terms of high reactivity, the chain polymerizable functional group is preferably a group containing at least one selected from a vinyl group, a styryl group, an acryloyl group, a methacryloyl group, and derivatives thereof.

Furthermore, the charge transporting skeleton in the compound having a chain polymerizable functional group and a charge transporting skeleton in the same molecule is not particularly limited as long as it has a known structure in the electrophotographic photoreceptor, and it is, for example, a skeleton derived from a nitrogen-containing hole transporting compound such as a triarylamine compound, a benzidine compound, and a hydrazone compound. Examples thereof include structures having conjugation with nitrogen atoms. Among these, a triarylamine skeleton is preferable.

Non-Reactive Charge Transporting Material

For the film constituting the protective layer (outermost surface layer), a non-reactive charge transporting material may be used in combination. The non-reactive charge transporting material has no reactive group not in charge of charge transportation, and accordingly, in the case where the non-reactive charge transporting material is used in the protective layer (outermost surface layer), the concentration of the charge transporting component increases, which is thus effective for further improvement of electrical characteristics. In addition, the non-reactive charge transporting material may be added to reduce the crosslinking density, and thus adjust the strength.

As the non-reactive charge transporting material, a known charge transporting material may be used, and specifically, a triarylamine compound, a benzidine compound, an arylalkane compound, an aryl-substituted ethylene compound, a stilbene compound, an anthracene compound, a hydrazone compound, or the like is used.

Among these, from the viewpoint of charge mobility, compatibility, or the like, it is preferable to have a triphenylamine skeleton.

The amount of the non-reactive charge transporting material used is preferably from 0% by weight to 30% by weight, more preferably from 1% by weight to 25% by weight, and even more preferably from 5% by weight to 25% by weight, based on the total solid content in a coating liquid for forming a layer.

Other Additives

The film constituting the protective layer (outermost surface layer) may be used in a mixture with other coupling agents, particularly, fluorine-containing coupling agents for the purpose of further adjusting film formability, flexibility, lubricating property, and adhesiveness. As these compounds, various silane coupling agents and commercially available silicone hard coat agents are used. In addition, a radical polymerizable group-containing silicon compound or a fluorine-containing compound may be used.

Examples of the silane coupling agent include vinyltrichlorosilane, vinyltrimethoxysilane, vinyltriethoxysilane, 3-glycidoxypropylmethyldiethoxysilane, 3-glycidoxypropyltriethoxysilane, 3-glycidoxypropyltrimethoxysilane, 3-aminopropyltriethoxysilane, 3-aminopropyltrimethoxysilane, 3-aminopropylmethyldimethoxysilane, N-2(aminoethyl)-3-aminopropyltriethoxysilane, tetramethoxysilane, methyltrimethoxysilane, and dimethyldimethoxysilane.

Examples of the commercially available hard coat agent include KP-85, X-40-9740, and X-8239 (all manufactured by Shin-Etsu Chemical Co., Ltd.), and AY42-440, AY42-441, and AY49-208 (all manufactured by Dow Corning Toray Co., Ltd.).

In addition, in order to impart water repellency, a fluorine-containing compound such as (tridecafluoro-1,1,2,2-tetrahydrooctyl)triethoxysilane, (3,3,3-trifluoropropyl)trimethoxysilane, 3-(heptafluoroisopropoxy)propyltriethoxysilane, 1H, 1H,2H,2H-perfluoroalkyltriethoxysilane, 1H,1H,2H, 2H-perfluorodecyltriethoxysilane, and 1H, H,2H,2H-perfluorooctyltriethoxysilane may be added.

The silane coupling agent may be used in a desired amount, but the amount of the fluorine-containing compound is preferably 0.25 time or less by weight, based on the compound containing no fluorine from the viewpoint of the film formability of the crosslinked film. In addition, a reactive fluorine compound disclosed in JP-A-2001-166510 or the like may be mixed.

Examples of the radical polymerizable group-containing silicon compound and fluorine-containing compound include the compounds described in JP-A-2007-11005.

A deterioration inhibitor is preferably added to the film constituting the protective layer (outermost surface layer). Preferable examples of the deterioration inhibitor include hindered phenol deterioration inhibitors and hindered amine deterioration inhibitors, and known antioxidants such as organic sulfur antioxidants, phosphite antioxidants, dithiocarbamate antioxidants, thiourea antioxidants, benzoimidazole antioxidants, and the like may be used.

The amount of the deterioration inhibitor to be added is preferably 20% by weight or less, and more preferably 10% by weight or less.

Examples of the hindered phenol antioxidant include IRGANOX 1076, IRGANOX 1010, IRGANOX 1098, IRGANOX 245, IRGANOX 1330, and IRGANOX 3114 (all manufactured by Ciba Japan), and 3,5-di-t-butyl-4-hydroxybiphenyl.

Examples of the hindered amine antioxidants include SANOL LS2626, SANOL LS765, SANOL LS770, and SANOL LS744 (all manufactured by Sankyo Lifetech Co., Ltd.), TINUVIN 144 and TINUVIN 622LD (both manufactured by Ciba Japan), and MARK LA57, MARK LA67, MARK LA62, MARK LA68, and MARK LA63 (all manufactured by Adeka Corporation); examples of the thioether antioxidants include SUMILIZER TPS and SUMILIZER TP-D (all manufactured by Sumitomo Chemical Co., Ltd.); and examples of the phosphite antioxidants include MARK 2112, MARK PEP-8, MARK PEP-24G, MARK PEP-36, MARK 329K, and MARK HP-10 (all manufactured by Adeka Corporation).

Conductive particles, organic particles, or inorganic particles may be added to the film constituting the protective layer (outermost surface layer).

Examples of the particles include silicon-containing particles. The silicon-containing particles refer to particles which include silicon as a constitutional element, and specific examples thereof include colloidal silica and silicone particles. The colloidal silica used as the silicon-containing particles is selected from silica having an average particle diameter of from 1 nm to 100 nm, and preferably from 10 nm to 30 nm, and is selected from those dispersed in an acidic or alkaline aqueous dispersion or in an organic solvent such as an alcohol, a ketone, and an ester. As the particles, commercially available ones may be used.

The solid content of the colloidal silica in the protective layer is not particularly limited, but it is used in an amount in the range of 0.1% by weight to 50% by weight, and preferably from 0.1% by weight to 30% by weight, based on the total solid content of the protective layer.

The silicone particles used as the silicon-containing particles are selected from silicone resin particles, silicone rubber particles, and treated silica particles whose surfaces have been treated with silicone, and commercially available silicone particles may be used.

These silicone particles are spherical, and the average particle diameter is preferably from 1 nm to 500 nm, and more preferably from 10 nm to 100 nm.

The content of the silicone particles in the surface layer is preferably from 0.1% by weight to 30% by weight, and more preferably from 0.5% by weight to 10% by weight, based on the total amount of the total solid content of the protective layer.

In addition, examples of other particles include semiconductive metal oxides such as ZnO—$Al_2O_3$, $SnO_2$—$Sb_2O_3$, $In_2O_3$—$SnO_2$, $ZnO_2$—$TiO_2$, ZnO—$TiO_2$, MgO—$Al_2O_3$, FeO—$TiO_2$, $TiO_2$, $SnO_2$, $In_2O_3$, ZnO, and MgO. Further, various known dispersant materials may be used to disperse the particles.

Oils such as a silicone oil may be added to the film constituting the protective layer (outermost surface layer).

Examples of the silicone oil include silicone oils such as dimethylpolysiloxane, diphenylpolysiloxane, and phenylmethylsiloxane; reactive silicone oils such as amino-modified polysiloxane, epoxy-modified polysiloxane, carboxylic-modified polysiloxane, carbinol-modified polysiloxane, methacryl-modified polysiloxane, mercapto-modified polysiloxane, and phenol-modified polysiloxane; cyclic dimethylcyclosiloxanes such as hexamethylcyclotrisiloxane, octamethylcyclotetrasiloxane, decamethylcyclopentasiloxane, and dodecamethylcyclohexasiloxane; cyclic methylphenylcyclosiloxanes such as 1,3,5-trimethyl-1,3,5-triphenylcyclotrisiloxane, 1,3,5,7-tetramethyl-1,3,5,7-tetraphenylcyclotetrasiloxane, and 1,3,5,7,9-pentamethyl-1,3,5,7,9-pentaphenylcyclopentasiloxane; cyclic phenylcyclosiloxanes such as hexaphenylcyclotrisiloxane; fluorine-containing cyclosiloxanes such as 3-(3,3,3-trifluoropropyl)methylcyclotrisiloxane; hydrosilyl group-containing cyclosiloxanes such as a methylhydrosiloxane mixture, pentamethylcyclopentasiloxane, and phenylhydrocyclosiloxane; and vinyl group-containing cyclosiloxanes such as pentavinylpentamethylcyclopentasiloxane.

In order to improve the wettablility of the coating film, a silicone-containing oligomer, a fluorine-containing acryl polymer, a silicone-containing polymer, or the like may be added to the film constituting the protective layer (outermost surface layer).

A metal, a metal oxide, carbon black, or the like may be added to the film constituting the protective layer (outermost surface layer). Examples of the metal include aluminum, zinc, copper, chromium, nickel, silver and stainless steel, and resin particles having any of these metals deposited on the surface thereof. Examples of the metal oxide include zinc oxide, titanium oxide, tin oxide, antimony oxide, indium oxide, bismuth oxide, indium oxide on which tin has been doped, tin oxide having antimony or tantalum doped thereon, and zirconium oxide having antimony doped thereon.

These may be used singly or in combination of two or more kinds thereof. When two or more kinds are used in combination, they may be simply mixed or formed into a solid solution or a fused product. The average particle diameter of the conductive particles is 0.3 μm or less, and particularly preferably 0.1 μm or less.

Composition

The composition used to form a protective layer is preferably prepared as a coating liquid for forming a protective layer, including the respective components dissolved or dispersed in the solvent.

Here, as the solvent of the coating liquid for forming a protective layer, from the viewpoint of the solubility of the charge transporting material, the dispersibility of the fluorine-containing resin particles, and the suppression of uneven distribution of the fluorine-containing resin particles on the surface layer side of the outermost surface layer, a ketone solvent or ester solvent having a difference (absolute value) in the SP value (solubility parameter as calculated by a Feders method) from the binder resin of the charge transporting layer (specific polycarbonate copolymer) of from 2.0 to 4.0 (preferably from 2.5 to 3.5) may be used.

Specific examples of the solvent of the coating liquid for forming a protective layer include singular or mixed solvents, for example, ketones such as methylethyl ketone, methylisobutyl ketone, diisopropyl ketone, diisobutyl ketone, ethyl-n-butyl ketone, di-n-propyl ketone, methyl-n-amyl ketone, methyl-n-butyl ketone, diethyl ketone, and methyl-n-propyl ketone; esters such as isopropyl acetate, isobutyl acetate, ethyl acetate, n-propyl acetate, n-butyl acetate, ethyl isovalerate, isoamyl acetate, isopropyl butyrate, isoamyl propionate, butyl butyrate, amyl acetate, butyl propionate, ethyl propionate, methyl acetate, methyl propionate, and allyl acetate. Further, 0% by weight to 50% by weight of an ether solvent (for example, diethyl ether, dioxane, diisopropyl ether, cyclopentyl methyl ether, and tetrahydrofuran), and an alkylene glycol solvent (for example, 1-methoxy-2-propanol, 1-ethoxy-2-propanol, ethylene glycol monoisopropyl ether, and propylene glycol monomethyl ether acetate) may be mixed and used.

Examples of the method of dispersing the fluorine-containing resin particles in the coating liquid for forming a protective layer include dispersing methods using a media dispersing machine such as a ball mill, a vibrating ball mill, an attritor, a sand mill, and a horizontal sand mill; and a medialess dispersing machine such as a stirrer, an ultrasonic dispersing machine, a roll mill, and a high-pressure homogenizer. Further, examples of the dispersing method as a high-pressure homogenizer include dispersing methods using a collision system in which the particles are dispersed by causing the dispersion to collide against liquid or against walls under a high pressure, and a penetration system in which the particles are dispersed by causing the dispersion to penetrate through a fine flow path under a high pressure.

Moreover, the method for preparing the coating liquid for forming a protective layer is not particularly limited, and the coating liquid for forming a protective layer may be prepared by mixing a charge transporting material, fluorine-containing resin particles, a fluorine-containing dispersant, and if necessary, other components such as a solvent, and using the above-described dispersing machine, or may be prepared by separately preparing two liquids of a mixed liquid A including fluorine-containing resin particles, a fluorine-containing dispersant, and a solvent, and a mixed liquid B including at least a charge transporting material and a solvent, and then mixing the mixed liquids A and B. By mixing the fluorine-containing resin particles and a fluorine-containing dispersant in a solvent, the fluorine-containing dispersant is easily attached to the surface of the fluorine-containing resin particles.

In addition, when the above-described components are reacted with each other to obtain a coating liquid for forming a protective layer, the respective components may be simply mixed and dissolved, but alternatively, the components may be preferably warmed under the conditions of a temperature of from room temperature (20° C.) to 100° C., and more preferably from 30° C. to 80° C., and a time of preferably from 10 minutes to 100 hours, and more preferably from 1 hour to 50 hours. Further, it is also preferable to irradiate ultrasonic waves.

Preparation of Protective Layer

The coating liquid for forming a protective layer is coated on a surface to be coated (charge transporting layer), by an ordinary method such as a blade coating method, a wire bar coating method, a spray coating method, a dip coating method, a bead coating method, an air knife coating method, a curtain coating method, and an ink jet coating method.

Thereafter, light, an electron beam, or heat is applied to the obtained film to induce radical polymerization, and thus, polymerize and cure the coating film.

For the curing method, heat, light, radiation, or the like is used. In the case where curing is carried out using heat and light, a polymerization initiator is not necessarily required, but a photocuring catalyst or a thermal polymerization initiator may be used. As the photocuring catalyst and the thermal polymerization initiator, a known photocuring catalyst or thermal polymerization initiator is used. As the radiation, an electron beam is preferable.

Electron Beam Curing

In the case of using electron beam, the accelerating voltage is preferably 300 kV or less, and more preferably 150 kV or less. Further, the radiation dose is preferably in the range of 1 Mrad to 100 Mrad, and more preferably in the range of 3 Mrad to 50 Mrad. If the accelerating voltage is 300 kV or less, the damage of electron beam irradiation to the photoreceptor characteristics is suppressed. Further, if the radiation dose is 1 Mrad or more, the crosslinking is carried out, and thus, the radiation dose of 100 Mrad or less suppresses deterioration of the photoreceptor.

The irradiation is carried out under an inert gas atmosphere such as nitrogen and argon, at an oxygen concentration of 1000 ppm or less, and preferably 500 ppm or less, and further, heating may be carried out during the irradiation or after the irradiation, at a temperature of 50° C. to 150° C.

Photocuring

As a light source, a high pressure mercury lamp, a low pressure mercury lamp, a metal halide lamp, or the like is used, and a suitable wavelength may be selected by using a filter such as a band-pass filter. Although the irradiation time and the light intensity are arbitrarily selected, for example, the illumination (365 nm) is preferably from 300 mW/cm$^2$ to 1000 mW/cm$^2$, and for example, in the case of carrying out irradiation with UV light at 600 mW/cm$^2$, the duration of the irradiation may be from 5 seconds to 360 seconds.

The irradiation is carried out under an inert gas atmosphere of nitrogen and argon, at an oxygen concentration of 1000 ppm or less, and preferably 500 ppm or less, and heating may be carried out at 50° C. or higher and 150° C. or lower during irradiation or after irradiation.

As a photocuring catalyst, an intramolecular cleavage type photocuring catalyst, such as a benzyl ketal photocuring catalyst, an alkylphenone photocuring catalyst, an aminoalkylphenone photocuring catalyst, a phosphine oxide photocuring catalyst, a titanocene photocuring catalyst, and an oxime photocuring catalyst may be exemplified.

More specific example of the benzyl ketal photocuring catalyst include 2,2-dimethoxy-1,2-diphenylethan-1-one.

Moreover, examples of the alkylphenone photocuring catalyst include 1-hydroxy-cyclohexyl-phenyl-ketone, 2-hydroxy-2-methyl-1-phenyl-propan-1-one, 1-[4-(2-hydroxyethoxy)-phenyl]-2-hydroxy-2-methyl-1-propan-1-one, 2-hydroxy-1-{4-[4-(2-hydroxy-2-methylpropionyl)-benzyl]phenyl}-2-methyl-propan-1-one, acetophenone, and 2-phenyl-2-(p-toluenesulfonyloxy)acetophenone.

Examples of the aminoalkylphenone photocuring catalyst include p-dimethylaminoacetophenone, p-dimethylaminopropiophenone, 2-methyl-1-(4-methylthiophenyl)-2-morpholinopropan-1-one, and 2-benzyl-2-dimethylamino-1-(4-morpholinophenyl)-butanone-1,2-(dimethylamino)-2-[(4-methylphenyl)methyl]-1-[4-(4-morpholinyl)phenyl]-1-butanone.

Examples of the phosphine oxide photocuring catalyst include 2,4,6-trimethylbenzoyl-diphenyl phosphinoxide and bis(2,4,6-trimethylbenzoyl)phenyl phosphineoxide.

Examples of the titanocene photocuring catalyst include bis(η5-2,4-cyclopentadien-1-yl)-bis[2,6-difluoro-3-(1H-pyrrol-1-yl)-phenyl]titanium.

Examples of the oxime photocuring catalyst include 1,2-octanedione, 1-[4-(phenylthio)-, 2-(O-benzoyloxime), ethanone, 1-[9-ethyl-6-(2-methylbenzoyl)-9H-carbazol-3-yl]-, 1-(O-acetyloxime).

Examples of the hydrogen abstraction type photocuring catalyst include a benzophenone photocuring catalyst, a thioxanthone photocuring catalyst, a benzyl photocuring catalyst, and a Michler's ketone photocuring catalyst.

More specific examples of the benzophenone photocuring catalyst include 2-benzoyl benzoic acid, 2-chlorobenzophenone, 4,4'-dichlorobenzo-phenone, 4-benzoyl-4'-methyl-diphenyl sulfide, and p,p'-bisdiethylaminobenzophenone.

Examples of the thioxanthone photocuring catalyst include 2,4-diethylthioxanthen-9-one, 2-chlorothioxanthone, and 2-isopropylthioxanthone.

Example of the benzyl photocuring catalyst include benzyl, (±)-camphor-quinone, and p-anisyl.

These photopolymerization initiators may be used singly or in combination of two or more kinds thereof.

Thermal Curing

Examples of the thermal polymerization initiator include thermal radical generators or derivatives thereof, specifically, for example, an azo initiator such as V-30, V-40, V-59, V601, V65, V-70, VF-096, VE-073, Vam-110, and Vam-111 (all manufactured by Wako Pure Chemicals Industries, Ltd.), and OTazo-15, OTazo-30, AIBN, AMBN, ADVN, and ACVA (all manufactured by Otsuka Chemical Co., Ltd.); and Pertetra A, Perhexa HC, Perhexa C, Perhexa V, Perhexa 22, Perhexa MC, Perbutyl H, Percumyl H, Percumyl P, Permenta H, Perocta H, Perbutyl C, Perbutyl D, Perhexyl D, Peroyl IB, Peroyl 355, Peroyl L, Peroyl SA, NYPER BW, NYPER-BMT-K40/M, Peroyl IPP, Peroyl NPP, Peroyl TCP, Peroyl OPP, Peroyl SBP, Percumyl ND, Perocta ND, Perhexyl ND, Perbutyl ND, Perbutyl NHP, Perhexyl PV, Perbutyl PV, Perhexa 250, Perocta O, Perhexyl O, Perbutyl O, Perbutyl L, Perbutyl 355, Perhexyl I, Perbutyl I, Perbutyl E, Perhexa 25Z, Perbutyl A, Perhexyl Z, Perbutyl ZT, and Perbutyl Z (all manufactured by NOF CORPORATION), Kayaketal AM-C55, Trigonox 36-C75, Laurox, Perkadox L-W75, Perkadox CH-50L, Trigonox TMBH, Kaya cumen H, Kaya butyl H-70, Perkadox BC-FF, Kaya hexa AD, Perkadox 14, Kaya butyl C, Kaya butyl D, Kaya hexa YD-E85, Perkadox 12-XL25, Perkadox 12-EB20, Trigonox 22-N70, Trigonox 22-70E, Trigonox D-T50, Trigonox 423-C70, Kaya ester CND-C70, Kaya ester CND-W50, Trigonox 23-C70, Trigonox 23-W50N, Trigonox 257-C70, Kaya ester P-70, Kaya ester TMPO-70, Trigonox 121, Kaya ester 0, Kaya ester HTP-65W, Kaya ester AN, Trigonox 42, Trigonox F-C50, Kaya butyl B, Kaya carbon EH-C70, Kaya carbon EH-W60, Kaya carbon 1-20, Kaya carbon BIC-75, Trigonox 117, and Kayaren 6-70 (all manufactured by Kayaku Akzo), Luperox 610, Luperox 188, Luperox 844, Luperox 259, Luperox 10, Luperox 701, Luperox 11, Luperox 26, Luperox 80, Luperox 7, Luperox 270, Luperox P, Luperox 546, Luperox 554, Luperox 575, Luperox TANPO, Luperox 555, Luperox 570, Luperox TAP, Luperox TBIC, Luperox TBEC, Luperox JW, Luperox TAIC, Luperox TAEC, Luperox DC, Luperox 101, Luperox F, Luperox DI, Luperox 130, Luperox 220, Luperox 230, Luperox 233, and Luperox 531 (all manufactured by ARKEMA Yoshitomi).

Among these, by using an azo polymerization initiator having a molecular weight of 250 or more, a reaction proceeds without unevenness at a low temperature, and thus, it is promoted to form a high-strength film having a suppressed unevenness. More suitably, the molecular weight of the azo polymerization initiator is 250 or more, and still more suitably 300 or more.

Heating is carried out in an inert gas atmosphere such as nitrogen and argon, at an oxygen concentration of 1000 ppm or less, and preferably 500 ppm or less, and furthermore, at a temperature of preferably 50° C. to 170° C., more preferably 70° C. to 150° C., for a period of preferably 10 minutes to 120 minutes, and more preferably 15 minutes to 100 minutes.

The total content of the photocuring catalyst or the thermal polymerization initiator is preferably in the range of 0.1% by weight to 10% by weight, more preferably 0.1% by weight to 8% by weight, and particularly preferably 0.1% by weight to 5% by weight, based on the total solid content of the dissolution liquid for forming a layer.

In addition, in the present exemplary embodiment, since it is difficult to attain structural relaxation of the coating film using crosslinking when the reaction proceeds too quickly, and thus, unevenness of the film and wrinkles easily occur. As a result, a curing method by heat, in which generation of radicals occurs relatively slowly is adopted.

In particular, by combining specific chain polymerizable group-containing charge transporting material with curing by heat, the structural relaxation of the coating film is further promoted, and a protective layer (outermost surface layer) having excellent surface properties and states is easily obtained.

The film thickness of the protective layer is set within a range of preferably from 3 μm to 40 μm, and more preferably from 5 μm to 35 μm.

Image Forming Apparatus (and Process Cartridge)

Hereinafter, the image forming apparatus (and a process cartridge) according to the present exemplary embodiment will be described in detail.

Figure 2:
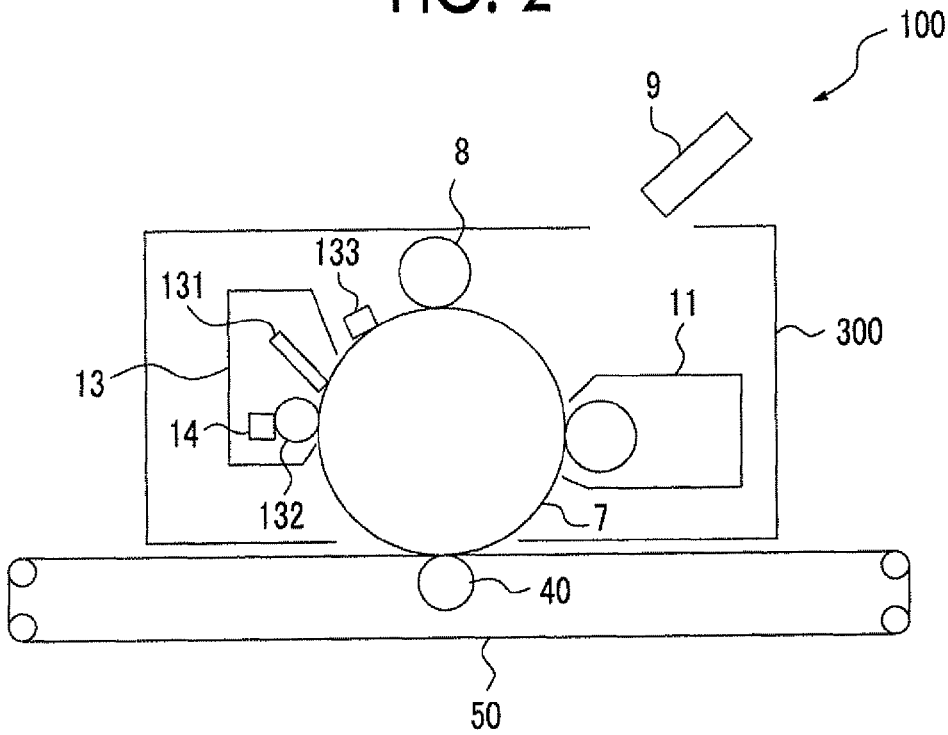
FIG. 2 is a schematic configuration view showing an example of the image forming apparatus according to the present exemplary embodiment.

FIG. 2 is a schematic structural view showing an example of the image forming apparatus according to the present exemplary embodiment.

The image forming apparatus 100 according to the present exemplary embodiment is provided with a process cartridge 300 having an electrophotographic photoreceptor 7 as shown in FIG. 2, an exposure device 9, a transfer device 40 (primary transfer device), and an intermediate transfer member 50. Further, in the image forming apparatus 100, the exposure device 9 is arranged at a position where the exposure device 9 may radiate light onto the electrophotographic photoreceptor 7 through an opening in the process cartridge 300, and the transfer device 40 is arranged at a position opposite to the electrophotographic photoreceptor 7 by the intermediary of the intermediate transfer member 50. The intermediate transfer member 50 is arranged to contact partially the electrophotographic photoreceptor 7. Further, although not shown in the figure, the apparatus also includes a secondary transfer device that transfers a toner image transferred onto the intermediate transfer member 50 to a transfer member.

The process cartridge 300 in FIG. 2 supports, in house, the electrophotographic photoreceptor 7, an charging device 8, a developing device 11, and a cleaning device 13 as a unit. The cleaning device 13 has a cleaning blade (cleaning member), and the cleaning blade 131 is arranged so as to be in contact with the surface of the electrophotographic photoreceptor 7.

Furthermore, an example in which a fibrous member 132 (in a roll form) that supplies a lubricant material 14 onto the surface of the photoreceptor 7, and a fibrous member 133 (in a flat brush form) that assists cleaning are used is shown; however these members may or may not be used.

Hereinafter, the respective configurations of the image forming apparatus according to the present exemplary embodiment will be described.

Charging Device

As the charging device 8, for example, a contact type charging device using a conductive or semiconductive charging roll, a charging brush, a charging film, a charging rubber blade, a charging tube, or the like is used. Further, known charging devices themselves, such as a non-contact type roller charging device, and a scorotron charging device and a corotron charging device, each using corona discharge are also used.

Further, a photoreceptor heating member, although not shown in the figure, may be further arranged around the electrophotographic photoreceptor 7 to raise the temperature of the electrophotographic photoreceptor 7, thus to decrease the relative temperature.

Exposure Device

The exposure device 9 may be an optical instrument for exposure of the surface of the photoreceptor 7, to rays such as a semiconductor laser ray, an LED ray, and a liquid crystal shutter ray in a predetermined image-wise manner. The wavelength(s) of the light source may be a wavelength or wavelengths in the range of the spectral sensitivity wavelengths of the photoreceptor. As the wavelengths of semiconductor lasers, near infrared wavelengths that are laser-emission wavelengths near 780 nm are predominant. However, the wavelength of the laser ray to be used is not limited to such a wavelength, and a laser having an emission wavelength of 600 nm range, or a laser having any emission wavelength in the range of 400 nm to 450 nm may be used as a blue laser. In order to form a color image, it is effective to use a plane-emissive type laser light source capable of attaining a multi-beam output.

Developing Device

As the developing device 11, for example, a common developing device, in which a magnetic or non-magnetic single-component or two-component developer is contacted or not contacted for forming an image, may be used. Such a developing device is not particularly limited as long as it has the above-described functions, and may be appropriately selected according to the intended use. Examples thereof include a known developing device in which the single-component or two-component developer is applied to the photoreceptor 7 using a brush or a roller. Among these, the developing device using developing roller retaining developer on the surface thereof is preferable.

Hereinafter, a developer toner used in the developing device 11 will be described. The developer may be a single-component developer formed of a toner alone or a two-component developer formed of a toner and a carrier. As the developer, known ones may be used.

Cleaning Device

As the cleaning device 13, a cleaning blade type device provided with the cleaning blade 131 is used.

Further, in addition to the cleaning blade type, a fur brush cleaning type and a type of performing developing and cleaning at once may also be used.

Transfer Device

Examples of transfer device 40 include known transfer charging devices themselves, such as a contact type transfer charging device using a belt, a roller, a film, a rubber blade, or the like, a scorotron transfer charging device, and a corotron transfer charging device utilizing corona discharge.

Intermediate Transfer Member

As the intermediate transfer member 50, a form of a belt which is imparted with the semiconductivity (intermediate transfer belt) of polyimide, polyamideimide, polycarbonate, polyarylate, polyester, rubber, or the like is used. In addition, the intermediate transfer member may also take the form of a drum, in addition to the form of a belt.

In addition to the above-described devices, the image forming apparatus 100 may further be provided with, for example, a known device.

Figure 3:
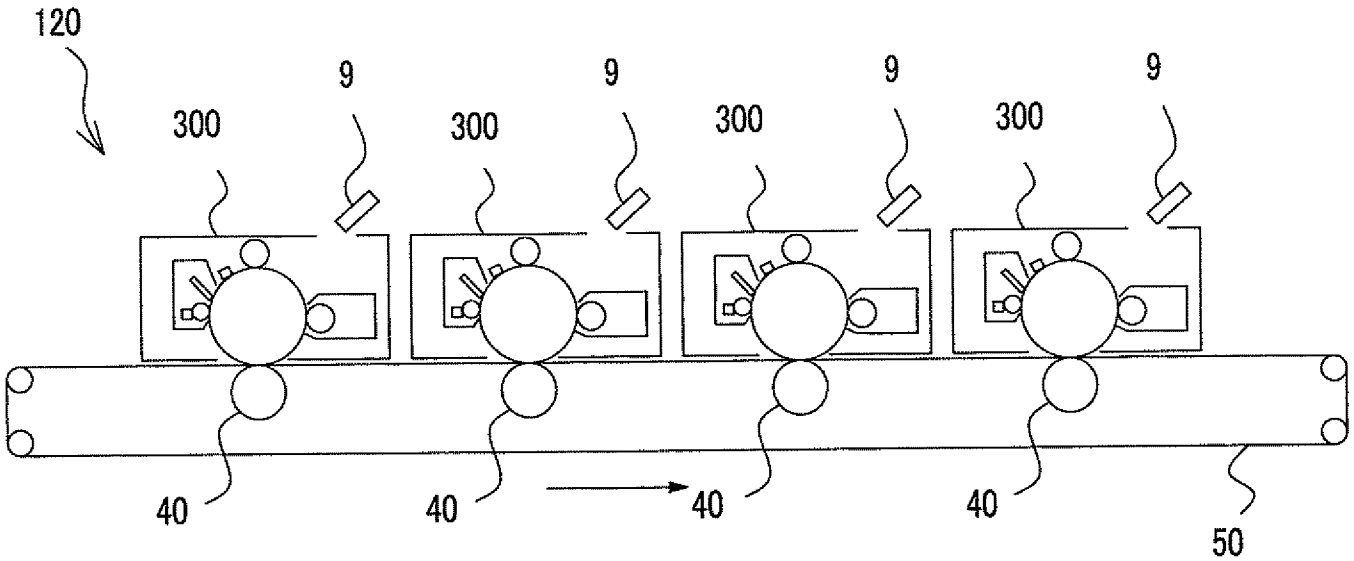
FIG. 3 is a schematic configuration view showing another example of the image forming apparatus according to the present exemplary embodiment.

FIG. 3 is a schematic structural view showing another example of the image forming apparatus of the present exemplary embodiment.

The image forming apparatus 120 shown in FIG. 3 is a tandem type full color image forming apparatus equipped with four process cartridges 300. In the image forming apparatus 120, four process cartridges 300 are disposed parallel with each other on the intermediate transfer member 50, and one electrophotographic photoreceptor may be used for one color. Further, the image forming apparatus 120 has the same configuration as the image forming apparatus 100, except that it is a tandem type.

Further, the process cartridge according to the present exemplary embodiment may be a process cartridge which is provided with an electrophotographic photoreceptor and is detachable from the image forming apparatus.

In the image forming apparatus (process cartridge) according to the exemplary embodiment, an image forming apparatus using a dry developer is described. However, the image forming apparatus (process cartridge) may use a liquid developer. Particularly, in the image forming apparatus (process cartridge) using a liquid developer, due to the liquid components in the liquid developer, the outermost surface layer of the electrophotographic photoreceptor is, for example, swollen, whereby the uppermost surface layer is easily cracked or receives cleaning damage by cleaning. However, such problems are improved by using the electrophotographic photoreceptor according to the exemplary embodiment, and consequently, an image which is stable for a long time is obtained.

Figure 4:
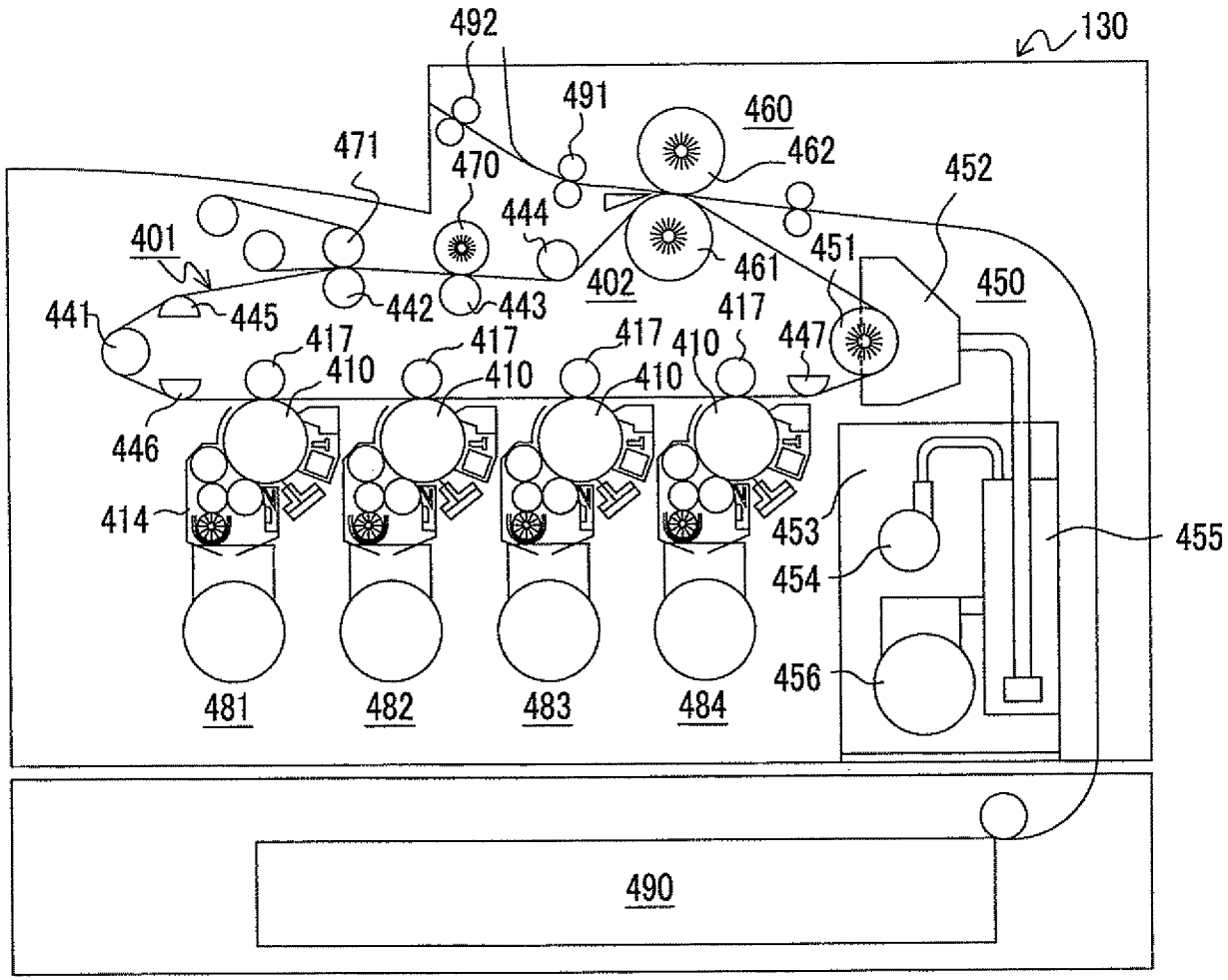
FIG. 4 is a schematic configuration view showing a still another example of the image forming apparatus according to the present exemplary embodiment.
Figure 5:
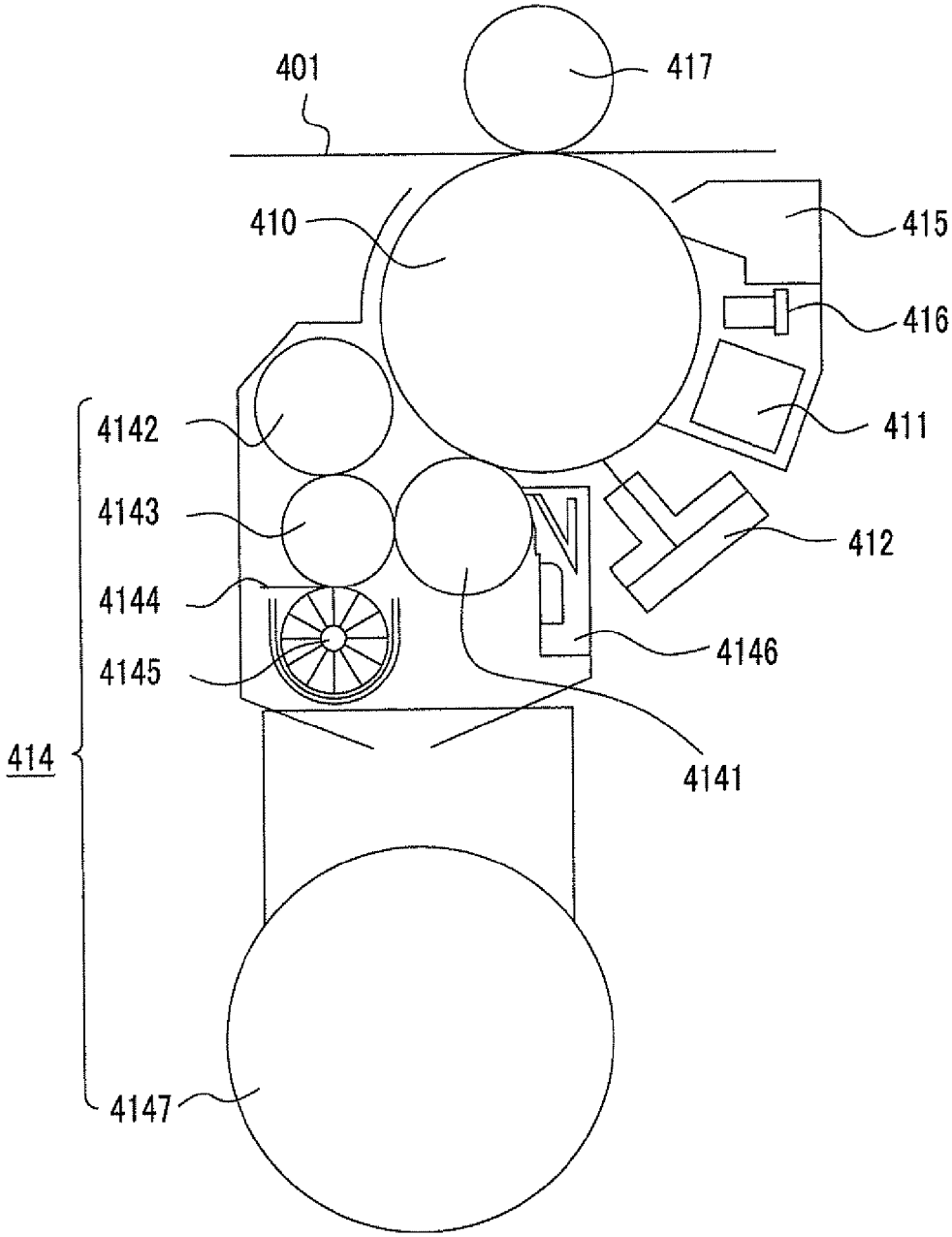
FIG. 5 is a schematic configuration view showing the developing device in the image forming apparatus shown in FIG. 4.

FIG. 4 is a schematic configuration view showing a still another example of the image forming apparatus according to the present exemplary embodiment, and FIG. 5 is a schematic configuration view showing an image forming unit in the image forming apparatus shown in FIG. 4.

An image forming apparatus 130 shown in FIG. 4 is mainly configured with a belt-shaped intermediate transfer member 401, image forming units 481, 482, 483, and 484 for each color, a heating unit 450 (an example of a layer forming unit), and a transfer and fixing unit 460.

As shown in FIG. 5, the image forming unit 481 is configured with an electrophotographic photoreceptor 410, a charging device 411 that charges the electrophotographic photoreceptor 410, an LED array head 412 (an example of an electrostatic latent image forming unit) that performs image exposure for forming an electrostatic latent image on the surface of the charged electrophotographic photoreceptor 410 according to image information, a developing device 414 that develops the electrostatic latent image formed on the electrophotographic photoreceptor 410 by using a liquid developer, a cleaner 415 that cleans the photoreceptor surface, a charge eraser 416, and a transfer roll 417 (an example of a primary transfer unit) that faces the electrophotographic photoreceptor 410 across the belt-shaped intermediate transfer member 401 and is applied with transfer bias for transferring the developed image which has been formed on the electrophotographic photoreceptor 410 and developed by the liquid developer to the belt-shaped intermediate transfer member 401.

As shown in FIG. 5, in the developing device 414, a developing roll 4141, a liquid draining roll 4142, a developer cleaning roll 4143, a developer cleaning blade 4144, a developer cleaning brush 4145, a circulating pump (not shown), a liquid developer supplying path 4146, and a developer cartridge 4147 are provided.

As the liquid developer used herein, a liquid developer in which particles having a heat melting and fixing type of resin such as polyester or polystyrene as a main component are dispersed, or a liquid developer to be a layer (which will be referred to as "to form a film", hereinafter) by removing a surplus dispersion medium (carrier liquid) and increasing the proportion of the solid contents in the liquid developer is used. Specific materials to form a film are described in detail in U.S. Pat. No. 5,650,253 (Column 10, Line 8 to Column 13, Line 14) and U.S. Pat. No. 5,698,616.

The developer to form a film refers to a liquid developer in which micro-substances (such as a micro-toner) having a glass transition point (temperature) lower than room temperature (for example, 25° C.) are dispersed in a carrier liquid. Generally, the substances do not contact each other and do not aggregate. However, when the carrier liquid is removed, only the substances remain, and if the substances are attached as a film shape, they bind to each other at room temperature (for example, 25° C.), thereby forming a film. The substance is obtained by mixing ethyl alcohol with methyl methacrylate, and the glass transition temperature is set by the blending ratio thereof.

Moreover, other image forming units 482, 483, and 484 also have the same configuration. In the developing units of the respective image forming units, different colors (yellow, magenta, cyan, and black) of liquid developers are contained.

In addition, in the respective image forming units 481, 482, 483, and 484, the electrophotographic photoreceptor, the developing device, and the like are formed into a cartridge.

In the above configuration, examples of the material of the belt-shaped intermediate transfer member 401 include a PET film (polyethylene terephthalate film) coated with silicon rubber or a fluororesin, a polyimide film, and the like.

The electrophotographic photoreceptor 410 contacts the belt-shaped intermediate transfer member 401 through the upper surface thereof, and moves at the same speed as the belt-shaped intermediate transfer member 401.

As the charging device 411, for example, a corona charging device is used. The electrophotographic photoreceptors 410 in the image forming unit 481, 482, 483, and 484 have the same circumferential length. In addition, the interval between the respective transfer rolls 417 arranged is configured so as to be the same as the circumferential length of the electrophotographic photoreceptor 410 or to be an integer multiple of the circumferential length.

The heating unit 450 is configured with a heating roll 451 that is disposed so as to rotate while contacting the inner surface of the belt-shaped intermediate transfer member 401, a storage chamber 452 that is disposed so as to face the heating roll 451 and surround the outer surface of the belt-shaped intermediate transfer member 401, and a carrier liquid collecting unit 453 that collects vapor of the carrier liquid and the carrier liquid from the storage chamber 452. On the carrier liquid collecting unit 453, a suction blade 454 that sucks the vapor of the carrier liquid in the storage chamber 452, a condensing unit 455 that liquefies the vapor of the carrier liquid, and a collecting cartridge 456 that collects the carrier liquid from the condensing unit 455 are mounted.

The transferring and fixing unit 460 (an example of a secondary transfer unit) is configured with a transfer supporting roll 461 that rotatably supports the belt-shaped intermediate transfer member 401, and a transferring and fixing roll 462 that rotates while pushing a recording medium passing through the transferring and fixing unit 460 to the belt-shaped intermediate transfer member 401 side, and also includes a heating element in the inside thereof.

In addition, a cleaning roll 470 and a cleaning web 471 that clean the top of the belt-shaped intermediate transfer member 401 before a color image is formed on the belt-shaped intermediate transfer member 401, supporting rolls 441 to 444 that support the rotation driving of the belt-shaped intermediate transfer member 401, and supporting shoes 445 to 447 are provided.

The belt-shaped intermediate transfer member 401 constitutes an intermediate member unit 402 with transfer rolls 417 of image forming units for each color, the heating roll 451, the transfer supporting roll 461, the supporting rolls 441 to 444, the supporting shoes 445 to 447, the cleaning roll 470, and a cleaning web 471. The belt-shaped intermediate transfer member 401 is configured such that the vicinity of the supporting roll 441 integrally moves up and down based on vicinity of the heating roll 451 as a supporting point.

Hereinafter, the operation of the image forming apparatus using the liquid developer shown in FIG. 4 will be described.

First, in the image forming unit 481, the LED array head 412 performs the image exposure on the electrophotographic photoreceptor 410 of which the surface has been charged by the charging device 411, according to yellow image information, whereby an electrostatic latent image is formed. This electrostatic latent image is developed with a yellow liquid developer by the developing device 414.

Herein, the development is performed through the following steps. The yellow liquid developer passes through the liquid developer supplying path 4146 by the circulation pump from the developer cartridge 4147, and is supplied to the vicinity of a place where the developing roll 4141 and the electrophotographic photoreceptor 410 approach. Due to a development field formed between the electrostatic latent image on the electrophotographic photoreceptor 410 and the developing roll 4141, coloring solid contents with charges in the supplied liquid developer move to the electrostatic latent image side to be an image on the electrophotographic photoreceptor 410.

Subsequently, the liquid draining roll 4142 removes the carrier liquid from the top of the electrophotographic photoreceptor 410 so as to yield a proportion of the carrier liquid required for the next transferring. On the surface of the electrophotographic photoreceptor 410 having passed through the developing device 414 in this manner, a yellow image developed by the yellow liquid developer is formed.

In the developing device 414, the developer cleaning roll 4143 removes the liquid developer remaining on the developing roll 4141 after developing operation and the liquid developer attached to a squeeze roll due to a squeeze operation, and the developer cleaning blade 4144 and the developer cleaning brush 4145 clean the developer cleaning roll 4143. In this manner, developing operation is stably performed all the time. The configuration and operations of the developing device is described in detail in JP-A-11-249444.

Further, for the developing roll 4141, the level of solid contents ratio in the liquid developer is automatically controlled by at least one of the developing device 414 and the developer cartridge 4147 such that a liquid developer containing a constant ratio of a solid contents is supplied.

The developed yellow image formed on the electrophotographic photoreceptor 410 contacts the belt-shaped intermediate transfer member 401 through the upper surface thereof by the rotation of the electrophotographic photoreceptor 410. The image is then transferred to the belt-shaped intermediate transfer member 401 by contact electrostatic transfer, by the transfer roll 417 that is pressed on the electrophotographic photoreceptor 410 while facing the electrophotographic photoreceptor 410 across the belt-shaped intermediate transfer member 401 and is applied with the transfer bias.

From the electrophotographic photoreceptor 410 having completed the contact electrostatic transfer, the liquid developer remaining after the transfer is removed by the cleaner 415, and the electricity of electrophotographic photoreceptor 410 is erased by the charge eraser 416 so that the electrophotographic photoreceptor 410 is used for the next image formation.

The same operation is performed in the image forming units 482, 483, and 484. The circumferential length of the electrophotographic photoreceptors 410 used in the respective image forming units is the same. In addition, the developed images of each color formed on the respective photoreceptors are sequentially and electrostatically transferred onto the belt-shaped intermediate transfer member 401, by the transfer rolls arranged in the interval that is as long as the circumferential length of the photoreceptor or is the integer multiple of the circumferential length. Accordingly, the respective developed images of yellow, magenta, cyan, and black, which are formed on the respective electrophotographic photoreceptors 410 in consideration of the overlapped position on the belt-shaped intermediate transfer member 401, are sequentially transferred onto the belt-shaped intermediate transfer member 401 by contact electrostatic transfer with a high accuracy, while overlapping with each other without misalignment, even if eccentricity occurs in the electrophotographic photoreceptor 410. In this manner, on the belt-shaped intermediate transfer member 401 having passed through the image forming unit 484, an image developed by liquid developer of each color is formed.

In the heating unit 450, the developed image formed on the belt-shaped intermediate transfer member 401 is heated by the heating roller 451 from the back surface of the belt-shaped intermediate transfer member 401. As a result, the carrier liquid as the dispersion medium is almost completely evaporated, and an image of a film is formed. This is because if the liquid developer is a developer in which particles having heat melting and fixing type resin as a main component are dispersed, the dispersed particles become a film by being melted through the removal of the surplus dispersion medium and heating by the heating roll 451. Alternatively, this is because the liquid developer is a developer that becomes a film by increasing the solid contents ratio in the liquid developer through the removal of the surplus dispersion medium (carrier liquid).

In the heating unit 450, the vapor of the carrier liquid in the storage chamber 452, which is generated by being heated and evaporated by the heating roll 451, is introduced to the condensing unit 455 by the suction blade 454 in the carrier liquid collecting unit 453 and liquefied. The re-liquefied carrier liquid is guided to the collecting cartridge 456 and collected.

In a transferring and fixing unit 460, the belt-shaped intermediate transfer member 401 that has passed the heating unit 450 and has a film-like (layer-like) image formed on the top thereof is transferred by heat and pressure to a transfer member (for example, plain paper) that has been transported in time from a paper storage unit 490 in the lower portion of the apparatus, by the transferring and supporting roll 461 and transferring and fixing roll 462. In this manner, an image is formed on the transfer member and discharged outside the apparatus by discharge rolls 491 and 492. In this transferring, the adhesive force of the image of a film that is formed on the belt-shaped intermediate transfer member 401 with respect to the belt-shaped intermediate transfer member 401 is weaker than the adhesive force of the image of a film with respect to the transfer member. Since the image is transferred to the transfer member by such a difference in the adhesive force, an electrostatic force is not imparted during transferring. In addition, the binding force of the image of a film as a film is stronger than the adhesive force with respect to the transfer member.

From the belt-shaped intermediate transfer member 401 having passed through the transferring and fixing unit 460, the solid contents that remain after the transferring and substances that are contained in the solid contents and hinder the function of the belt-shaped intermediate transfer member 401 are collected and removed by the cleaning roll 470 and the cleaning web 471 having a heat source in the inside thereof. Thereafter, the belt-shaped intermediate transfer member 401 is used for the next image formation.

After the image is formed in the above-described manner, in the intermediate member unit 402, the vicinity of the supporting roll 441 moves upward integrally, based on the vicinity of the heating roll 451 as a supporting point. In this manner, the belt-shaped intermediate transfer member 401 is separated from the electrophotographic photoreceptors 410 of the respective image forming units. The transferring and fixing roll 462 is also separated from the belt-shaped intermediate transfer member 401 in the same manner.

When there is a request for image formation again, the intermediate member unit 402 operates such that the belt-shaped intermediate transfer member 401 contacts the electrophotographic photoreceptors 410 of the respective image forming units, and similarly, the transferring and fixing roll 462 also operates to contact the belt-shaped intermediate transfer member 401. The operation of the transferring and fixing roll 462 may be performed with timing in which the image is transferred to the recording medium.

On the other hand, the image forming apparatus using the liquid developer is not limited to the image forming apparatus 130 shown in FIG. 4. For example, the image forming apparatus may be the image forming apparatus shown in FIG. 6.

Figure 6:
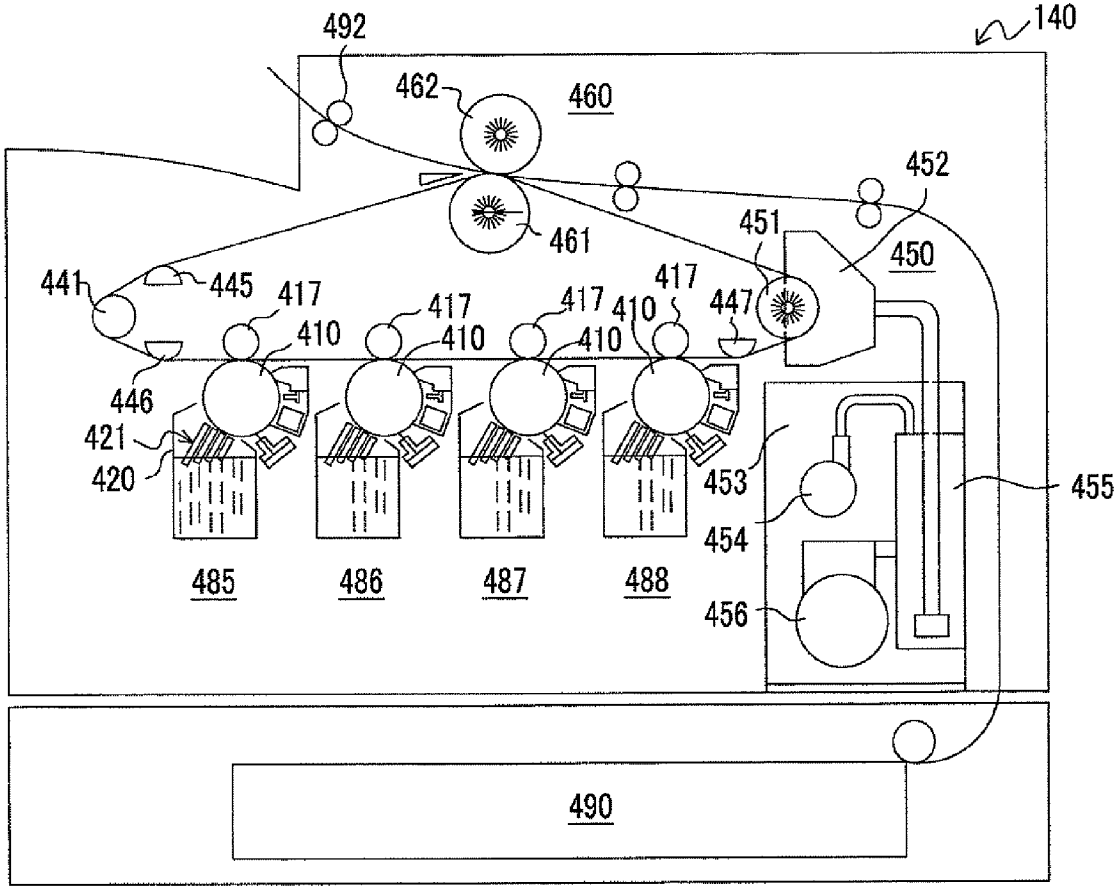
FIG. 6 is a schematic configuration view showing an even still another example of the image forming apparatus according to the present exemplary embodiment.

FIG. 6 is a schematic configuration view showing an image forming apparatus according to another exemplary embodiment.

Similarly to the configuration of the image forming apparatus 130 shown in FIG. 4, an image forming apparatus 140 shown in FIG. 6 is mainly configured with the belt-shaped intermediate transfer member 401, image forming units 485, 486, 487, and 488 for each color, the heating unit 450, and the transferring and fixing unit 460.

The image forming apparatus 140 shown in FIG. 6 is different from the image forming apparatus 130 shown in FIG. 4 in that the belt-shaped intermediate transfer member 401 runs approximately in a triangle shape, and in the configuration of a developing device 420 in image forming units 485, 486, 487, and 488 for each color. The heating unit 450 and the transferring and fixing unit 460 are the same as those in the image forming apparatus 130 shown in FIG. 4. In addition, the cleaning roll 470 and the cleaning web 471 are omitted in the drawing.

While rotating and running of the belt-shaped intermediate transfer member 401, the belt-shaped intermediate transfer member 401 performs a bending operation, but since this bending operation affects the stabilized running and the life of the belt-shaped intermediate transfer member 401, the belt-shaped intermediate transfer member 401 is allowed to run approximately in a triangle shape so as to reduce the bending operation as much as possible.

In the developing device 420, recording heads 421 that selectively discharge and attach the liquid developer to the electrostatic latent image formed on the electrophotographic photoreceptor 410 are arranged in plural columns, instead of the developing roll, the liquid draining roll, and the like.

In each column of the recording heads 421, a large number of recording electrodes 422 are evenly arranged in the longitudinal direction of the electrophotographic photoreceptor 410, and a flying electric field is formed between the potential of the electrostatic latent image formed on the electrophotographic photoreceptor 410 and the flying bias potential applied to the recording electrodes 422. In addition, coloring solid contents with charges in the liquid developer supplied to the recording electrodes 422 move to the electrostatic latent image side to be an image portion on the electrophotographic photoreceptor 410 and develop the image.

Figure 7:
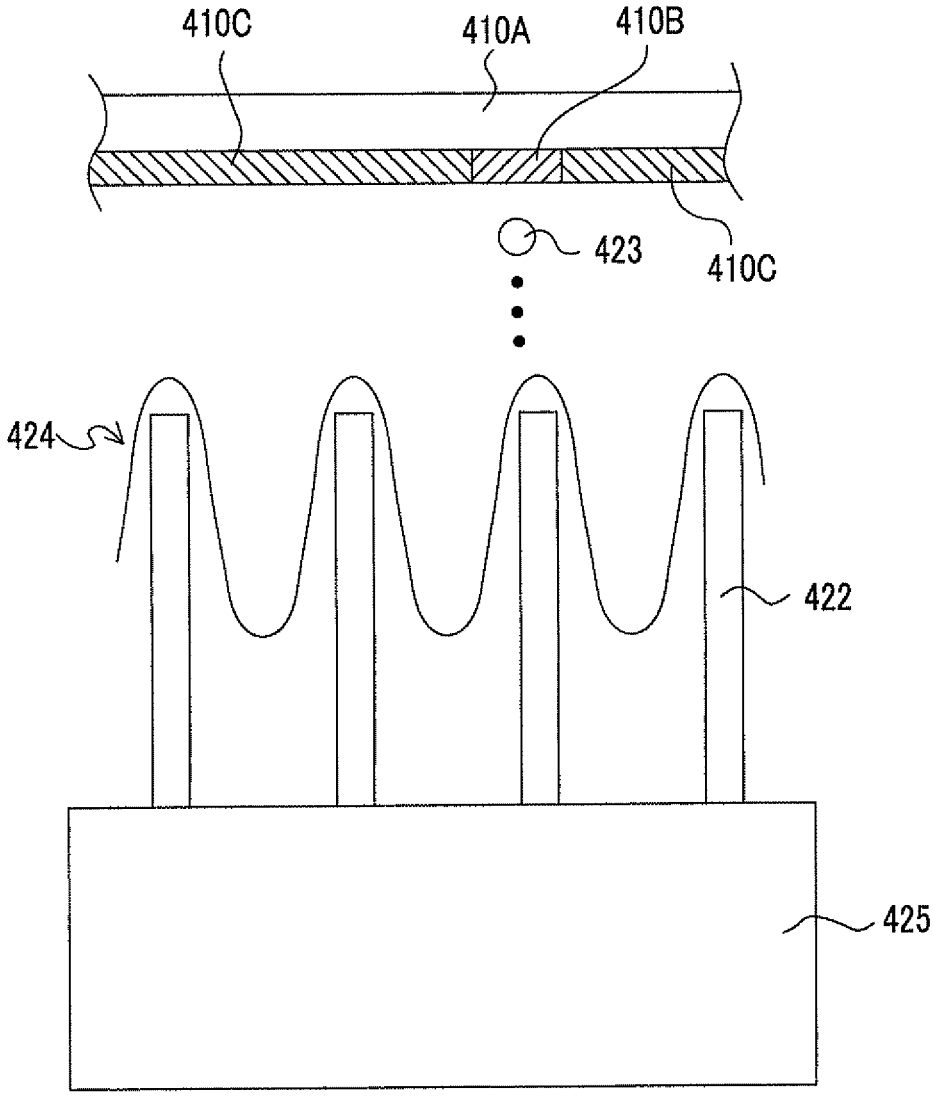
FIG. 7 is a schematic diagram showing a meniscus of a liquid developer that is formed around recording electrodes of the developing device and how the liquid moves to an image portion, in the image forming apparatus shown in FIG. 6.

Around the recording electrodes 422, a meniscus (a liquid-holding form that is formed on a member or between members contacting a liquid due to the viscosity or surface tension of the liquid, and the surface energy of the surface of the contacting member) 424 of the liquid developer is formed. FIG. 7 is a view showing the state of the meniscus. On an electrophotographic photoreceptor 410A to which a liquid particle 423 of the liquid developer flies, an electrostatic latent image to be an image portion is formed. At this time, an electrostatic latent image potential of from about 50 V to 100 V has been applied to an image portion 410B, and a potential of from about 500 V to 600 V has been applied to a non-image portion 410C. At this time, when a flying bias potential of 1000 V is applied to the recording electrodes 422 via a bias potential supplying unit 425, due to electric field concentration, a liquid developer having a higher solid contents ratio compared to the supplied liquid developer, that is, a high concentration liquid developer is supplied to the tip of the recording electrodes 422. Moreover, due to a potential difference (a threshold of a potential difference required for from 700 V to 800 V to detach) between the electrostatic latent image potential of the image portion 410C on the electrophotographic photoreceptor 410A and the flying bias potential of the recording electrodes 422, the liquid particles 423 from the high concentration liquid developer detach and are attached to the electrostatic latent image portion (image portion) of the electrophotographic photoreceptor 410A. In addition, in the developing device 420, the developing device itself plays a role of a developer cartridge.

The operation of the image forming apparatus 140 shown in FIG. 6 is the same as that of the image forming apparatus 130 shown in FIG. 4, except for the running pattern of the belt-shaped intermediate transfer member 401 and the operation of the developing device 420. Therefore, description thereof is omitted.

Figure 8:
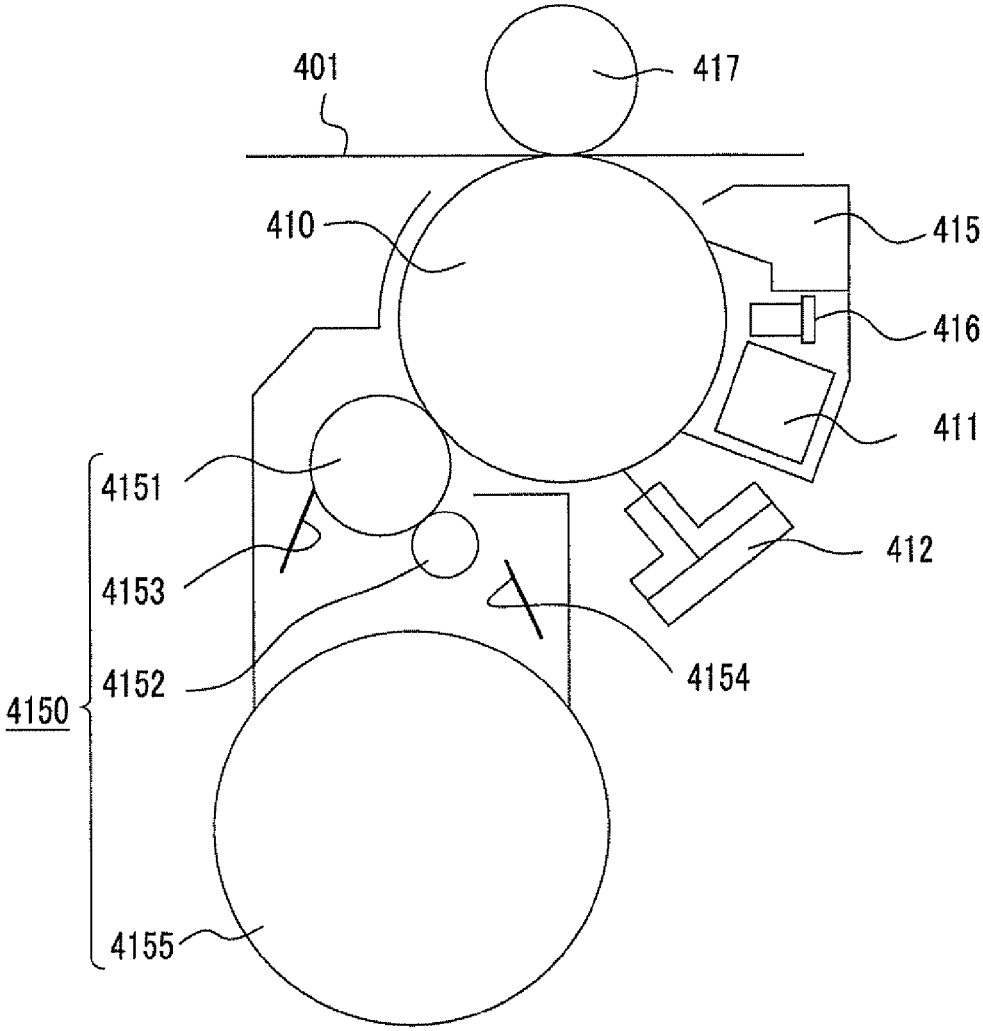
FIG. 8 is a schematic configuration view showing another developing device in the image forming apparatuses shown in FIGS. 4 and 6.

Herein, in the image forming apparatus using the liquid developer, the developing device is not limited to the above-described configuration, and the developing device may be, for example, the developing device shown in FIG. 8.

FIG. 8 is a schematic configuration view showing another developing device in the image forming apparatus shown in FIG. 4 or 6.

When the electrostatic latent image formed on the electrophotographic photoreceptor 410 is developed using a developing roll 4151 in the image forming apparatus 130 or 140 shown in FIG. 4 or 6, a developing device 4150 shown in FIG. 8 forms a liquid developer layer including a higher solid contents ratio compared to the liquid developer supplied from a developer cartridge 4155 on the developing roll 4151, and develops an image by using the liquid developer layer of which the concentration has been increased.

In order to form the liquid developer layer having an increased solid contents ratio on the developing roll 4151, an electric field is formed by creating a potential difference between a supplying roll 4152 and the developing roll 4151, whereby the liquid developer layer having a higher solid contents ratio compared to the proportion of solid contents in the liquid developer from the developer cartridge 4155 is formed on the developing roll 4151. For the developing roll 4151 and the supplying roll 4152, cleaning brushes 4153 and 4154 that clean the surface of the respective rolls are arranged.

Further, the image forming apparatus (process cartridge) described above according to the exemplary embodiment is not limited to the configurations above, and known configurations may also be applied.

EXAMPLES

Hereinafter, the invention will be described in detail with reference to Examples below, but the invention is not limited thereto.

Example 1

Preparation of Undercoat Layer 100 parts by weight of zinc oxide (average particle diameter: 70 nm, manufactured by Tayca Corporation, specific surface area: 15 $m^2/g$) is stirred and mixed with 500 parts by weight of toluene, and 1.3 parts by weight of a silane coupling agent (KBM503, manufactured by Shin-Etsu Chemical Co., Ltd.) is added thereto, followed by stirring for 2 hours. Subsequently, toluene is removed by distillation under reduced pressure and baked at a temperature of 120° C. for 3 hours to obtain zinc oxide having the surface treated with the silane coupling agent.

110 parts by weight of the surface-treated zinc oxide is stirred and mixed with 500 parts by weight of tetrahydrofuran, into which a solution having 0.6 part by weight of alizarin dissolved in 50 parts by weight of tetrahydrofuran is added, followed by stirring at a temperature of 50° C. for 5 hours. Subsequently, the zinc oxide to which the alizarin is added is collected by filtration under a reduced pressure, and dried under reduced pressure at a temperature of 60° C. to obtain alizarin-added zinc oxide.

38 parts by weight of a solution prepared by dissolving 60 parts by weight of the alizarin-added zinc oxide, 13.5 parts by weight of a curing agent (blocked isocyanate, Sumidur 3175, manufactured by Sumitomo-Bayer Urethane Co., Ltd.) and 15 parts by weight of a butyral resin (S-Lec BM-1, manufactured by Sekisui Chemical Co., Ltd.) in 85 parts by weight of methyl ethyl ketone is mixed with 25 parts by weight of methyl ethyl ketone. The mixture is dispersed using a sand mill with glass beads having a diameter of 1 mmϕ for 2 hours to obtain a dispersion.

0.005 part by weight of dioctyl tin dilaurate as a catalyst, and 40 parts by weight of silicone resin particles (Tospal 145, manufactured by GE Toshiba Silicone Co., Ltd.) are added to the dispersion to obtain a coating liquid for an undercoat layer.

An undercoat layer having a thickness of 18.7 μm is formed by coating the coating liquid on a cylindrical aluminum support having a diameter of 30 mm, a length of 340 mm and a thickness of 1 mm as a conductive support by dip coating, and drying to cure at a temperature of 170° C. for 40 minutes.

Preparation of Charge Generating Layer

A mixture including 15 parts by weight of hydroxygallium phthalocyanine having the diffraction peaks at least at the positions at 7.3°, 16.0°, 24.9°, and 28.0° of Bragg angles (2θ±0.2°) in an X-ray diffraction spectrum of Cukα characteristic X rays as a charge generating substance, 10 parts by weight of a vinyl chloride-vinyl acetate copolymer resin (VMCH, manufactured by Nippon Unicar Co., Ltd.) as a binder resin, and 200 parts by weight of n-butyl acetate is dispersed using a sand mill with the glass beads having a diameter of 1 mmϕ for 4 hours. 175 parts by weight of n-butyl acetate and 180 parts by weight of methyl ethyl ketone are added to the obtained dispersion, followed by stirring to obtain a coating liquid for forming a charge generating layer.

The obtained coating liquid for forming a charge generating layer is dip-coated on the undercoat layer formed in advance on the cylindrical aluminum support, and dried at an ordinary temperature (25° C.) to form a charge generating layer having a film thickness of 0.2 μm.

Preparation of Charge Transporting Layer

First, a polycarbonate copolymer (1) is obtained in the following manner.

In a flask equipped with a phosgene inlet tube, a thermometer, and a stirrer, 106.9 g (0.398 mole) of 1,1-bis(4-hydroxyphenyl)cyclohexane (Unit (Z)-0, which is hereinafter referred to as Z), 24.7 g (0.133 mole) of 4,4'-dihydroxybiphenyl (Unit (BP)-0, which is hereinafter referred to as BP), 0.41 g of hydrosulfide, 825 ml (sodium hydroxide 2.018 moles) of a 9.1% sodium hydroxide aqueous solution, and 500 ml of methylene chloride are combined and dissolved under a nitrogen atmosphere, maintained at from 18° C. to 21° C. under stirring, and 76.2 g (0.770 mole) of phosgene is introduced theretinto for 75 minutes to perform a reaction with the inlet phosgenation. After the end of the phosgenation reaction, 1.11 g (0.0075 mole) of p-tert-butylphenol and 54 ml (sodium hydroxide 0.266 mole) of a 25% sodium hydroxide aqueous solution are added thereto, followed by stirring, while 0.18 mL (0.0013 mole) of triethylamine is added thereto to perform a reaction at a temperature of from 30° C. to 35° C. for 2.5 hours. The separated methylene chloride phase is washed with an acid and water until the inorganic salts and the amines disappear, and then methylene chloride is removed to obtain a polycarbonate. The polycarbonate has a ratio of structural units of Z to BP of 75:25 in terms of a molar ratio.

Next, 40 parts by weight of N,N'-diphenyl-N,N'-bis(3-methylphenyl)-[1,1']biphenyl-4,4'-diamine (TPD), 10 parts by weight of N,N-bis(3,4-dimethylphenyl)biphenyl-4-amine, and 55 parts by weight of the polycarbonate copolymer (1) (viscosity average molecular weight of 50,000) as a binder resin are dissolved in 560 parts by weight of tetrahydrofuran and 240 parts by weight of toluene to obtain a coating liquid for a charge transporting layer. This coating liquid is coated on the charge generating layer and dried at 135° C. for 45 minutes to form a charge transporting layer having a film thickness of 25 μm.

Preparation of Protective Layer

To the suspension are added 100 parts by weight of an exemplary compound (I-a)-31 as a reactive group-containing charge transporting material, 2 parts by weight of VE-73 (manufactured by Wako Pure Chemical Industries, Ltd.) of a polymerization initiator, and 300 parts by weight of isobutyl acetate, followed by stirring and mixing at room temperature for 12 hours to obtain a coating liquid for forming a protective layer.

Next, the obtained coating liquid for forming a protective layer is coated on the charge transporting layer previously formed on the cylindrical aluminum support at an extrusion rate of 150 mm/min by a ring coating method. Thereafter, a curing reaction is carried out at a temperature of 160±5° C. for 60 minutes in the state of an oxygen concentration of 200 ppm or less in a nitrogen dryer having an oxygen concentration system to form a protective layer. The film thickness of the protective layer is 7 μm.

As described above, an electrophotographic photoreceptor is prepared.

Examples 2 to 5, Comparative Examples 1 and 2, and Comparative Examples 4 to 7

An undercoat layer and a charge generating layer are formed on a cylindrical aluminum support by the method described in Example 1 by sequential coating. Thereafter, according to Tables 1 and 2 below, the protective layer is formed by the method described in Example 1 except that the binder resin of the charge transporting layer, the chain polymerizable group-containing charge transporting material (denoted as "RCTM" in the Tables) of the coating liquid for forming a protective layer and the solvent (denoted as "SOL" in the Tables), thereby preparing an electrophotographic photoreceptor.

Furthermore, the respective polycarbonate copolymers (denoted as "PC copolymers" in the Tables) used in the respective Examples are synthesized according to the synthesis of the polycarbonate copolymer (1) in correspondence with the repeating structural units (denoted as "units" in the Tables).

Comparative Example 3

An undercoat layer and a charge generating layer are formed on a cylindrical aluminum support by sequential coating by the method described in Example 1.

Preparation of Charge Transporting Layer 40 parts by weight of N,N'-diphenyl-N,N'-bis(3-methylphenyl)-[1,1']biphenyl-4,4'-diamine (TPD), 10 parts by weight of N,N-bis(3,4-dimethylphenyl)biphenyl-4-amine, and 55 parts by weight of polycarbonate ("C-1400 WP (bisphenol A) polycarbonate, manufactured by Teijin Chemicals Ltd.", viscosity average molecular weight of 50,000) are added to 800 parts by weight of dichloromethane and the mixture is dissolved therein to obtain a coating liquid for a charge transporting layer. This coating liquid is coated onto the charge generating layer, followed by drying at 135° C. for 45 minutes, thereby forming a charge transporting layer having a thickness of 25 μm.

Thereafter, according to Table 2 below, the protective layer is formed by the method described in Example 1 except that the binder resin of the charge transporting layer, the chain polymerizable group-containing charge transporting material (denoted as "RCTM" in the Tables) of the coating liquid for forming a protective layer and the solvent (denoted as "SOL" in the Tables), thereby preparing an electrophotographic photoreceptor.

Evaluation

Measurement of A and B Values

The A and B values (the A value represented by the equation (1) and the B value represented by the equation (2)) of the protective layer of the electrophotographic photoreceptor obtained in each of Examples are investigated according to the methods as described above. The results as well as S1, S13, S0, S03, S2, and S23 for calculating the A and B values are shown in Table 3.

Performance Evaluation

The electrophotographic photoreceptor obtained in each of Examples is installed in Docucentre-IVC2260 manufactured by Fuji Xerox Co., Ltd., and images are continuously printed on 100,000 sheets of A4 paper under an environment of 28° C. and 80% RH, with the printing image having a solid image portion having an image concentration of 100% and a half-tone image portion having an image concentration of 20% and a fine-line image portion.

For the images at the initial time at the $100^{th}$ sheet and after the passage of time at the $100{,}000^{th}$ sheet, evaluation of the scratch resistance and confirmation of the presence or absence of blade curling are carried out. Further, for the electrophotographic photoreceptor at the initial time (after printing 100 sheets) and after printing 100,000 sheets in the print test, the residual potential (Rp) after the removal of charge is measured by providing a surface potential probe (at a position of 1 mm from the surface of the electrophotographic photoreceptor) in an area to be measured, using a surface potential meter (Trek 334, manufactured by Trek Co., Ltd.), and the difference (ΔRp) between the initial residual potential and the residual potential after printing 100,000 sheets is calculated. The results are shown in Table 3.

In addition, in the image forming test, P paper (A4 size, horizontal transport) manufactured by Fuji Xerox Co., Ltd. is used.

Evaluation of Scratch Resistance

The surface of the electrophotographic photoreceptor after printing 100,000 sheets in the print test is visually observed to carry out evaluation according to the following criteria.

A+: Scratch is almost not generated.

A: Scratch is partially generated.

B: Little scratch is wholly generated.

C: Scratch is wholly generated.

Residual Potential

The residual potential is evaluated according to the following criteria.

A+: Less than 20 V
A: from 20 V to less than 50 V
B: from 50 V to less than 80 V
C: 80 V or more Overall Evaluation The respective evaluations above are combined, and thus, overall evaluation of the electrophotographic photoreceptor and the image forming systems is conducted. Further, the evaluation criteria are as follows.

A+: Extraordinarily excellent
A: Excellent
B: Although there are some problems, there is no problem in practical use.
C: There is a problem in practical use

TABLE 1

| | Coating liquid for forming a protective layer | | Binder resin of charge transporting layer | | | | | | | | | | | |
|---|---|---|---|---|---|---|---|---|---|---|---|---|---|---|
| | | | | | Viscosity average | Unit 1 | | | Unit 2 | | | Unit 3 | | |
| | Type of RCTM | Type of SOL | Type | SP value | molecular weight | Type | Molar ratio | SP value | Type | Molar ratio | SP value | Type | Molar ratio | SP value |
| Example 1 | a-1 | IBA | PC copolymer (1) | 11.56 | 50,000 | (Z)-0 | 75 | 11.28 | (BP)-0 | 25 | 12.39 | | | |
| Example 2 | a-2 | IBA | PC copolymer (1) | 11.56 | 50,000 | (Z)-0 | 75 | 11.28 | (BP)-0 | 25 | 12.39 | | | |
| Example 3 | a-3 | IBA | PC copolymer (1) | 11.56 | 50,000 | (Z)-0 | 75 | 11.28 | (BP)-0 | 25 | 12.39 | | | |
| Example 4 | a-4 | IBA | PC copolymer (1) | 11.56 | 50,000 | (Z)-0 | 75 | 11.28 | (BP)-0 | 25 | 12.39 | | | |
| Example 5 | a-5 | IBA | PC copolymer (1) | 11.56 | 50,000 | (Z)-0 | 75 | 11.28 | (BP)-0 | 25 | 12.39 | | | |
| Example 6 | a-6 | IBA | PC copolymer (1) | 11.56 | 50,000 | (Z)-0 | 75 | 11.28 | (BP)-0 | 25 | 12.39 | | | |
| Example 21 | a-6 | EA | PC copolymer (1) | 11.56 | 50,000 | (Z)-0 | 75 | 11.28 | (BP)-0 | 25 | 12.39 | | | |
| Example 22 | a-6 | MIBK | PC copolymer (1) | 11.56 | 50,000 | (Z)-0 | 75 | 11.28 | (BP)-0 | 25 | 12.39 | | | |
| Example 23 | a-6 | Di-n-propylketone | PC copolymer (1) | 11.56 | 50,000 | (Z)-0 | 75 | 11.28 | (BP)-0 | 25 | 12.39 | | | |
| Example 24 | a-6 | MEK | PC copolymer (1) | 11.56 | 50,000 | (Z)-0 | 75 | 11.28 | (BP)-0 | 25 | 12.39 | | | |
| Example 8 | a-6 | IBA | PC copolymer (3) | 11.46 | 50,000 | (Z)-0 | 80 | 11.28 | (BP)-0 | 10 | 12.39 | (F)-0 | 10 | 12.02 |
| Example 9 | a-6 | IBA | PC copolymer (4) | 11.44 | 50,000 | (Z)-0 | 85 | 11.28 | (BP)-0 | 15 | 12.39 | | | |
| Example 10 | a-6 | IBA | PC copolymer (5) | 11.52 | 50,000 | (Z)-0 | 70 | 11.28 | (BP)-1 | 30 | 12.07 | | | |
| Example 11 | a-6 | IBA | PC copolymer (6) | 11.65 | 50,000 | (Z)-0 | 50 | 11.28 | (F)-0 | 50 | 12.02 | | | |
| Example 12 | a-6 | IBA | PC copolymer (7) | 11.45 | 50,000 | (Z)-0 | 45 | 11.28 | (E)-0 | 55 | 11.59 | | | |
| Example 13 | a-6 | IBA | PC copolymer (9) | 11.63 | 50,000 | (A)-0 | 50 | 11.24 | (F)-0 | 50 | 12.02 | | | |
| Example 14 | a-6 | IBA | PC copolymer (10) | 11.51 | 50,000 | (A)-0 | 65 | 11.24 | (F)-0 | 35 | 12.02 | | | |
| Example 15 | a-7 | IBA | PC copolymer (1) | 11.56 | 50,000 | (Z)-0 | 75 | 11.28 | (BP)-0 | 25 | 12.39 | | | |
| Example 16 | a-8 | IBA | PC copolymer (1) | 11.56 | 50,000 | (Z)-0 | 75 | 11.28 | (BP)-0 | 25 | 12.39 | | | |
| Example 17 | a-6 | IBA | PC copolymer (14) | 11.47 | 50,000 | (Z)-0 | 40 | 11.28 | (E)-0 | 60 | 11.59 | | | |
| Example 18 | a-6 | IBA | PC copolymer (15) | 11.47 | 50,000 | (A)-0 | 70 | 11.24 | (F)-0 | 30 | 12.02 | | | |
| Example 19 | a-9 | IBA | PC copolymer (1) | 11.56 | 50,000 | (Z)-0 | 75 | 11.28 | (BP)-0 | 25 | 12.39 | | | |
| Example 20 | a-10 | IBA | PC copolymer (1) | 11.56 | 50,000 | (Z)-0 | 75 | 11.28 | (BP)-0 | 25 | 12.39 | | | |
| Example 25 | a-11 | IBA | PC copolymer (1) | 11.56 | 50,000 | (Z)-0 | 75 | 11.28 | (BP)-0 | 25 | 12.39 | | | |

TABLE 2

| | Coating liquid for forming a protective layer | | Binder resin of charge transporting layer | | | | | | | | | | | |
|---|---|---|---|---|---|---|---|---|---|---|---|---|---|---|
| | | | | | Viscosity average | Unit 1 | | | Unit 2 | | | Unit 3 | | |
| | Type of RCTM | Type of SOL | Type | SP value | molecular weight | Type | Molar ratio | SP value | Type | Molar ratio | SP value | Type | Molar ratio | SP value |
| Comparative Example 1 | a-6 | IBA | b-1 | 11.28 | 50,000 | (Z)-0 | 100 | 11.28 | | | | | | |
| Comparative Example 2 | a-6 | IBA | PC copolymer (11) | 11.33 | 50,000 | (Z)-0 | 95 | 11.28 | (BP)-0 | 5 | 12.39 | | | |
| Comparative Example 3 | a-6 | IBA | b-2 | 11.24 | 40,000 | (A)-0 | 100 | 11.24 | | | | | | |
| Comparative Example 4 | a-6 | IBA | PC copolymer (12) | 11.32 | 50,000 | (A)-0 | 90 | 11.24 | (F)-0 | 10 | 12.02 | | | |
| Comparative Example 6 | a-6 | MFG | PC copolymer (1) | 11.56 | 50,000 | (Z)-0 | 75 | 11.28 | (BP)-0 | 25 | 12.39 | | | |
| Comparative Example 5 | a-6 | IBA | PC copolymer (13) | 11.82 | 50,000 | (A)-0 | 25 | 11.24 | (F)-0 | 75 | 12.02 | | | |
| Comparative Example 7 | a-6 | MEK | b-1 | 11.28 | 50,000 | (Z)-0 | 100 | 11.28 | | | | | | |

TABLE 3

| | S1 | S13 | S0 | S03 | S2 | S23 | A value = (S1/S13) − (S0/S03) | B value = S2/S23 | Scratch resistance | Residual potentiaL Rp | Overall evaluation |
|---|---|---|---|---|---|---|---|---|---|---|---|
| Example 1 | 0.36 | 2.43 | 0.00 | 2.21 | 0.04 | 2.67 | 0.15 | 0.016 | A | A | A |
| Example 2 | 0.44 | 2.58 | 0.00 | 2.35 | 0.04 | 2.84 | 0.17 | 0.015 | A | A | A |
| Example 3 | 0.36 | 2.76 | 0.00 | 2.51 | 0.03 | 3.04 | 0.13 | 0.009 | A+ | A | A+ |
| Example 4 | 0.34 | 2.25 | 0.00 | 2.05 | 0.04 | 2.48 | 0.15 | 0.015 | A+ | A | A+ |
| Example 5 | 0.41 | 2.55 | 0.00 | 2.32 | 0.04 | 2.81 | 0.16 | 0.014 | A+ | A | A+ |
| Example 6 | 0.40 | 2.64 | 0.00 | 2.40 | 0.05 | 2.90 | 0.15 | 0.018 | A+ | A | A+ |
| Example 21 | 0.64 | 2.65 | 0.00 | 2.41 | 0.05 | 2.92 | 0.24 | 0.017 | A | A | A |
| Example 22 | 0.50 | 2.51 | 0.00 | 2.28 | 0.05 | 2.76 | 0.20 | 0.018 | A | A | A |
| Example 23 | 0.45 | 2.37 | 0.00 | 2.15 | 0.04 | 2.61 | 0.19 | 0.016 | A | A | A |
| Example 24 | 0.61 | 2.43 | 0.00 | 2.21 | 0.05 | 2.67 | 0.25 | 0.017 | A | A | A |
| Example 8 | 0.46 | 2.30 | 0.00 | 2.09 | 0.04 | 2.53 | 0.20 | 0.015 | A | A | A |
| Example 9 | 0.55 | 2.50 | 0.00 | 2.27 | 0.05 | 2.75 | 0.22 | 0.017 | A | A | A |
| Example 10 | 0.48 | 2.68 | 0.00 | 2.44 | 0.04 | 2.95 | 0.18 | 0.014 | A | A | A |
| Example 11 | 0.31 | 2.55 | 0.00 | 2.32 | 0.03 | 2.81 | 0.12 | 0.009 | A | A | A |
| Example 12 | 0.47 | 2.34 | 0.00 | 2.13 | 0.03 | 2.57 | 0.20 | 0.012 | A | A | A |
| Example 13 | 0.33 | 2.36 | 0.00 | 2.15 | 0.03 | 2.60 | 0.14 | 0.013 | A | A | A |
| Example 14 | 0.33 | 2.51 | 0.00 | 2.28 | 0.04 | 2.76 | 0.13 | 0.013 | A | A | A |
| Example 15 | 0.34 | 2.46 | 0.00 | 2.24 | 0.03 | 2.71 | 0.14 | 0.012 | B | B | B |
| Example 16 | 0.62 | 2.60 | 0.21 | 2.36 | 0.03 | 2.86 | 0.15 | 0.012 | B | B | B |
| Example 17 | 0.55 | 2.40 | 0.00 | 2.18 | 0.04 | 2.64 | 0.23 | 0.017 | A | A | A |
| Example 18 | 0.56 | 2.55 | 0.00 | 2.32 | 0.05 | 2.81 | 0.22 | 0.018 | A | A | A |
| Example 19 | 0.48 | 2.66 | 0.00 | 2.42 | 0.04 | 2.93 | 0.18 | 0.015 | A+ | A | A+ |
| Example 20 | 0.40 | 2.35 | 0.00 | 2.14 | 0.04 | 2.59 | 0.17 | 0.014 | A+ | A | A+ |
| Example 25 | 0.36 | 2.80 | 0.00 | 2.55 | 0.03 | 3.08 | 0.13 | 0.011 | A+ | A | A+ |
| Comparative Example 1 | 0.59 | 2.35 | 0.00 | 2.14 | 0.07 | 2.59 | 0.25 | 0.026 | C | A | C |
| Comparative Example 2 | 0.59 | 2.26 | 0.00 | 2.05 | 0.08 | 2.49 | 0.26 | 0.031 | C | A | C |
| Comparative Example 3 | 0.75 | 2.60 | 0.00 | 2.36 | 0.10 | 2.86 | 0.29 | 0.035 | C | A | C |
| Comparative Example 4 | 0.78 | 2.80 | 0.00 | 2.55 | 0.10 | 3.08 | 0.28 | 0.032 | C | A | C |
| Comparative Example 6 | 0.00 | 2.12 | 0.00 | 1.93 | 0.00 | 2.33 | 0.00 | 0.000 | A | C | C |
| Comparative Example 6 | 0.12 | 2.33 | 0.00 | 2.12 | 0.01 | 2.56 | 0.05 | 0.005 | A | C | C |
| Comparative Example 7 | 0.70 | 2.11 | 0.00 | 1.92 | 0.09 | 2.32 | 0.33 | 0.04 | C | C | C |

From the above results, it can be seen that in the present Examples, the satisfactory results are obtained in evaluation of all of scratch resistance and residual potentials, as compared with Comparative Examples.

The details of the abbreviations shown in Tables are shown below.

RCTM: chain polymerizable group-containing charge transporting material (a-1): Exemplary compound (I-a)-31

(a-2): Exemplary compound (I-b)-31

(a-3): Exemplary compound (I-c)-43

(a-4): Exemplary compound (I-c)-52 (see the following synthesis method)

(a-5): Exemplary compound (II)-54

(a-6): Exemplary compound (II)-55

(a-7): Compound represented by the following formula CTM-1

(a-8): Compound represented by the following formula CTM-2

(a-9): Exemplary compound (II)-181

(a-10): Exemplary compound (II)-182

(a-11): Exemplary compound (I-d)-22

Synthesis of Exemplary Compound (I-c)-52

To a 500-ml flask, 22 g of the following compound (2), 33 g of t-butoxy potassium, 300 ml of tetrahydrofuran, and 0.2 g of nitrobenzene are added. While this mixture is stirred under a nitrogen gas flow, a solution obtained by dissolving 25 g of 4-chloromethyl styrene in 150 ml of tetrahydrofuran is slowly added dropwise thereto. After the completion of dropwise addition, the resultant is heated and refluxed for 4 hours, followed by cooling, poured into water, and extracted with toluene. The toluene layer is sufficiently washed with water and then concentrated, and the obtained oily substance is purified by silica gel column chromatography to obtain 29 g of an oily exemplary compound (I-c)-52.

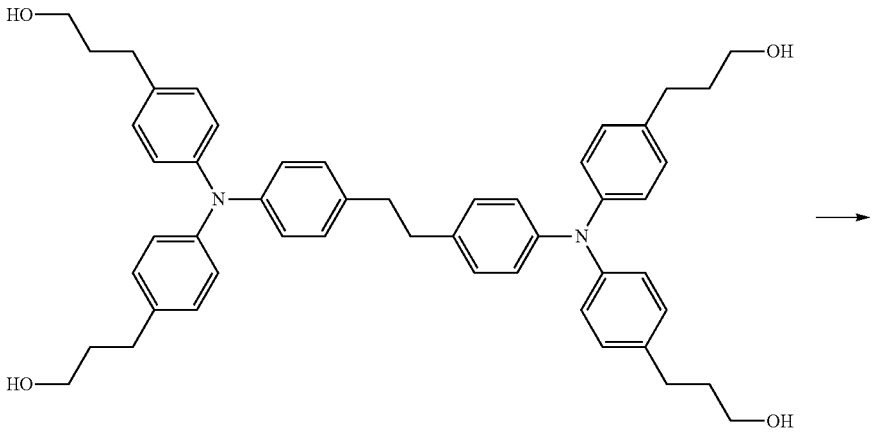
(2)
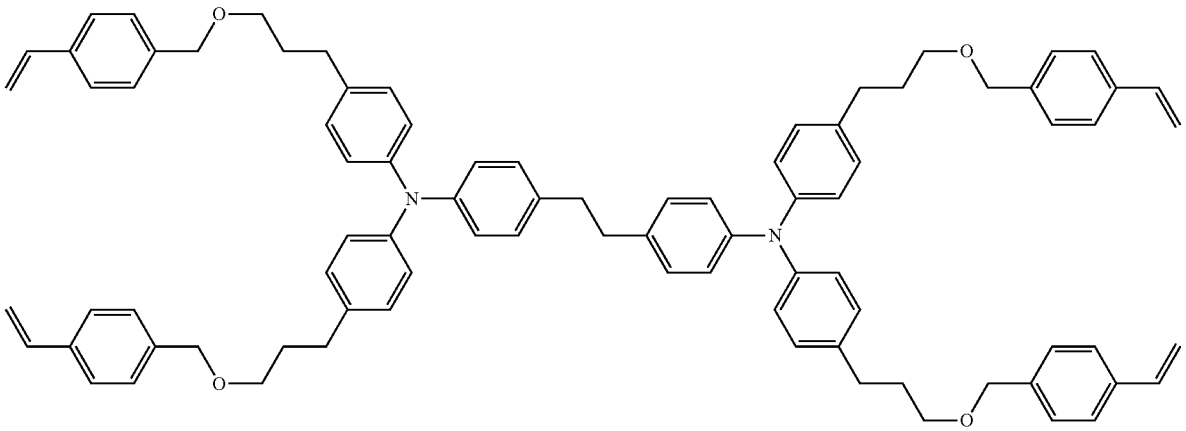
In addition, the other exemplary compounds are synthesized in accordance with the above synthesis.
(CTM-1)
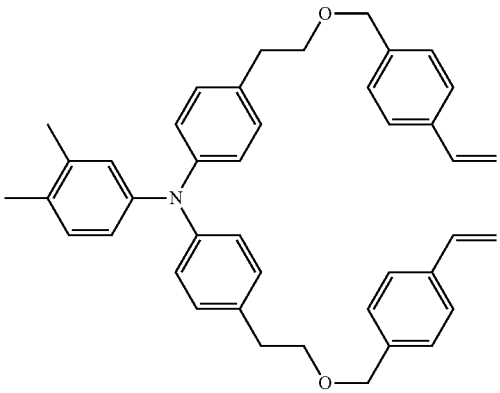
-continued
(CTM-2)
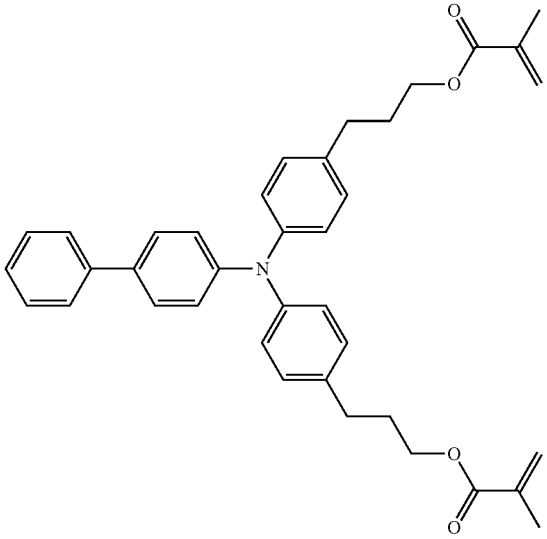

SOL: Solvent
IBA: Isobutyl acetate (SP value=8.5)
EA: Ethyl acetate (SP value=8.7)
MIBK: Methyl isobutyl ketone (SP value=8.7)
Di-n-propyl ketone: (SP value=8.8)
MEK: Methyl ethyl ketone (SP value=9.0)
MFG: 1-Methoxy-2-propanol
Binder Resins
(b-1): PCZ-400 (bisphenol (Z) polycarbonate, manufactured by Mitsubishi Gas Chemical Company, Inc.)
(b-2): C-1400 WP (bisphenol (A) polycarbonate, manufactured by Mitsubishi Gas Chemical Company, Inc.)

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An electrophotographic photoreceptor comprising:
a conductive substrate;
a charge generating layer provided on the conductive substrate;
a charge transporting layer provided on the charge generating layer, which is configured to include a charge transporting material and a polycarbonate; and
an outermost surface layer provided on the charge transporting layer, which is constituted with a cured film formed of a composition including a chain polymerizable compound having at least a charge transporting skeleton and a chain polymerizable functional group in the same molecule, and has an A value represented by the following equation (1) being from 0.1 to 0.3, and a B value represented by the following equation (2) being 0.02 or less, each of which is determined by an Attenuated total reflection Fourier transform infrared spectroscopy:

$$A=(S1/S13)-(S0/S03) \quad \text{Equation (1)}$$

$$B=S2/S23 \quad \text{Equation (2)}$$

wherein in the equations (1) and (2),
S1 represents a peak area of a peak based on a monosubstituted benzene in the outermost surface layer (a peak in the range from 685 $cm^{-1}$ to 715 $cm^{-1}$);
S13 represents a peak area of a peak based on C=C stretching vibration of aromatics of the outermost surface layer (a peak in the range from 1500 $cm^{-1}$ to 1525 $cm^{-1}$);
S0 represents a peak area of a peak based on a monosubstituted benzene of a washed outermost surface layer (a peak in the range from 685 $cm^{-1}$ to 715 $cm^{-1}$);
S03 represents a peak area of a peak based on C=C stretching vibration of aromatics of the washed outermost surface layer (a peak in the range from 1500 $cm^{-1}$ to 1525 $cm^{-1}$);
S2 represents a peak area of a peak based on a C=O bond of a polycarbonate of the outermost surface layer (a peak in the range from 1750 $cm^{-1}$ to 1800 $cm^{-1}$); and
S23 represents a peak area of a peak based on C=C stretching vibration of aromatics of the outermost surface layer (a peak in the range from 1500 $cm^{-1}$ to 1525 $cm^{-1}$); and
wherein the polycarbonate is a polycarbonate copolymer having a solubility parameter calculated by a Feders method of 11.40 to 11.75.

2. The electrophotographic photoreceptor according to claim 1, wherein the polycarbonate copolymer has a repeating structural unit having a solubility parameter calculated by a Feders method of 12.20 to 12.40.

3. The electrophotographic photoreceptor according to claim 1, wherein the polycarbonate copolymer is a polycarbonate copolymer having the repeating structural units represented by the following formula (PC-1):

(PC-1)

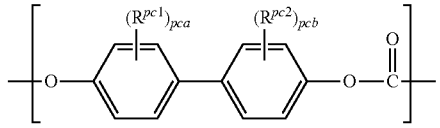

wherein in the formula (PC-1), $R^{pc1}$ and $R^{pc2}$ each independently represent a halogen atom, an alkyl group having 1 to 6 carbon atoms, a cycloalkyl group having 5 to 7 carbon atoms, or an aryl group having 6 to 12 carbon atoms; and pca and pcb each independently represent an integer of 0 to 4.

4. The electrophotographic photoreceptor according to claim 3, wherein a ratio of the repeating structural unit represented by the formula (PC-1) is from 20% by mole to 40% by mole based on the polycarbonate copolymer.

5. The electrophotographic photoreceptor according to claim 1, wherein the polycarbonate copolymer is a polycarbonate copolymer having the repeating structural units represented by the following formula (PC-2):

(PC-2)

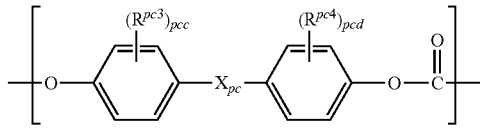

wherein in the formula (PC-2), $R^{pc3}$ and $R^{pc4}$ each independently represent a halogen atom, an alkyl group having 1 to 6 carbon atoms, a cycloalkyl group having 5 to 7 carbon atoms, or an aryl group having 6 to 12 carbon atoms; pcc and pcd each independently represent an integer of 0 to 4; and $X_{pc}$ represents —$CR^{pc5}R^{pc6}$— (provided that $R^{pc5}$ and $R^{pc6}$ each independently represent a hydrogen atom, a trifluoromethyl group, an alkyl group having 1 to 6 carbon atoms, or an aryl group having 6 to 12 carbon atoms), a 1,1-cycloalkylene group having 5 to 11 carbon atoms, an α,ω-alkylene group having 2 to 10 carbon atoms, —O—, —S—, —SO—, or —$SO_2$—.

6. The electrophotographic photoreceptor according to claim 5, wherein a ratio of the repeating structural unit represented by the formula (PC-2) is from 35% by mole to 55% by mole.

7. The electrophotographic photoreceptor according to claim 1, wherein the chain polymerizable compound of the outermost surface layer is at least one selected from the chain polymerizable compounds represented by the formulae (I) and (II):

(I)

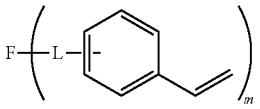

wherein in the formula (I), F represents a charge transporting skeleton; L represents a divalent linking group including two or more selected from the group consisting of an alkylene group, an alkenylene group, —C(=O)—, —N(R)—, —S—, and —O—; R represents a hydrogen atom, an alkyl group, an aryl group, or an aralkyl group; and m represents an integer of 1 to 8, (II)

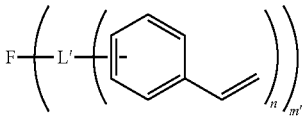

wherein in the formula (II), F represents a charge transporting skeleton; L' represents an (n+1)-valent linking group including two or more selected from the group consisting of a trivalent or tetravalent group derived from an alkane or an alkene, an alkylene group, an alkenylene group, —C(=O)—, —N(R)—, —S—, and —O—; R represents a hydrogen atom, an alkyl group, an aryl group, or an aralkyl group; m' represents an integer of 1 to 6; and n represents an integer of 2 to 3.

8. The electrophotographic photoreceptor according to claim 7, wherein the chain polymerizable compound represented by the formula (I) is at least one chain polymerizable compound selected from the chain polymerizable compounds represented by the formula (I-a), (I-b), (I-c), and (I-d):

(I-a)

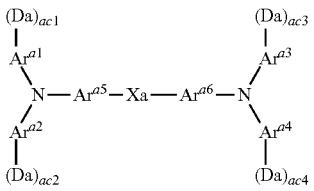

wherein in the formula (I-a), $Ar^{a1}$ to $Ar^{a4}$ each independently represent a substituted or unsubstituted aryl group. $Ar^{a5}$ and $Ar^{a6}$ each independently represent a substituted or unsubstituted arylene group; Xa represents a divalent linking group formed by a combination of the groups selected from an alkylene group, —O—, —S—, and an ester group; Da represents a group represented by the following formula (IA-a); and ac1 to ac4 each independently represent an integer of 0 to 2; provided that the total number of Da is 1 or 2:

(IA-a)

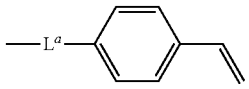

wherein in the formula (IA-a), $L^a$ is represented by *—$(CH_2)_{an}$—O—$CH_2$— and represents a divalent linking group linked to a group represented by $Ar^{a1}$ to $Ar^{a4}$ at *; and an represents an integer of 1 or 2:

(I-b)

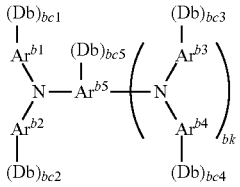

wherein in the formula (I-b), $Ar^{b1}$ to $Ar^{b4}$ each independently represent a substituted or unsubstituted aryl group; $Ar^{b5}$ represents a substituted or unsubstituted aryl group, or a substituted or unsubstituted arylene group; Db represents a group represented by the following formula (IA-b); bc1 to bc5 each independently represent an integer of 0 to 2; and bk represents 0 or 1; provided that the total number of Db is 1 or 2:

(IA-b)

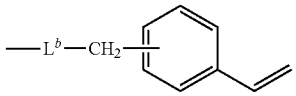

wherein in the formula (IA-b), $L^b$ includes a group represented by *—$(CH_2)_{bn}$—O— and represents a divalent linking group linked to a group represented by $Ar^{b1}$ to $Ar^{b5}$ at *; and bn represents an integer of 3 to 6:

(I-c)

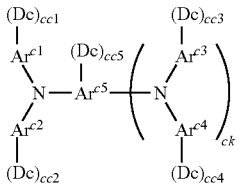

wherein in the formula (I-c), $Ar^{c1}$ to $Ar^{c4}$ each independently represent a substituted or unsubstituted aryl group; $Ar^{c5}$ represents a substituted or unsubstituted aryl group, or a substituted or unsubstituted arylene group; Dc represents a group represented by the following formula (IA-c); cc1 to cc5 each independently represent an integer of 0 to 2; and ck represents 0 or 1; provided that the total number of Dc is from 1 to 8:

(IA-c)

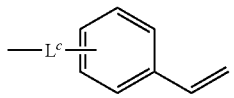

wherein in the formula (IA-c), $L^c$ represents a divalent linking group including one or more groups selected from the group consisting of —C(=O)—, —N(R)—, —S— and the groups formed by a combination of —C(=O)—, and —O—, —N(R)—, or —S—; and R represents a hydrogen atom, an alkyl group, an aryl group, or an aralkyl group:

(I-d)

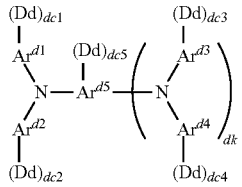

wherein in the formula (I-d), $Ar^{d1}$ to $Ar^{d4}$ each independently represent a substituted or unsubstituted aryl group; $Ar^{d5}$ represents a substituted or unsubstituted aryl group, or a substituted or unsubstituted arylene group; Dd represents a group represented by the following formula (IA-d); dc1 to dc5 each independently represent an integer of 0 to 2; and dk represents 0 or 1; provided that the total number of Dd is from 3 to 8:

(IA-d)

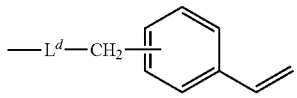

wherein in the formula (IA-d), $L^d$ includes a group represented by *—$(CH_2)_{dn}$—O—, and represents a divalent linking group linked to a group represented by $Ar^{d1}$ to $Ar^{d5}$ at *; and do represents an integer of 1 to 6.

9. The electrophotographic photoreceptor according to claim 8, wherein the group represented by the formula (IA-c) is a group represented by the following formula (IA-c1):

(IA-c1)

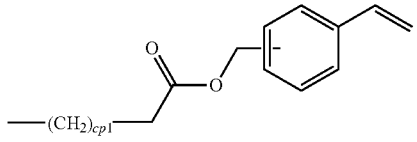

wherein in the formula (IA-c1), cp1 represents an integer of 0 to 4.

10. The electrophotographic photoreceptor according to claim 7, wherein the chain polymerizable compound represented by the formula (II) is a chain polymerizable compound represented by the following formula (II-a):

(II-a)

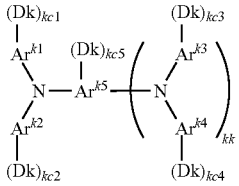

wherein in the formula (II-a), $Ar^{k1}$ to $Ar^{k4}$ each independently represent a substituted or unsubstituted aryl group; $Ar^{k5}$ represents a substituted or unsubstituted aryl group, or a substituted or unsubstituted arylene group; Dk represents a group represented by the following formula (IIA-a); kc1 to kc5 each independently represent an integer of 0 to 2; and kk represents 0 or 1; provided that the total number of Dk is from 1 to 8:

(IIA-a)

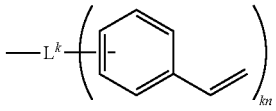

wherein in the formula (IIA-a), $L^k$ represents a (kn+1)-valent linking group including two or more selected from the group consisting of a trivalent or tetravalent group derived from an alkane or an alkene, and an alkylene group, an alkenylene group, —C(=O)—, —N(R)—, —S—, and —O—; R represents a hydrogen atom, an alkyl group, an aryl group, or an aralkyl group; and kn represents an integer of 2 to 3.

11. The electrophotographic photoreceptor according to claim 10, wherein the group linked to the charge transporting skeleton represented by F of the compound represented by the formula (II) is a group represented by the following formula (IIA-a1) or (IIA-a2):

(IIA-a1)

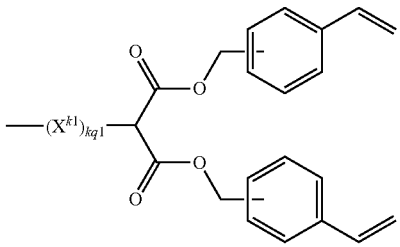

(IIA-a2)

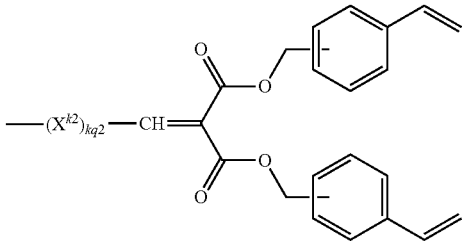

wherein in the formula (IIA-a1) or (IIA-a2), X presents a divalent linking group; kq1 represents an integer of 0 or 1; $X^{k2}$ represents a divalent linking group; and kq2 represents an integer of 0 or 1.

12. The electrophotographic photoreceptor according to claim 10, wherein the group linked to the charge transporting skeleton represented by F of the chain polymerizable compound represented by the formula (II) is a group represented by the following formula (IIA-a3) or (IIA-a4):

(IIA-a3)

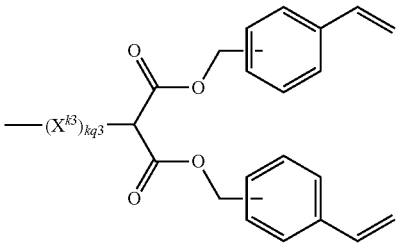

(IIA-a4)

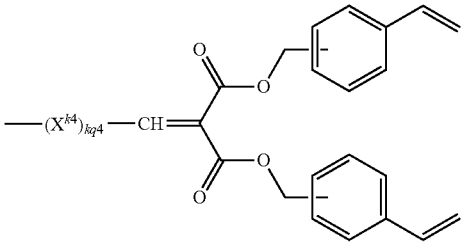

wherein in the formula (IIA-a3) or (IIA-a4), $X^{k3}$ represents a divalent linking group; kq3 represents an integer of 0 or 1; $X^{k4}$ represents a divalent linking group; and kq4 represents an integer of 0 or 1.

13. A process cartridge comprising the electrophotographic photoreceptor according to claim 1, which is detachable from an image forming apparatus.

14. An image forming apparatus comprising:

the electrophotographic photoreceptor according to claim 1;

a charging unit that charges a surface of the electrophotographic photoreceptor;

an electrostatic latent image forming unit that forms an electrostatic latent image on a charged surface of the electrophotographic photoreceptor;

a developing unit that develops the electrostatic latent image formed on the surface of the electrophotographic photoreceptor with a developer including a toner to form a toner image; and a transfer unit that transfers the toner image onto a transfer medium.

* * * * *